US011612921B2

(12) United States Patent
Ishii et al.

(10) Patent No.: US 11,612,921 B2
(45) Date of Patent: Mar. 28, 2023

(54) ROLLING MILL, AND METHOD FOR SETTING ROLLING MILL

(71) Applicant: NIPPON STEEL CORPORATION, Tokyo (JP)

(72) Inventors: Atsushi Ishii, Tokyo (JP); Daisuke Kasai, Tokyo (JP); Daisuke Nikkuni, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 179 days.

(21) Appl. No.: 17/056,302

(22) PCT Filed: May 17, 2019

(86) PCT No.: PCT/JP2019/019809
§ 371 (c)(1),
(2) Date: Nov. 17, 2020

(87) PCT Pub. No.: WO2019/221297
PCT Pub. Date: Nov. 21, 2019

(65) Prior Publication Data

US 2021/0078059 A1 Mar. 18, 2021

(30) Foreign Application Priority Data

May 18, 2018 (JP) ..... JP2018-096364

(51) Int. Cl.
*B21B 37/62* (2006.01)
*B21B 31/02* (2006.01)
(Continued)

(52) U.S. Cl.
CPC ..... *B21B 37/62* (2013.01); *B21B 31/028* (2013.01); *B21B 38/08* (2013.01); *B21C 51/00* (2013.01);
(Continued)

(58) Field of Classification Search
CPC ..... B21B 31/028; B21B 37/38; B21B 37/58; B21B 37/62; B21B 37/68; B21B 38/08;
(Continued)

(56) References Cited

U.S. PATENT DOCUMENTS 3,416,341 A * 12/1968 Dey ..... B21B 37/38 72/240
3,587,266 A * 6/1971 Randlich ..... B21B 37/62 72/11.8
(Continued)

FOREIGN PATENT DOCUMENTS

EP 2 489 447 A1 8/2012
JP 8-294713 A 11/1996
(Continued)

OTHER PUBLICATIONS

JP 60-203316A, Itagaki Oct. 1985.*
JP 2006-110627A, Ishii et al. Apr. 2006.*
JP 57-124515A, Takahashi Aug. 1982.*

*Primary Examiner* — Edward T Tolan
(74) *Attorney, Agent, or Firm* — Birch, Stewart, Kolasch & Birch, LLP

(57) ABSTRACT

There is provided a rolling mill that includes a plurality of rolls, in which any one roll among respective rolls is adopted as a reference roll, including a load detection apparatus, detects a vertical roll load at a rolling support point position; a pressing apparatus pressing the roll chocks in the rolling direction; a driving apparatus moving the roll chocks in the rolling direction; and a position control unit which fixes a rolling direction position of roll chocks of the reference roll, and drives the driving apparatus to control positions in the rolling direction of the roll chocks of the rolls other than the reference roll.

14 Claims, 20 Drawing Sheets

(51) Int. Cl.
*B21B 38/08* (2006.01)
*B21C 51/00* (2006.01)

(52) U.S. Cl.
CPC ..... *B21B 2203/18* (2013.01); *B21B 2203/34* (2013.01); *B21B 2269/02* (2013.01)

(58) Field of Classification Search
CPC ..... B21B 2265/12; B21B 2269/02; B21B 2269/04; B21B 13/023; B21B 37/30; B21B 2203/18; B21B 2203/34
See application file for complete search history.

(56) References Cited

U.S. PATENT DOCUMENTS

| | | | | |
|---|---|---|---|---|
| 3,877,270 | A * | 4/1975 | Marten | B21B 37/38 72/245 |
| 3,938,360 | A * | 2/1976 | Shida | B21B 37/38 72/10.7 |
| 7,310,982 | B2 * | 12/2007 | Ogawa | B21B 37/28 72/10.4 |
| 8,973,419 | B2 * | 3/2015 | Kasai | B21B 38/105 72/10.4 |
| 9,527,121 | B2 * | 12/2016 | Denker | B21B 37/60 |
| 11,247,252 | B2 * | 2/2022 | Fröhlich | B21B 27/005 |
| 2019/0047028 | A1 | 2/2019 | Sako et al. | |

FOREIGN PATENT DOCUMENTS

| | | | |
|---|---|---|---|
| JP | 3499107 | B2 | 2/2004 |
| JP | 4962334 | B2 | 6/2012 |
| JP | 2014-4599 | A | 1/2014 |
| WO | WO 2018/083794 | A1 | 5/2018 |

* cited by examiner

ROLLING MILL, AND METHOD FOR SETTING ROLLING MILL

TECHNICAL FIELD

The present invention relates to a rolling mill that rolls a workpiece, and a method for setting the rolling mill.

BACKGROUND ART

In a hot rolling process, for example, zigzagging of a steel plate occurs as a phenomenon that is the cause of rolling trouble. A thrust force that is generated at a minute cross (also referred to as "roll skew") between rolls of a rolling apparatus is one cause of zigzagging of a steel plate, and it is difficult to directly measure such a thrust force. Therefore, in the past it has been proposed to measure a thrust counterforce that is detected as a counterforce that is the total value of thrust forces generated between rolls or measure an inter-roll cross angle which is a factor that causes the generation of a thrust force, and identify the thrust force generated between rolls based on the thrust counterforce or the inter-roll cross angle and perform zigzagging control of the steel plate.

For example, Patent Document 1 discloses a plate rolling method which measures a thrust counterforce in the axial direction of a roll and a load in a vertical direction, determines either one of, or both of, a reduction position zero point and deformation properties of the rolling mill, and sets the reduction position at the time of rolling execution and controls rolling. Further, Patent Document 2 discloses a zigzagging control method that calculates a thrust force generated at a roll based on an inter-roll minute cross angle (skew angle) that is measured using a distance sensor provided inside a rolling mill and, based on the thrust force, calculates a differential load component that is a cause of zigzagging based on a load measurement value in the vertical direction and performs reduction leveling control. In addition, Patent Document 3 discloses a cross-point correcting device which corrects a deviation in a point (cross point) at which the central axes of upper and lower rolls cross in the horizontal direction in a pair cross rolling mill. The apparatus includes an actuator that absorbs play that arises between a crosshead and roll chocks, and a detector that detects roll chock positions, and corrects a deviation in the cross point based on the roll chock positions.

Further, Patent Document 4 discloses a method for controlling a rolling mill that detects a load difference between the drive side and the work side, and by estimating a differential load caused by thrust during rolling when controlling zigzagging of a rolled material by independently controlling reduction positions on the drive side and on the work side based on the detected load difference, separates a differential load during rolling into a load that is attributable to zigzagging of the rolled material and a load that is attributable to thrust, and controls reduction positions on the drive side and the work side based on these separated differential loads.

LIST OF PRIOR ART DOCUMENTS

Patent Document

Patent Document 1: JP3499107B
Patent Document 2: JP2014-4599A
Patent Document 3: JP8-294713A
Patent Document 4: JP4962334B

SUMMARY OF INVENTION

Technical Problem

However, according to the technique disclosed in Patent Document 1, although it is necessary to perform measurement of the thrust counterforce of rolls other than a backup roll at a time of reduction position zero point adjustment and during rolling, in the case of measuring thrust counterforces during rolling, in some cases characteristics such as the working point of the thrust counterforce change depending on changes in the rolling conditions such as the rolling load, and asymmetric deformation that accompanies the thrust force cannot be correctly identified. Therefore, there is the possibility that reduction leveling control cannot be accurately performed.

Further, according to the technique disclosed in Patent Document 2, a roll skew angle is determined based on a distance in the horizontal direction of a roll that is measured by a distance sensor such as a vortex sensor. However, because a roll vibrates in the horizontal direction depending on the degree of machining precision such as the eccentricity or cylindricity of a roll body length portion, and chock positions in the horizontal direction fluctuate due to impact at the time of biting at the start of rolling and the like, it is difficult to accurately measure the horizontal displacement of a roll by a thrust force. Furthermore, the coefficient of friction of a roll is constantly changing because the degree of roughness of a roll changes with time as the number of rolled workpieces increases. Therefore, calculation of a thrust force without identification of the coefficient of friction cannot be performed accurately based on only a roll skew angle measurement.

In addition, according to the technique disclosed in Patent Document 3, an inter-roll cross angle arises due to relative crossing of rolls, and since there is also looseness in roll bearings and the like, even if position control of each roll chock position is individually performed in the rolling direction, deviations in the relative positional relation between the rolls themselves are not eliminated. Consequently, thrust forces that are generated due to inter-roll cross angles cannot be eliminated.

Furthermore, according to the technique disclosed in Patent Document 4, prior to rolling, in a state in which upper and lower rolls do not contact each other, a bending force is imparted while driving the rolls, and a differential load that is caused by thrust is estimated based on a thrust factor or a skew amount that is determined based on a load difference between the drive side and the work side that arises at such time. According to Patent Document 4, the thrust factor or skew amount is identified based on only measurement values in one rotational state of the upper and lower rolls. Therefore, in a case where there is a deviation in a zero point at a load detection apparatus or in a case where the influence of frictional resistance between the housing and roll chocks differs between left and right, there is a possibility that a left-right asymmetry error may arise between a measurement value on the drive side and a measurement value on the work side. In particular, in a case where the load level is small, such as in the case of a bending force, the error in question can become a critical error with respect to identification of the thrust factor or the skew amount.

Further, according to the technique disclosed in Patent Document 4, a thrust factor or a skew amount cannot be identified unless a coefficient of friction between rolls is applied. In addition, according to Patent Document 4, it is assumed that a thrust counterforce of a backup roll acts along the axial center position of the roll, and a change in the position of the working point of the thrust counterforce is not taken into consideration. Usually, because the chocks of a backup roll are supported by a pressing-down device or the like, the position of the working point of a thrust counterforce is not always located along the axial center of the roll. Consequently, an error arises in an inter-roll thrust force that is determined based on a load difference between a vertical roll load on the drive side and a vertical roll load on the work side, and an error also arises in a thrust factor or a skew amount that is calculated based on the inter-roll thrust force. When an error arises in a thrust factor or a skew amount in this manner, zigzagging control of a workpiece is influenced by the error and the accuracy of the zigzagging control decreases.

Further, as normal preparation operations before rolling, after replacing work rolls, the zero point of the reduction position in a kiss roll state is adjusted by an operator based on the values of vertical roll loads on the work side and the drive side. At such time, if an inter-roll thrust force is generated due to an inter-roll minute cross, in some cases a difference arises between the vertical roll load on the work side and the vertical roll load on the drive side, and the reduction position zero point adjustment cannot be correctly performed. However, it is not possible to reduce an inter-roll thrust force prior to reduction position zero point adjustment by employing a technique disclosed in any of the patent documents described above.

The present invention has been made in view of the problems described above, and an objective of the present invention is to provide a novel and improved method for setting a rolling mill, and a rolling mill, before zero point of reduction position adjustment or before starting rolling, by reducing thrust forces generated between rolls and suppressing the occurrence of zigzagging and camber of a workpiece.

Solution to Problem

To solve the problems described above, according to one aspect of the present invention there is provided a rolling mill of four-high or more that includes a plurality of rolls including at least a pair of work rolls and a pair of backup rolls supporting the work rolls, in which any one roll among respective rolls arranged in a vertical direction is adopted as a reference roll, including a load detection apparatus which, at a rolling support point position on a work side and a drive side of the backup rolls, detects a vertical roll load that acts in the vertical direction of the rolls; a pressing apparatus which, with respect to at least roll chocks of the rolls other than the reference roll, is provided on either one of an entrance side and an exit side in a rolling direction of a workpiece, the pressing apparatus pressing the roll chocks in the rolling direction; a driving apparatus which, with respect to at least roll chocks of the rolls other than the reference roll, is provided so as to face the pressing apparatus in the rolling direction, the driving apparatus moving the roll chocks in the rolling direction; and a position control unit which fixes a rolling direction position of roll chocks of the reference roll as a reference position, and drives the driving apparatus to control positions in the rolling direction of the roll chocks of the rolls other than the reference roll so that a vertical roll load difference that is a difference between a vertical roll load detected by the load detection apparatus on the work side and a vertical roll load detected by the load detection apparatus on the drive side becomes a value within an allowable range.

A roll located at a lowermost part or an uppermost part in the vertical direction among the plurality of rolls may be adopted as the reference roll.

Further, the rolling mill may be provided a bending apparatus that imparts a bending force to the rolls. In this case, the position control unit sets a roll gap between the work rolls in an open state, and imparts a bending force by means of the bending apparatus to the roll chocks on a side of the roll that is a position adjustment object.

The driving apparatus may be a hydraulic cylinder comprising a roll chock position detection apparatus.

Further, to solve the problem described above, according to a different aspect of the present invention there is provided a method for setting a rolling mill, the rolling mill being a rolling mill of four-high or more that includes a plurality of rolls including at least a pair of work rolls and a pair of backup rolls supporting the work rolls, and a load detection apparatus which, at a rolling support point position on a work side and a drive side of the backup rolls, detects a vertical roll load that acts in a vertical direction of the rolls; the method for setting a rolling mill being executed before reduction position zero point adjustment or before starting rolling, in which any one roll among respective rolls arranged in the vertical direction is adopted as a reference roll, the method including: calculating a vertical roll load difference that is a difference between a vertical roll load detected by the load detection apparatus on the work side and a vertical roll load detected by the load detection apparatus on the drive side; and fixing a rolling direction position of roll chocks of the reference roll as a reference position and moving roll chocks of the rolls other than the reference roll in a rolling direction of a workpiece to adjust positions of the roll chocks so that the vertical roll load difference becomes a value within an allowable range.

A roll located at a lowermost part or an uppermost part in the vertical direction among the plurality of rolls may be adopted as the reference roll.

In the rolling mill being a four-high rolling mill, wherein, a plurality of rolls provided on an upper side in the vertical direction with respect to the workpiece are taken as an upper roll assembly, and a plurality of rolls provided on a lower side in the vertical direction with respect to the workpiece are taken as a lower roll assembly; the method including performing: a first step of setting a roll gap between the work rolls in an open state, and in a state in which a bending force is imparted by a bending apparatus to the roll chocks of the work rolls, with respect to each of the upper roll assembly and the lower roll assembly, adjusting positions of the roll chocks of the work roll and the roll chocks of the backup roll, and after finishing the first step, a second step of setting the work rolls in a kiss roll state, and adjusting positions of the roll chocks of the upper roll assembly and the lower roll assembly; wherein, the first step includes performing: a first reference value calculation step of causing the rolls to rotate in a predetermined rotational direction, and with respect to each of the upper roll assembly and the lower roll assembly, detecting a vertical roll load on the work side and on the drive side and calculating a first reference value based on a vertical roll load difference that is a difference between the vertical roll load on the work side and the vertical roll load on the drive side, a first control target value calculation step of reversing the rotational direction of the rolls, and with respect to each of the upper roll assembly and the lower roll assembly, detecting a vertical roll load on each of the work side and the drive side and calculating a first control target value based on a deviation between a vertical roll load difference that is a difference between the vertical roll load on the work side and the vertical roll load on the drive side and the first reference value, and a first adjustment step of moving the roll chocks of the work roll of a roll assembly on the reference roll side in the rolling direction or moving the roll chocks of the work roll or the backup roll of a roll assembly on an opposite side to the reference roll in the rolling direction to adjust positions of the roll chocks so that the vertical roll load difference becomes a value within an allowable range of the first control target value; and the second step includes setting the work rolls in a kiss roll state, and performing: a second reference value calculation step of causing the rolls to rotate in a predetermined rotational direction, and with respect to each of the upper roll assembly and the lower roll assembly, detecting a vertical roll load on the work side and on the drive side and calculating a second reference value based on a vertical roll load difference that is a difference between the vertical roll load on the work side and the vertical roll load on the drive side, a second control target value calculation step of reversing the rotational direction of the rolls, and with respect to each of the upper roll assembly and the lower roll assembly, detecting a vertical roll load on the work side and on the drive side and calculating a second control target value based on a deviation between a vertical roll load difference that is a difference between the vertical roll load on the work side and the vertical roll load on the drive side and the second reference value, and a second adjustment step of adopting one of the upper roll assembly and the lower roll assembly as a reference roll assembly, and controlling the roll chocks of each roll of the other roll assembly simultaneously and in a same direction while maintaining relative positions between the roll chocks to adjust positions of the roll chocks so that the vertical roll load difference becomes a value within an allowable range of the second control target value.

Further, in the rolling mill being the rolling mill that is six-high and comprises intermediate rolls between the work rolls and the backup rolls, respectively, wherein, a plurality of rolls provided on an upper side in the vertical direction with respect to the workpiece are taken as an upper roll assembly, and a plurality of rolls provided on a lower side in the vertical direction with respect to the workpiece are taken as a lower roll assembly; the method including performing: a first step of setting a roll gap between the work rolls in an open state, and in a state in which a bending force is imparted by a bending apparatus to the roll chocks of the intermediate rolls, with respect to each of the upper roll assembly and the lower roll assembly, adjusting positions of the roll chocks of the intermediate roll and the roll chocks of the backup roll, after finishing the first step, a second step of maintaining the roll gap between the work rolls in an open state, and in a state in which a bending force is imparted by a bending apparatus to the roll chocks of the work rolls, with respect to each of the upper roll assembly and the lower roll assembly, adjusting positions of the roll chocks of the intermediate roll and the roll chocks of the work roll, and after finishing the second step, a third step of setting the work rolls in a kiss roll state, and adjusting positions of the roll chocks of the upper roll assembly and the lower roll assembly; wherein, the first step includes performing: a first reference value calculation step of causing the rolls to rotate in a predetermined rotational direction, and with respect to each of the upper roll assembly and the lower roll assembly, detecting a vertical roll load on the work side and on the drive side and calculating a first reference value based on a vertical roll load difference that is a difference between the vertical roll load on the work side and the vertical roll load on the drive side, a first control target value calculation step of reversing the rotational direction of the rolls, and with respect to each of the upper roll assembly and the lower roll assembly, detecting a vertical roll load on the work side and the drive side and calculating a first control target value based on a deviation between a vertical roll load difference that is a difference between the vertical roll load on the work side and the vertical roll load on the drive side and the first reference value, and a first adjustment step of moving the roll chocks of the intermediate roll of a roll assembly on the reference roll side and either of the roll chocks of the intermediate roll and the roll chocks of the backup roll of a roll assembly on an opposite side to the reference roll in the rolling direction to adjust positions of the roll chocks so that the vertical roll load difference becomes a value within an allowable range of the first control target value; the second step includes performing: a second reference value calculation step of causing the rolls to rotate in a predetermined rotational direction, and with respect to each of the upper roll assembly and the lower roll assembly, detecting a vertical roll load on the work side and on the drive side and calculating a second reference value based on a vertical roll load difference that is a difference between the vertical roll load on the work side and the vertical roll load on the drive side, a second control target value calculation step of reversing the rotational direction of the rolls, and with respect to each of the upper roll assembly and the lower roll assembly, detecting a vertical roll load on the work side and on the drive side and calculating a second control target value based on a deviation between a vertical roll load difference that is a difference between the vertical roll load on the work side and the vertical roll load on the drive side and the second reference value, and a second adjustment step of moving the roll chocks of the work roll of a roll assembly on the reference roll side and either the roll chocks of the work roll or the roll chocks of the intermediate roll and the backup roll of a roll assembly on an opposite side to the reference roll in the rolling direction to adjust positions of the roll chocks so that the vertical roll load difference becomes a value within an allowable range of the second control target value; and the third step includes setting the work rolls in a kiss roll state, and performing: a third reference value calculation step of causing the rolls to rotate in a predetermined rotational direction, and with respect to each of the upper roll assembly and the lower roll assembly, detecting a vertical roll load on the work side and on the drive side and calculating a third reference value based on a vertical roll load difference that is a difference between the vertical roll load on the work side and the vertical roll load on the drive side, a third control target value calculation step of reversing the rotational direction of the rolls, and with respect to each of the upper roll assembly and the lower roll assembly, detecting a vertical roll load on the work side and on the drive side and calculating a third control target value based on a deviation between a vertical roll load difference that is a difference between the vertical roll load on the work side and the vertical roll load on the drive side and the third reference value, and a third adjustment step of adopting one of the upper roll assembly and the lower roll assembly as a reference roll assembly, and controlling the roll chocks of each roll of the other roll assembly simultaneously and in a same direction while maintaining relative positions between the roll chocks to adjust positions of the roll chocks so that the vertical roll load difference becomes a value within an allowable range of the third control target value.

Alternatively, in the rolling mill being a four-high rolling mill, wherein, a plurality of rolls provided on an upper side in the vertical direction with respect to the workpiece are taken as an upper roll assembly, and a plurality of rolls provided on a lower side in the vertical direction with respect to the workpiece are taken as a lower roll assembly; the method including performing: a first step of setting a roll gap between the work rolls in an open state, and in a state in which a bending force is imparted by a bending apparatus to the roll chocks of the work rolls, with respect to each of the upper roll assembly and the lower roll assembly, adjusting positions of the roll chocks of the work roll and the roll chocks of the backup roll, and after finishing the first step, a second step of setting the work rolls in a kiss roll state, and adjusting positions of the roll chocks of the upper roll assembly and the lower roll assembly; wherein, the first step includes performing: a first control target value calculation step of, in a state in which rotation of the rolls is stopped, with respect to each of the upper roll assembly and the lower roll assembly, detecting a vertical roll load on the work side and on the drive side, calculating a first reference value based on a vertical roll load difference that is a difference between the vertical roll load on the work side and the vertical roll load on the drive side, and setting a first control target value based on the first reference value, a first load difference calculation step of causing the rolls to rotate and, with respect to each of the upper roll assembly and the lower roll assembly, detecting a vertical roll load on the work side and on the drive side and calculating a vertical roll load difference that is a difference between the vertical roll load on the work side and the vertical roll load on the drive side, and a first adjustment step of moving the roll chocks of the work roll of a roll assembly on the reference roll side in the rolling direction or moving the roll chocks of the work roll or the backup roll of a roll assembly on an opposite side to the reference roll in the rolling direction to adjust positions of the roll chocks so that the vertical roll load difference becomes a value within an allowable range of the first control target value; and the second step includes setting the work rolls in a kiss roll state, and performing: a second control target value calculation step of, in a state in which rotation of the rolls is stopped, with respect to each of the upper roll assembly and the lower roll assembly, detecting a vertical roll load on the work side and on the drive side, calculating a second reference value based on a vertical roll load difference that is a difference between the vertical roll load on the work side and the vertical roll load on the drive side, and setting a second control target value based on the second reference value, a second load difference calculation step of causing the rolls to rotate and, with respect to each of the upper roll assembly and the lower roll assembly, detecting a vertical roll load on the work side and on the drive side and calculating a vertical roll load difference that is a difference between the vertical roll load on the work side and the vertical roll load on the drive side, and a second adjustment step of adopting one of the upper roll assembly and the lower roll assembly as a reference roll assembly, and controlling the roll chocks of each roll of the other roll assembly simultaneously and in a same direction while maintaining relative positions between the roll chocks to adjust positions of the roll chocks so that the vertical roll load difference becomes a value within an allowable range of the second control target value.

Further, in the rolling mill being the rolling mill that is six-high and comprises intermediate rolls between the work rolls and the backup rolls, respectively, wherein, a plurality of rolls provided on an upper side in the vertical direction with respect to the workpiece are taken as an upper roll assembly, and a plurality of rolls provided on a lower side in the vertical direction with respect to the workpiece are taken as a lower roll assembly; the method including performing: a first step of setting a roll gap between the work rolls in an open state, and in a state in which a bending force is imparted by a bending apparatus to the roll chocks of the intermediate rolls, with respect to each of the upper roll assembly and the lower roll assembly, adjusting positions of the roll chocks of the intermediate roll and the roll chocks of the backup roll, after finishing the first step, a second step of maintaining the roll gap between the work rolls in an open state, and in a state in which a bending force is imparted by a bending apparatus to the roll chocks of the work rolls, with respect to each of the upper roll assembly and the lower roll assembly, adjusting positions of the roll chocks of the intermediate roll and the roll chocks of the work roll, and after finishing the second step, a third step of setting the work rolls in a kiss roll state, and adjusting positions of the roll chocks of the upper roll assembly and the lower roll assembly; wherein, the first step includes performing: a first control target value calculation step of, in a state in which rotation of the rolls is stopped, with respect to each of the upper roll assembly and the lower roll assembly, detecting a vertical roll load on the work side and on the drive side, calculating a first reference value based on a vertical roll load difference that is a difference between the vertical roll load on the work side and the vertical roll load on the drive side, and setting a first control target value based on the first reference value, a first load difference calculation step of causing the rolls to rotate and, with respect to each of the upper roll assembly and the lower roll assembly, detecting a vertical roll load on the work side and on the drive side and calculating a vertical roll load difference that is a difference between the vertical roll load on the work side and the vertical roll load on the drive side, and a first adjustment step of moving the roll chocks of the intermediate roll of a roll assembly on the reference roll side and either of the roll chocks of the intermediate roll and the roll chocks of the backup roll of a roll assembly on an opposite side to the reference roll in the rolling direction to adjust positions of the roll chocks so that the vertical roll load difference becomes a value within an allowable range of the first control target value; the second step includes performing: a second control target value calculation step of, in a state in which rotation of the rolls is stopped, with respect to each of the upper roll assembly and the lower roll assembly, detecting a vertical roll load on the work side and on the drive side, calculating a second reference value based on a vertical roll load difference that is a difference between the vertical roll load on the work side and the vertical roll load on the drive side, and setting a second control target value based on the second reference value, a second load difference calculation step of causing the rolls to rotate and, with respect to each of the upper roll assembly and the lower roll assembly, detecting a vertical roll load on the work side and on the drive side and calculating a vertical roll load difference that is a difference between the vertical roll load on the work side and the vertical roll load on the drive side, and a second adjustment step of moving the roll chocks of the work roll of a roll assembly on the reference roll side and either the roll chocks of the work roll or the roll chocks of the intermediate roll and the backup roll of a roll assembly on an opposite side to the reference roll to move in the rolling direction to adjust positions of the roll chocks so that the vertical roll load difference becomes a value within an allowable range of the second control target value; and the third step includes setting the work rolls in a kiss roll state, and performing: a third control target value calculation step of, in a state in which rotation of the rolls is stopped, with respect to each of the upper roll assembly and the lower roll assembly, detecting a vertical roll load on the work side and on the drive side, calculating a third reference value based on a vertical roll load difference that is a difference between the vertical roll load on the work side and the vertical roll load on the drive side, and setting a third control target value based on the third reference value, a third load difference calculation step of causing the rolls to rotate and, with respect to each of the upper roll assembly and the lower roll assembly, detecting a vertical roll load on the work side and on the drive side and calculating a vertical roll load difference that is a difference between the vertical roll load on the work side and the vertical roll load on the drive side, and a third adjustment step of adopting one of the upper roll assembly and the lower roll assembly as a reference roll assembly, and controlling the roll chocks of each roll of the other roll assembly simultaneously and in a same direction while maintaining relative positions between the roll chocks to adjust positions of the roll chocks so that the vertical roll load difference becomes a value within an allowable range of the third control target value.

Advantageous Effects of Invention

As described above, according to the present invention, thrust forces generated between rolls can be reduced before zero point of reduction position adjustment or before starting rolling, and the occurrence of zigzagging and camber of a workpiece can be suppressed.

BRIEF DESCRIPTION OF DRAWINGS

FIG. 8A is applied to a six-high rolling mill.

FIG. 8B is applied to a six-high rolling mill.

DESCRIPTION OF EMBODIMENTS

Figure 1:
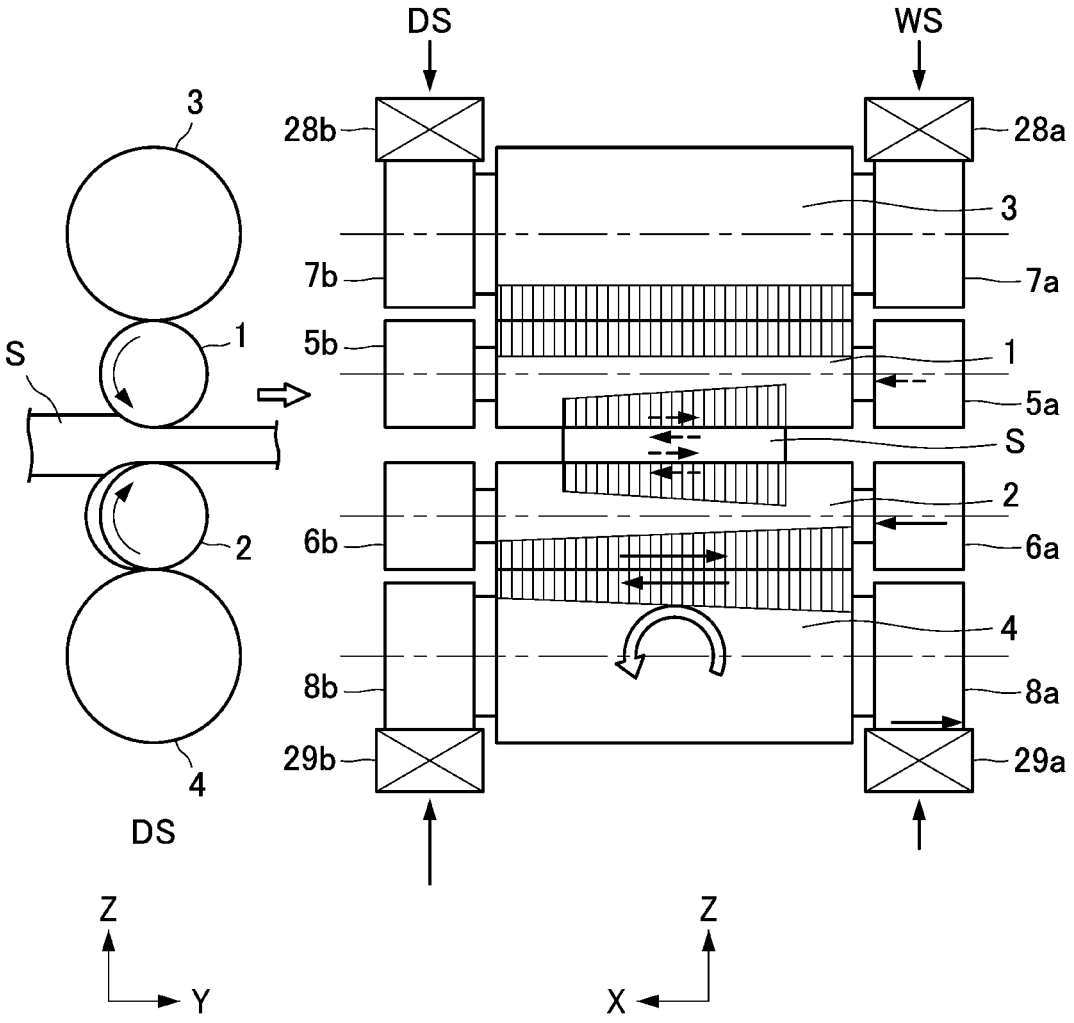
FIG. 1 is a multiple view drawing including a schematic side view and a schematic front view of a rolling mill for describing a thrust force and a thrust counterforce which are generated between rolls of a rolling mill during rolling.

Hereunder, preferred embodiments of the present invention are described in detail while referring to the accompanying drawings. Note that, in the present specification and the accompanying drawings, constituent elements having substantially the same functional configuration are denoted by the same reference characters and a duplicate description thereof is omitted.

1. Objective

An objective of a rolling mill as well as a method for setting the rolling mill according to the embodiments of the present invention is to eliminate thrust forces generated between rolls, and be stably produced of products without zigzagging and camber or with extremely little zigzagging and camber. In FIG. 1, a schematic side view and a schematic front view of a rolling mill are illustrated for describing a thrust force and a thrust counterforce which are generated between rolls of a rolling mill during rolling of a workpiece S. Hereunder, as illustrated in FIG. 1, the work side in the axial direction of rolls is represented by "WS", and the drive side is represented by "DS".

The rolling mill illustrated in FIG. 1 has a pair of work rolls consisting of an upper work roll 1 and a lower work roll 2, and a pair of backup rolls consisting of an upper backup roll 3 that supports the upper work roll 1 in the vertical direction (Z direction) and a lower backup roll 4 that supports the lower work roll 2 in the vertical direction. The plate thickness of the workpiece S is made a predetermined thickness by passing the workpiece S between the work rolls to perform rolling of the workpiece S. In the rolling mill, upper vertical roll load detection apparatuses 28*a* and 28*b* which detect vertical roll loads relating to an upper roll assembly that includes the upper work roll 1 and the upper backup roll 3 which are arranged on the top surface side of the workpiece S, and lower vertical roll load detection apparatuses 29*a* and 29*b* which detect vertical roll loads relating to a lower roll assembly that includes the lower work roll 2 and the lower backup roll 4 which are arranged on the undersurface side of the workpiece S are provided in the vertical direction (Z direction). The upper vertical roll load detection apparatus 28*a* and the lower vertical roll load detection apparatus 29*a* detect vertical roll loads on the work side. The upper vertical roll load detection apparatus 28*b* and the lower vertical roll load detection apparatus 29*b* detect vertical roll loads on the drive side.

The upper work roll 1, the lower work roll 2, the upper backup roll 3 and the lower backup roll 4 are arranged in a manner in which the axial directions of the respective rolls are parallel, so as to be orthogonal with the conveyance direction of the workpiece S. However, if a roll rotates slightly about an axis (Z-axis) that is parallel with the vertical direction and a deviation arises between the axial directions of the upper work roll 1 and the upper backup roll 3, or a deviation arises between the axial directions of the lower work roll 2 and the lower backup roll 4, a thrust force that acts in the axial direction of the rolls arises between the work roll and the backup roll. An inter-roll thrust force gives a moment to the rolls, and causes the rolling to enter an unstable state by asymmetric roll deformation, and for example gives rise to zigzagging or camber. The inter-roll thrust force is generated as a result of an inter-roll cross angle arising due to the occurrence of a deviation between the axial directions of a work roll and a backup roll. For example, let us assume that an inter-roll cross angle arises between the lower work roll 2 and the lower backup roll 4, a thrust force is generated between the lower work roll 2 and the lower backup roll 4, and as a result, a moment occurs at the lower backup roll 4, and the load distribution between the rolls changes to balance with the moment, and thus an asymmetric roll deformation occurs. Zigzagging or camber or the like is caused by this asymmetric roll deformation, and the rolling becomes unstable.

Therefore, an objective of the present invention is, during rolling of a workpiece by a rolling mill, to adjust the roll chock positions of each roll so that inter-roll thrust forces generated between rolls are eliminated, and thereby stably produce products without zigzagging and camber or with extremely little zigzagging and camber. In particular, according to the present invention a method is proposed that adjusts the roll chock positions of each roll so that inter-roll thrust forces generated between rolls are eliminated even in a case where thrust counterforces acting on the rolls cannot be measured.

2. First Embodiment

The configuration of a rolling mill according to a first embodiment of the present invention and an apparatus for controlling the rolling mill, as well as a method for setting a rolling mill will be described based on FIG. 2 to FIG. 4B. In the first embodiment, before reduction position zero point adjustment or before the start of rolling, the positions of roll chocks are adjusted so as to make an inter-roll cross angle between a backup roll serving as a reference and other rolls zero, to thereby realize rolling in which thrust forces do not arise. In the rolling mill according to the present embodiment, although thrust counterforce measurement apparatuses that measure thrust counterforces in the rolling mill are not provided, it is possible to adjust an inter-roll cross also in a case where thrust counterforces acting on the rolls cannot be measured.

[2-1. Configuration of Rolling Mill]

Figure 2:
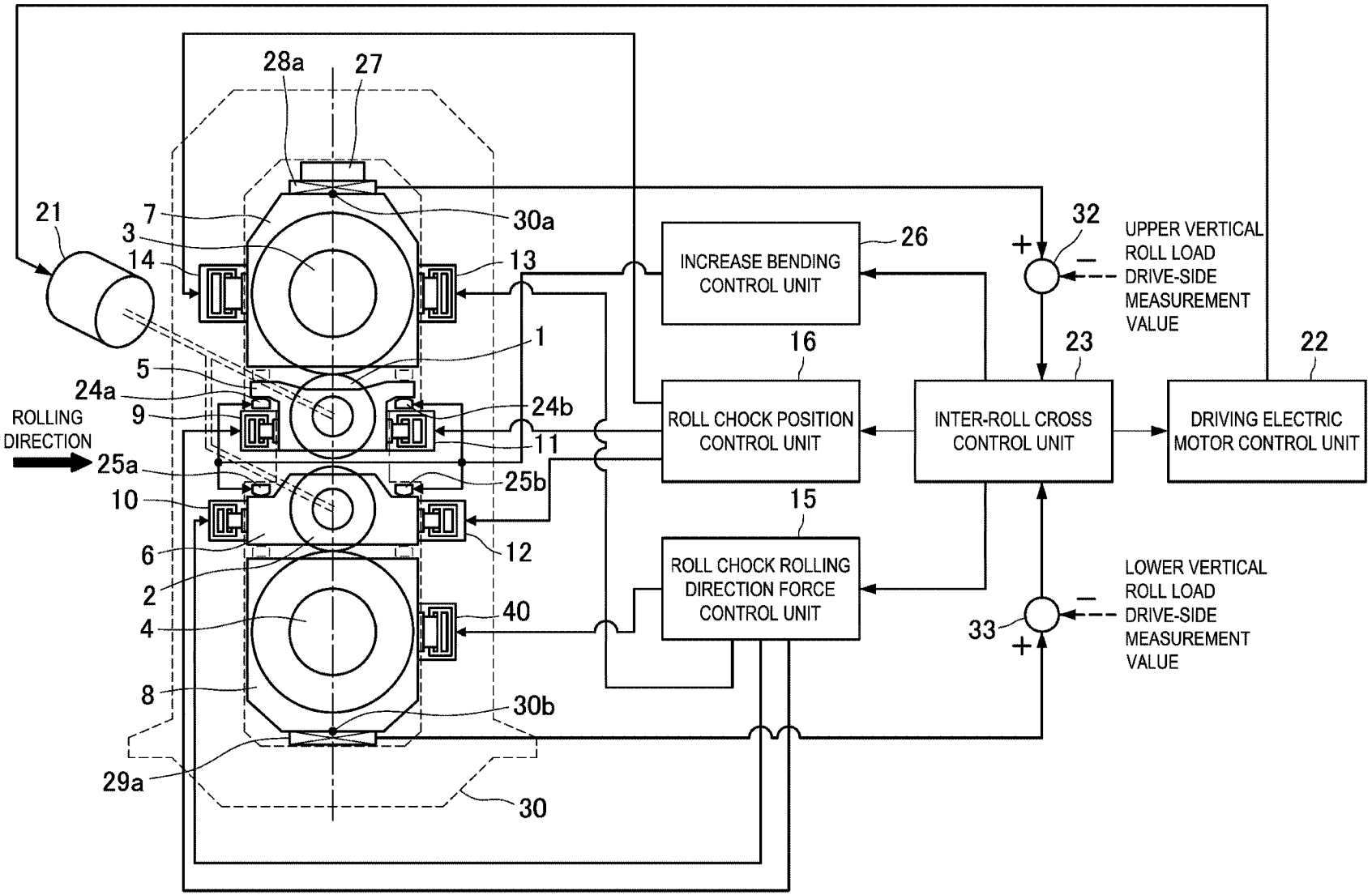
FIG. 2 is an explanatory drawing illustrating the configuration of a rolling mill according to a first embodiment of the present invention, and an apparatus for controlling the rolling mill.

First, the rolling mill according to the present embodiment and an apparatus for controlling the rolling mill will be described based on FIG. 2. FIG. 2 is an explanatory drawing illustrating the configuration of the rolling mill according to the present embodiment, and an apparatus for controlling the rolling mill. Note that, it is assumed that the rolling mill illustrated in FIG. 2 is shown in a state as seen from the work side in the axial direction of the rolls, and that the rolling direction is the direction from the left to the right of the page as seen from the direction of the viewer. Further, in FIG. 2, a configuration in a case where the lower backup roll is adopted as the reference roll is illustrated. Note that, in the invention according to the present embodiment, any one roll among the respective rolls arranged in the vertical direction may be set as the reference roll. The reference roll is preferably a roll for which the area of contact between the chocks and the housing is large, and which is located at the lowermost part or the uppermost part, where the position is stable.

The rolling mill illustrated in FIG. 2 is a four-high rolling mill having a pair of work rolls 1 and 2 and a pair of backup rolls 3 and 4 that support the pair of work rolls 1 and 2. In the four-high rolling mill, the upper work roll 1, the lower work roll 2, the upper backup roll 3 and the lower backup roll 4 are a plurality of rolls which are arranged in the vertical direction. The upper work roll 1 is supported by an upper work roll chock 5, and the lower work roll 2 is supported by a lower work roll chock 6. Note that, the upper work roll chock 5 and the lower work roll chock 6 are also similarly provided on the side facing away from the viewer (drive side) in FIG. 2, and support the upper work roll 1 and the lower work roll 2, respectively. The upper work roll 1 and the lower work roll 2 are rotationally driven by a driving electric motor 21. Further, the upper backup roll 3 is supported by an upper backup roll chock 7, and the lower backup roll 4 is supported by a lower backup roll chock 8. The upper backup roll chock 7 and the lower backup roll chock 8 are also similarly provided on the side facing away from the viewer (drive side) in FIG. 2, and support the upper backup roll 3 and the lower backup roll 4, respectively. The upper work roll chocks 5, the lower work roll chocks 6, the upper backup roll chocks 7 and the lower backup roll chocks 8 are retained by a housing 30. Note that, the upper work roll chocks 5, the lower work roll chocks 6, the upper backup roll chocks 7 and the lower backup roll chocks 8 in some cases are referred to as simply "roll chocks".

The upper work roll chocks 5 are provided with an upper work roll chock pressing apparatus 9 which is provided on the entrance side in the rolling direction and which presses the upper work roll chocks 5 in the rolling direction, and a driving apparatus with upper work roll chock position detection function 11 which is provided on the exit side in the rolling direction and which detects the position in the rolling direction and drives the upper work roll chocks 5 in the rolling direction.

Similarly, the lower work roll chocks 6 are provided with a lower work roll chock pressing apparatus 10 which is provided on the entrance side in the rolling direction and which presses the lower work roll chocks 6 in the rolling direction, and a driving apparatus with lower work roll chock position detection function 12 which is provided on the exit side in the rolling direction and which detects the position in the rolling direction and drives the lower work roll chocks 6 in the rolling direction. For example, a hydraulic cylinder is used as the driving apparatus with upper work roll chock position detection function 11, the driving apparatus with lower work roll chock position detection function 12, a drive mechanism of the upper work roll chock pressing apparatus 9 and a drive mechanism of the lower work roll chock pressing apparatus 10. Note that, whilst the upper and lower driving apparatuses with work roll chock position detection function 11 and 12 and the upper and lower work roll chock pressing apparatuses 9 and 10 are shown only on the work side in FIG. 2, these apparatuses are also similarly provided on the side facing away from the viewer (drive side) in FIG. 2.

The upper backup roll chocks 7 are provided with an upper backup roll chock pressing apparatus 13 which is provided on the exit side in the rolling direction and which presses the upper backup roll chocks 7 in the rolling direction, and a driving apparatus with upper backup roll chock position detection function 14 which is provided on the entrance side in the rolling direction and which detects the position in the rolling direction and drives the upper backup roll chocks 7 in the rolling direction. For example, a hydraulic cylinder is used as the driving apparatus with upper backup roll chock position detection function 14 and the drive mechanism of the upper backup roll chock pressing apparatus 13. Note that, whilst the driving apparatus with upper backup roll chock position detection function 14 and the upper backup roll chock pressing apparatus 13 are shown only on the work side in FIG. 2, these apparatuses are also similarly provided on the side facing away from the viewer (drive side) in FIG. 2.

On the other hand, with respect to the lower backup roll chocks 8, since the lower backup roll 4 is adopted as the reference roll in the present embodiment, the lower backup roll chocks 8 serve as reference backup roll chocks. Accordingly, since the lower backup roll chocks 8 are not driven to perform position adjustment, the lower backup roll chocks 8 do not necessarily need to be equipped with a driving apparatus and a position detection apparatus as in the case of the upper backup roll chocks 7. However, a configuration may be adopted in which, for example, a lower backup roll chock pressing apparatus 40 or the like is provided on the entrance side or the exit side in the rolling direction to suppress the occurrence of looseness of the lower backup roll chocks 8 so that the position of the reference backup roll chocks that serve as the reference for position adjustment does not change. Note that, whilst the lower backup roll chock pressing apparatus 40 is shown only on the work side in FIG. 2, this apparatus is also similarly provided on the side facing away from the viewer (drive side) in FIG. 2.

The upper work roll chock pressing apparatus 9, the lower work roll chock pressing apparatus 10, the upper backup roll chock pressing apparatus 13 and the lower backup roll chock pressing apparatus 40 are provided on either one of the entrance side and the exit side in the rolling direction of the workpiece, and are pressing apparatuses that press the roll chocks in the rolling direction, and in some cases are referred to as simply "pressing apparatuses". It suffices that the pressing apparatuses are provided with respect to at least the roll chocks of the rolls other than the reference roll. Further, the driving apparatus with upper work roll chock position detection function 11, the driving apparatus with lower work roll chock position detection function 12 and the driving apparatus with upper backup roll chock position detection function 14 are provided so as to face the pressing apparatuses in the rolling direction, and are driving apparatuses that move the roll chocks in the rolling direction, and in some cases are referred to as simply "driving apparatuses". It suffices that the driving apparatuses also are provided with respect to at least the roll chocks of the rolls other than the reference roll.

The rolling mill according to the present embodiment includes an entrance-side upper increase bending apparatus **24*a* and an exit-side upper increase bending apparatus 24*b* on a project block between the upper work roll chocks 5 and the housing 30. Further, the rolling mill includes an entrance-side lower increase bending apparatus 25*a* and an exit-side lower increase bending apparatus 25*b* on a project block between the lower work roll chocks 6 and the housing 30. The entrance-side upper increase bending apparatus 24*a*, the exit-side upper increase bending apparatus 24*b*, the entrance-side lower increase bending apparatus 25*a* and the exit-side lower increase bending apparatus 25*b* are also similarly provided on the side facing away from the viewer (drive side) in FIG. 2. Each increase bending apparatus imparts an increase bending force to the work roll chocks in order to apply a load to the upper work roll 1 and the upper backup roll 3, and the lower work roll 2 and the lower backup roll 4. The entrance-side upper increase bending apparatus 24*a*, the exit-side upper increase bending apparatus 24*b*, the entrance-side lower increase bending apparatus 25*a* and the exit-side lower increase bending apparatus 25*b*** are bending apparatuses that impart a bending force to rolls, and in some cases are also referred to simply as "bending apparatuses".

Further, as apparatuses for controlling the rolling mill, for example, as illustrated in FIG. 2, the configuration includes a roll chock rolling direction force control unit 15, a roll chock position control unit 16, a driving electric motor control unit 22, an inter-roll cross control unit 23 and an increase bending control unit 26.

The roll chock rolling direction force control unit 15 controls a pressing force in the rolling direction of the upper work roll chock pressing apparatus 9, the lower work roll chock pressing apparatus 10, the upper backup roll chock pressing apparatus 13 and the lower backup roll chock pressing apparatus 40. Based on a control instruction of the inter-roll cross control unit 23 that is described later, the roll chock rolling direction force control unit 15 drives the upper work roll chock pressing apparatus 9, the lower work roll chock pressing apparatus 10 and the upper backup roll chock pressing apparatus 13 that are control objects with respect to chock positions to thereby produce a state in which it is possible to control the chock positions by application of a predetermined pressing force.

The roll chock position control unit 16 performs drive control of the driving apparatus with upper work roll chock position detection function 11, the driving apparatus with lower work roll chock position detection function 12 and the driving apparatus with upper backup roll chock position detection function 14. The roll chock position control unit 16 is also referred to as simply "position control unit". Based on a control instruction of the inter-roll cross control unit 23, the roll chock position control unit 16 drives the driving apparatus with upper work roll chock position detection function 11, the driving apparatus with lower work roll chock position detection function 12 and the driving apparatus with upper backup roll chock position detection function 14 so that a vertical roll load difference that is a difference between a vertical roll load on the work side of the respective rolls and a vertical roll load on the drive side of the respective rolls is within a predetermined range. The driving apparatuses with position detection functions 11, 12 and 14 are disposed on both the work side and the drive side, and with respect to the positions in the rolling direction on the work side and the drive side, by controlling the driving apparatuses with position detection functions 11, 12 and 14 so that the positions change by the same amount in opposite directions on the work side and the drive side, can change a roll cross angle only, without changing the average rolling direction position of the work side and the drive side.

The driving electric motor control unit 22 controls the driving electric motor 21 that rotationally drives the upper work roll 1 and the lower work roll 2. The driving electric motor control unit 22 according to the present embodiment controls driving of the upper work roll 1 or the lower work roll 2 based on an instruction from the inter-roll cross control unit 23.

The inter-roll cross control unit 23 controls the position of each of the upper work roll 1, the lower work roll 2, the upper backup roll 3 and the lower backup roll 4 constituting the rolling mill, so that an inter-roll cross angle becomes zero. The inter-roll cross control unit 23 issues control instructions to the roll chock rolling direction force control unit 15, the roll chock position control unit 16 and the driving electric motor control unit 22 so that a vertical roll load difference that is a difference between a vertical roll load on the work side of the respective rolls and a vertical roll load on the drive side of the respective rolls falls within a predetermined range, so that crosses that occurred between the rolls are eliminated. Note that the details of the method for setting the rolling mill are described later.

The increase bending control unit 26 is an apparatus that controls the entrance-side upper increase bending apparatus 24*a*, the exit-side upper increase bending apparatus 24*b*, the entrance-side lower increase bending apparatus 25*a* and the exit-side lower increase bending apparatus 25*b*. The increase bending control unit 26 controls the increase bending apparatuses so as to impart an increase bending force to the work roll chocks, based on an instruction from the inter-roll cross control unit 23. Note that, the increase bending control unit 26 may also perform control of the increase bending apparatuses even in a case other than a case of performing adjustment of an inter-roll cross according to the present embodiment, for example, when performing crown control or shape control of a workpiece.

A pressing-down device 27 is also provided in the rolling mill. The pressing-down device 27 is a device that is arranged above the roll located at the uppermost part (in FIG. 2, the upper backup roll 3), and that presses the rolls in the downward direction. The position in the vertical direction of each roll can be adjusted by pressing the rolls downward from above by means of the pressing-down device 27. For example, when setting the upper work roll 1 and the lower work roll 2 in a kiss roll state, the positions of the upper work roll 1 and the lower work roll 2 are adjusted by applying a predetermined load to these work rolls by means of the pressing-down device 27.

In the vertical direction, the upper vertical roll load detection apparatuses 28*a* and 28*b* and the pressing-down device 27 are provided at a rolling support point position 30*a* between the upper backup roll chocks 7 and the housing 30, and the lower vertical roll load detection apparatuses 29*a* and 29*b* are provided at a rolling support point position 30*b* between the lower backup roll chocks 8 and the housing 30. Note that, whilst only the upper vertical roll load detection apparatus 28*a* and the lower vertical roll load detection apparatus 29*a* on the work side are illustrated in FIG. 2, as illustrated in FIG. 1 the upper vertical roll load detection apparatus 28*b* and the lower vertical roll load detection apparatus 29*b* are provided on the drive side that is the side facing away from the viewer in FIG. 2. The upper vertical roll load detection apparatuses 28*a* and 28*b* and the lower vertical roll load detection apparatuses 29*a* and 29*b* are arranged at rolling support point positions of the upper and lower backup roll chocks and are apparatuses that detect vertical roll loads acting in the vertical direction, with the upper vertical roll load detection apparatuses 28*a* and 28*b* detecting vertical roll loads relating to the roll at the uppermost part, and the lower vertical roll load detection apparatuses 29*a* and 29*b* detecting vertical roll loads relating to the roll at the lowermost part.

An upper vertical roll load difference calculation portion 32 calculates a vertical roll load difference that is a difference between a vertical roll load on the work side and a vertical roll load on the drive side that were detected by the upper vertical roll load detection apparatuses 28*a* and 28*b*. A lower vertical roll load difference calculation portion 33 calculates a vertical roll load difference that is a difference between a vertical roll load on the work side and a vertical roll load on the drive side that were detected by the lower vertical roll load detection apparatuses 29*a* and 29*b*. The vertical roll load differences calculated by the upper vertical roll load difference calculation portion 32 and the lower vertical roll load difference calculation portion 33 are output to the inter-roll cross control unit 23. The inter-roll cross control unit 23 recognizes the state of an inter-roll cross based on the vertical roll load differences that are input.

Although an example has been described above in which, with respect to the work roll chocks 5 and 6, the driving apparatuses with position detection functions 11 and 12 are arranged on the exit side and the pressing apparatuses 9 and 10 are arranged on the entrance side of the rolling mill, and with respect to the upper backup roll chocks 7, the driving apparatus with position detection function 14 is arranged on the entrance side and the pressing apparatus 13 is arranged on the exit side of the rolling mill, and furthermore, with respect to the lower backup roll chocks 8, the pressing apparatus 40 is arranged on the exit side of the rolling mill, the present invention is not limited to this example. For example, the arrangement of these apparatuses with respect to the entrance side and the exit side of the rolling mill may be the reverse of the arrangement in the above example, or these apparatuses may be installed in the same direction with respect to the work rolls and the backup rolls. In addition, with regard to the driving apparatuses with position detection functions 11, 12 and 14, whilst an example has been described in which these apparatuses are provided on both the work side and the drive side and the respective apparatuses are subjected to position control, the present invention is not limited to this example. These apparatuses may be provided on only one side among the work side and the drive side, or alternatively it is possible to adopt a configuration so that only the apparatuses provided on one side are actuated, and to control a roll cross angle by performing position control by taking the opposite side thereto as the support point of rotation, and it need scarcely be said that the same effect of reducing an inter-roll cross is obtained. Further, although in FIG. 2 an example is illustrated in which only the pressing apparatus 40 is provided for the lower backup roll chocks 8 of the lower backup roll 4 that is the reference roll, the present invention is not limited to this example, and a configuration may be adopted in which a driving apparatus with a position detection function is provided on the entrance side of the lower backup roll chocks 8 and the driving apparatus with position detection function can be controlled by the roll chock position control unit 16. By this means, for example, in a case where the right-angle relationship between the reference roll axis and the rolling direction is out of alignment to an extreme degree due to wear of a liner or the like, it is possible to drive the reference backup roll chocks by means of the roll chock position control unit 16 and thereby finely adjust the position of the reference roll. Further, by providing all of the rolls with a driving apparatus with a position detection function, the reference roll may be changed according to the situation, and control may be performed based on the changed reference roll. [2-2. Method for setting rolling mill]

Figure 3A:
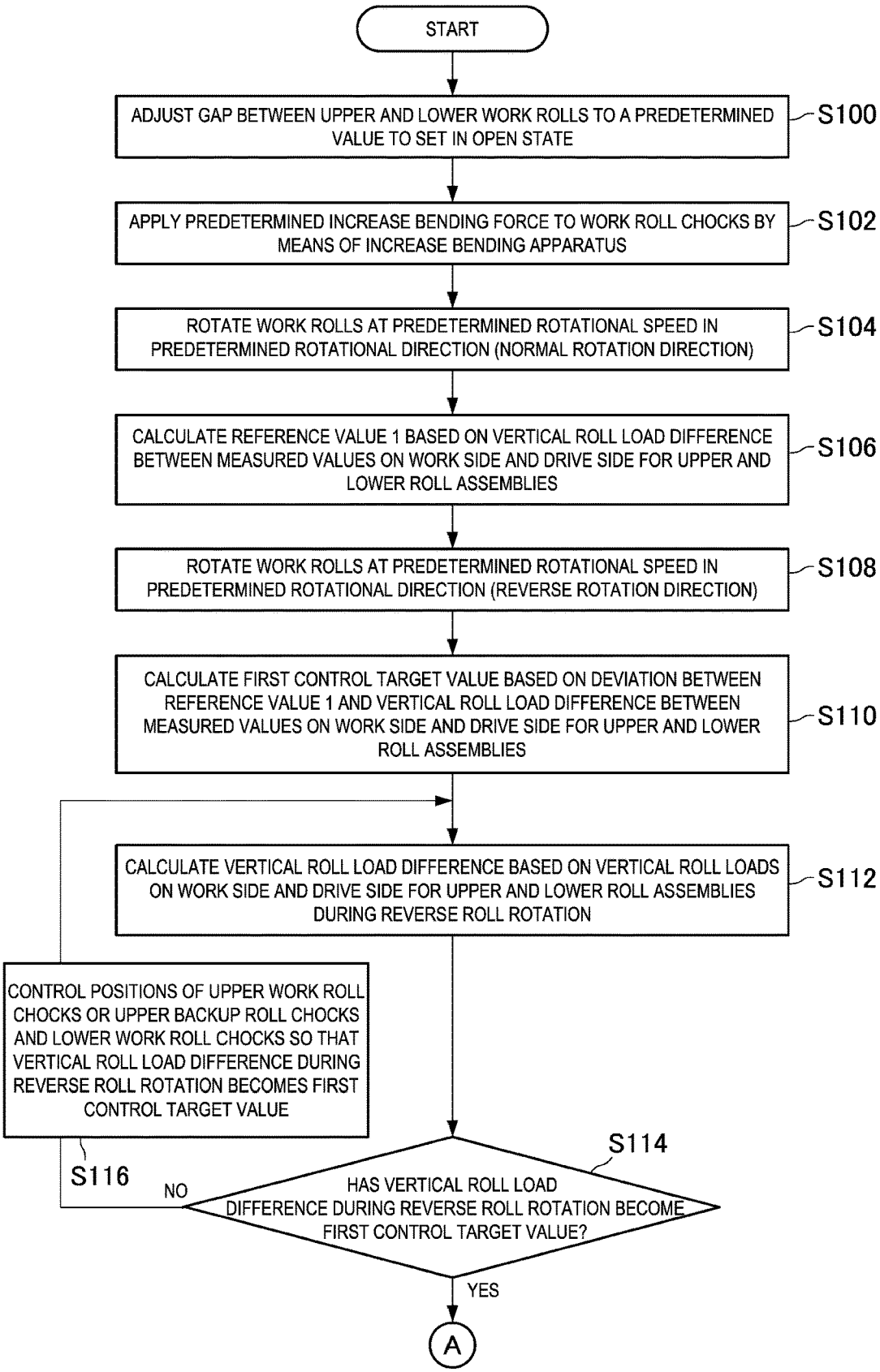
FIG. 3A is a flowchart describing a method for setting a rolling mill that performs roll chock position adjustment based on vertical roll loads during normal roll rotation and during reverse roll rotation according to the first embodiment, which describes a first adjustment in a state in which a roll gap is open.
Figure 3B:
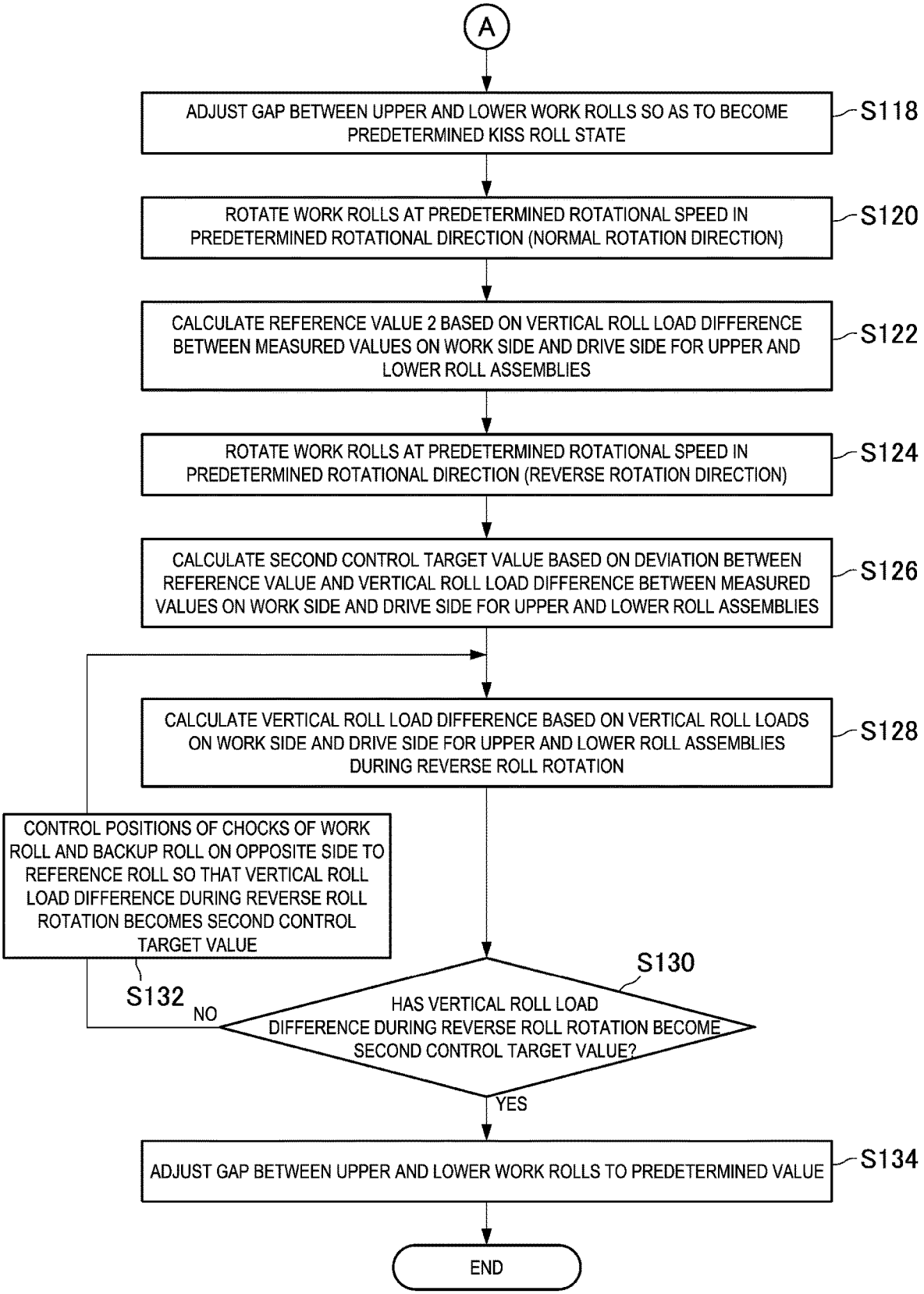
FIG. 3B is a flowchart describing a method for setting a rolling mill that performs roll chock position adjustment based on vertical roll loads during normal roll rotation and during reverse roll rotation according to the first embodiment, which describes a second adjustment in a kiss roll state.
Figure 4A:
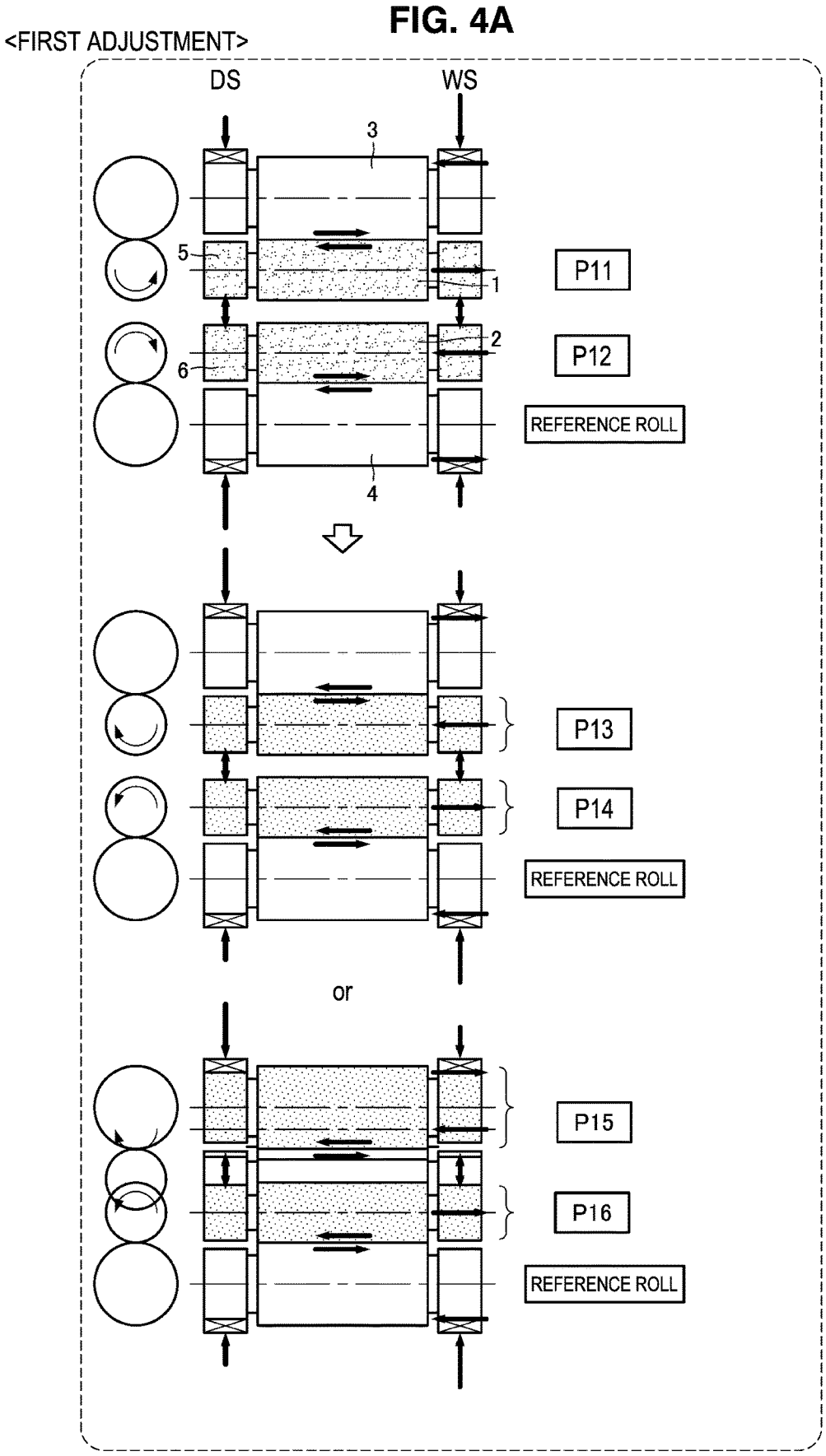
FIG. 4A is an explanatory drawing illustrating procedures for roll chock position adjustment in the method for setting a rolling mill according to the first embodiment, which illustrates position adjustment that is performed in a state in which a roll gap is open.
Figure 4B:
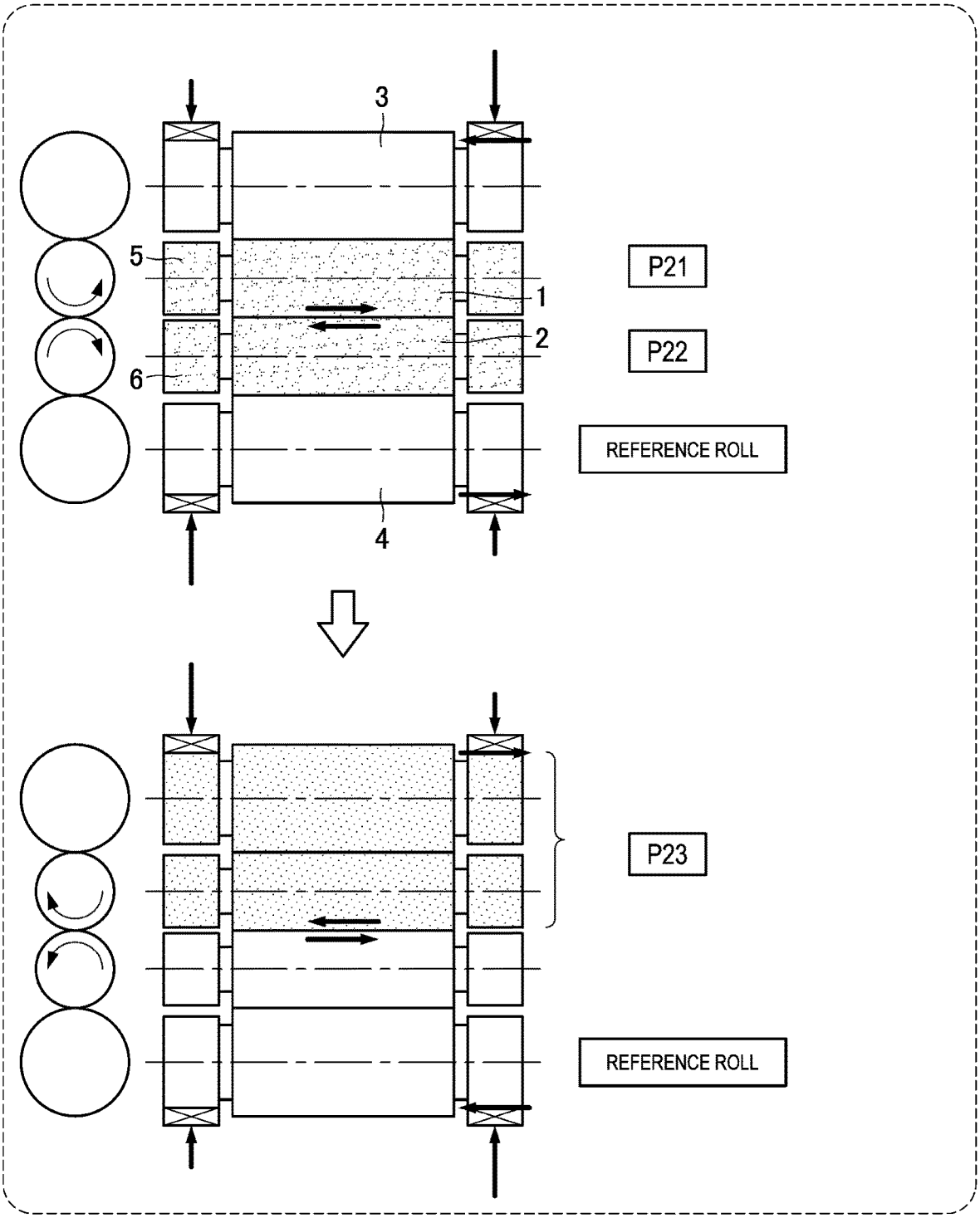
FIG. 4B is an explanatory drawing illustrating procedures for roll chock position adjustment in the method for setting a rolling mill according to the first embodiment, which illustrates position adjustment that is performed in a kiss roll state.
Figure 5:
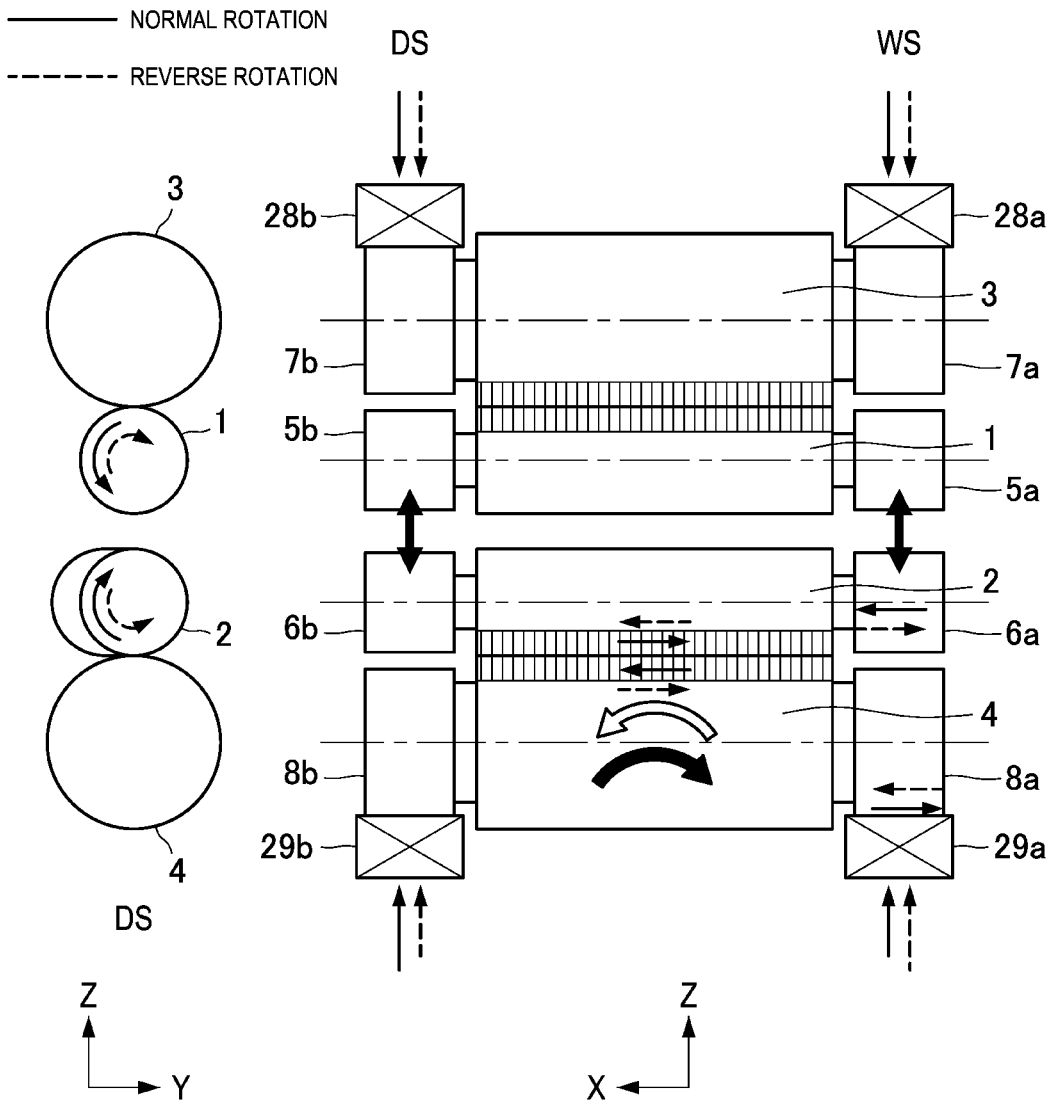
FIG. 5 is a multiple view drawing including a schematic side view and a schematic front view illustrating an example of a driving state of the rolling mill at a time of inter-roll cross angle identification.
Figure 6:
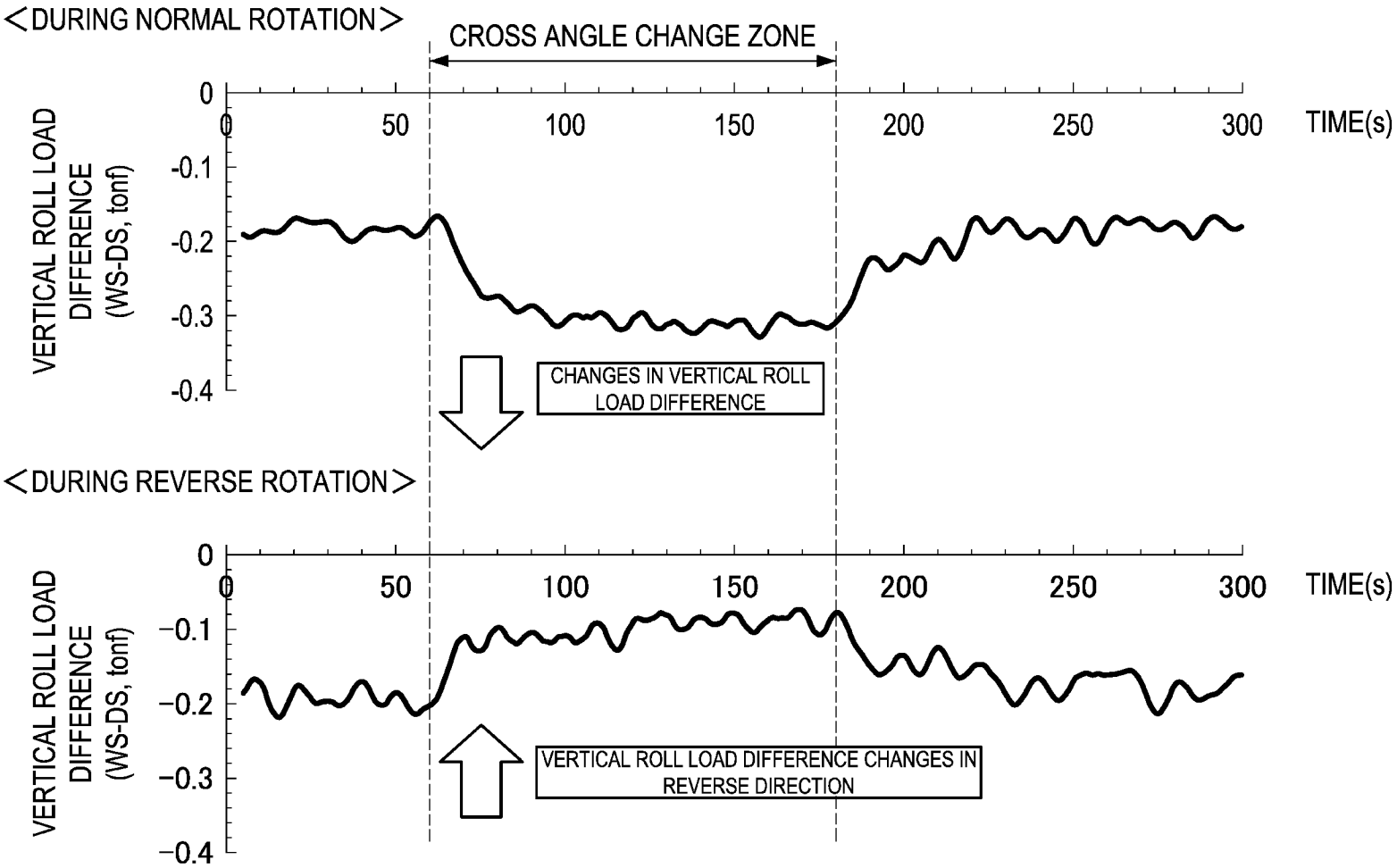
FIG. 6 is an explanatory drawing illustrating differences between vertical roll loads acquired in a case where rolls on a lower side are rotated in the normal direction and a case where the rolls are rotated in the reverse direction in the rolling mill in the state shown in FIG. 5.

Hereunder, the method for setting a rolling mill according to the present embodiment is described based on FIG. 3A to FIG. 6. FIG. 3A and FIG. 3B are flowcharts that describe a method for setting a rolling mill that performs roll chock position adjustment based on vertical roll loads during normal roll rotation and during reverse roll rotation according to the present embodiment. FIG. 4A is an explanatory drawing showing procedures for roll chock position adjustment in the method for setting a rolling mill according to the present embodiment, which illustrates position adjustment that is performed in a state in which a roll gap is open. FIG. 4B is an explanatory drawing showing procedures for roll chock position adjustment in the method for setting a rolling mill according to the present embodiment, which illustrates position adjustment that is performed in a kiss roll state. Note that, a description of the distribution of a load that acts between rolls is omitted from FIG. 4A and FIG. 4B. FIG. 5 is a multiple view drawing including a schematic side view and a schematic front view illustrating an example of a driving state of the rolling mill at a time of inter-roll cross angle identification. Note that, with respect to FIG. 5, although the load distribution also changes accompanying a change in the direction of a thrust force between the lower work roll 2 and the lower backup roll 4 during normal rotation and reverse rotation of the rolls, since the change in the load distribution is only a slight change, such a difference in the load distribution is not specifically described here. FIG. 6 is an explanatory drawing illustrating difference between vertical roll loads acquired in a case where rolls on the lower side are rotated in the normal direction and a case where the rolls are rotated in the reverse direction in the rolling mill in the state illustrated in FIG. 5. Whilst the lower backup roll 4 is described as the reference roll in the present example, it suffices to set either the roll at the uppermost part or the roll at the lowermost part in the vertical direction as the reference roll, and in some cases the upper backup roll 3 serves as the reference roll.

In the method for setting a rolling mill according to the present embodiment, with respect to a case where the roll gap between the upper work roll 1 and the lower work roll 2 is set in an open state and a case where the roll gap is set in a kiss roll state, a vertical roll load difference is calculated based on vertical roll loads on the drive side and the work side that were detected by the upper vertical roll load detection apparatuses 28*a* and 28*b*, and a vertical roll load difference is calculated based on vertical roll loads on the drive side and the work side that were detected by the lower vertical roll load detection apparatuses 29*a* and 29*b*. Further, position adjustment of roll chocks is then performed based on the calculated vertical roll load differences to make an inter-roll cross between each roll of the rolling mill fall within a predetermined range. At such time, the rolling direction position of the roll chocks of the reference roll is fixed as a reference position, and the positions in the rolling direction of the roll chocks of rolls other than the reference roll are moved to thereby adjust the positions of the roll chocks. These operations are described in detail hereunder.

(A) First Adjustment: Position Adjustment in State in which Roll Gap is Open (S100 to S116)

In a first adjustment in which position adjustment is performed in a state in which the roll gap is open, the upper work roll and the lower work roll are set in an open state, increase bending forces are imparted to apply loads between the work rolls and the backup rolls, and the positions of the upper and lower work roll chocks are controlled so that a difference between vertical roll loads that arise due to thrust forces between the relevant rolls in that state becomes a predetermined target value. First, as illustrated in FIG. 3A, the inter-roll cross control unit 23 causes the pressing-down device 27 to adjust the roll positions in the vertical direction so that the roll gap between the upper work roll 1 and the lower work roll 2 becomes an open state having a predetermined gap (S100). The pressing-down device 27 applies a predetermined load to the rolls based on the relevant instruction, to thereby set the roll gap between the work rolls 1 and 2 in an open state.

Further, the inter-roll cross control unit 23 instructs the increase bending control unit 26 so as to apply a predetermined increase bending force to the work roll chocks 5 and 6 by means of the increase bending apparatuses 24*a*, 24*b*, 25*a* and 25*b* (S102). The increase bending control unit 26 controls the respective increase bending apparatuses 24*a*, 24*b*, 25*a* and 25*b* based on the instruction, to thereby apply a predetermined increase bending force to the work roll chocks 5 and 6. By this means, a predetermined load can be applied only between the work roll and backup roll on the upper side and the lower side, respectively, without causing a load to act between the upper and lower work rolls. Note that, in a case where the increase bending apparatuses have a balancer function that lifts up the self-weight of the work rolls, the order of executing step S100 and step S102 may be reversed, that is, adjustment of the gap between the upper and lower work rolls may be performed after an increase bending force is applied.

Next, the inter-roll cross control unit 23 instructs the driving electric motor control unit 22 to drive the driving electric motor 21 and thereby cause the work rolls to rotate at a predetermined rotational speed and in a predetermined rotational direction (S104). The rotational speed and the rotational direction which are roll rotation conditions are set in advance, and the driving electric motor control unit 22 causes the upper work roll 1 and the lower work roll 2 to rotate in accordance with the roll rotation conditions that were set. It is assumed here that the rotational direction of each of the work rolls 1 and 2 in step S104 is the direction of normal rotation. When the work rolls are rotated, vertical roll loads on the work side and the drive side are respectively detected by the upper vertical roll load detection apparatuses 28*a* and 28*b* and the lower vertical roll load detection apparatuses 29*a* and 29*b*, and the detected vertical roll loads are output to the upper vertical roll load difference calculation portion 32 and the lower vertical roll load difference calculation portion 33. Upon receiving the input of the vertical roll loads, the upper vertical roll load difference calculation portion 32 and the lower vertical roll load difference calculation portion 33 each calculate a vertical roll load difference that is the difference between the vertical roll load on the work side and the vertical roll load on the drive side. Each of the calculated vertical roll load differences during normal roll rotation is input to the inter-roll cross control unit 23, and is adopted as a reference value 1 (corresponds to "first reference value" of the present invention) (S106).

After each reference value 1 is calculated, next, the work rolls are caused to rotate so that the rotational direction is the direction of reverse rotation, and processing for a time of reverse roll rotation is started. The inter-roll cross control unit 23 causes the driving electric motor control unit 22 to drive the driving electric motor 21 and thereby cause the work rolls to rotate at a predetermined rotational speed and in a predetermined rotational direction (S108). When the work rolls are rotated, similarly to the time of normal roll rotation, vertical roll loads on the work side and the drive side are respectively detected by the upper vertical roll load detection apparatuses 28*a* and 28*b* and the lower vertical roll load detection apparatuses 29*a* and 29*b*, and the detected vertical roll loads are output to the upper vertical roll load difference calculation portion 32 and the lower vertical roll load difference calculation portion 33. The rotational direction of each of the work rolls 1 and 2 in step S108 is taken to be the direction of reverse rotation.

Upon receiving the input of the vertical roll loads, the upper vertical roll load difference calculation portion 32 and the lower vertical roll load difference calculation portion 33 each calculate a vertical roll load difference that is the difference between the vertical roll load on the work side and the vertical roll load on the drive side, and output the calculated differential loads during reverse roll rotation to the inter-roll cross control unit 23. The inter-roll cross control unit 23 then calculates a first control target value for each of the upper roll assembly and the lower roll assembly based on a deviation between the relevant vertical roll load difference during reverse roll rotation and the corresponding reference value 1 calculated in step S106 (S110). The first control target value is preferably set to a value that is one-half of the deviation from the reference value 1. Note that, in some cases differences arise between the characteristics of vertical roll load differences in directions in which thrust forces act during normal rotation and during reverse rotation due to the influence of bearing looseness or sliding resistance between roll chocks and the housing or the like. In such a case, it suffices to set the first control target value in accordance with the degree of difference in the sizes of the vertical roll load differences during normal rotation and during reverse rotation based on results that were identified beforehand. That is, the first control target value may be a value other than a value that is one-half of the deviation from the reference value 1.

After each first control target value is calculated, with respect to each of the upper roll assembly and the lower roll assembly, a vertical roll load on the work side and a vertical roll load on the drive side are measured during reverse roll rotation, and a vertical roll load difference that is the difference between the measured values is calculated (S112). Next, the inter-roll cross control unit 23 compares the relevant vertical roll load difference during reverse roll rotation calculated in step S112 with the corresponding first control target value that was calculated in step S110, and determines whether or not these values match (S114). Note that, in the determination in step S114, it is assumed that cases where the values match include not only a case where the vertical roll load difference during reverse roll rotation and the first control target value match exactly, but also a case where a deviation of the vertical roll load difference during reverse roll rotation from the first control target value is within an allowable range. The allowable range may be defined, for example, by determining in advance the relation with respect to a deviation from the first control target value after first converting an asymmetric deformation amount obtained by performing roll deformation analysis or the like based on a zigzagging amount (mm) of a tail end portion or actual measurement values (mm/m) for camber per 1 m of a front end portion and vertical roll load differences during reverse roll rotation in an actual hot rolling process into a reduction leveling amount, that is, determining in advance the relation with respect to an inter-roll minute cross, and defining the allowable range so that zigzagging and camber are equal to or less than a standard that is required for the product. If it is determined in step S114 that the vertical roll load difference during reverse roll rotation is not the first control target value or is not within the allowable range thereof, the inter-roll cross control unit 23 instructs the roll chock position control unit 16 so as to adjust the positions of the work roll chocks of the roll assembly which did not satisfy the requirement in step S114 (S116). When the positions of the work roll chocks have been adjusted, the inter-roll cross control unit 23 executes the processing from step S112 again. At such time, instead of the upper work roll chocks, the positions of the upper backup roll chocks may be controlled so that a differential load that arises due to a thrust force between the upper work roll and the backup roll decreases.

When it is determined in step S114 that the respective vertical roll load differences during reverse roll rotation match the corresponding first control target value or is within the allowable range, the inter-roll cross control unit 23 transitions to the processing shown in FIG. 3B.

(Calculation of Reference Value 1 and First Control Target Value)

Calculation of the reference value 1 and the first control target value will now be described in detail based on FIG. 4A. First, as illustrated on the upper side of FIG. 4A, in a state in which the roll gap is open, in the upper roll assembly that includes the upper work roll 1 and the upper backup roll 3 and in the lower roll assembly that includes the lower work roll 2 and the lower backup roll 4, the respective rolls are caused to rotate in the normal direction. At such time, since the upper work roll 1 and the lower work roll 2 are separated from each other, each roll assembly is in an independent state. In this normal roll rotation state, a vertical roll load on the work side and a vertical roll load on the drive side of the upper roll assembly are measured, and a vertical roll load on the work side and a vertical roll load on the drive side of the lower roll assembly are measured. Next, based on these measurement values, a vertical roll load difference that is the difference between the vertical roll load on the work side and the vertical roll load on the drive side is calculated for each of the upper roll assembly and the lower roll assembly (P11, P12 in FIG. 4A). The vertical roll load difference of each roll assembly is calculated by the following formula (1).

[Expression 1]

$$\left.\begin{aligned} P_{df1}^{T} &= P_{W}^{T} - P_{D}^{T} \\ P_{df1}^{B} &= P_{W}^{B} - P_{D}^{B} \end{aligned}\right\} \quad (1)$$

Here, $P_{df1}{}^{T}$ represents a difference between vertical roll load measurement values on the work side and the drive side of the upper roll assembly in a normal roll rotation state (upper-side reference value $1^{T}$), and $P_{df1}{}^{B}$ represents a difference between the vertical roll load measurement values on the work side and the drive side of the lower roll assembly in a normal roll rotation state (lower-side reference value $1^{B}$). The reference value 1 in step S106 refers to the upper-side reference value $1^{T}$ and the lower-side reference value $1^{B}$. Further, $P_{W}{}^{T}$ represents a vertical roll load measurement value on the work side of the upper roll assembly in a normal roll rotation state, and $P_{W}{}^{B}$ represents a vertical roll load measurement value on the work side of the lower roll assembly in a normal roll rotation state. Further, $P_{D}{}^{T}$ represents a vertical roll load measurement value on the drive side of the upper roll assembly in a normal roll rotation state, and $P_{D}{}^{B}$ represents a vertical roll load measurement value on the drive side of the lower roll assembly in a normal roll rotation state.

Next, first control target values are calculated based on the measurement values on the work side and the drive side for upper and lower vertical roll loads that were measured in a state of reverse roll rotation and the respective reference values 1 calculated by the above formula (1).

In this case, to calculate the first control target values, the relation with respect to a vertical roll load difference that is a difference between a vertical roll load on the work side and a vertical roll load on the drive side during normal rotation of rolls and during reverse rotation of rolls was studied. In the study, for example, as illustrated in FIG. 5, in a rolling mill having a pair of work rolls 1 and 2 and a pair of backup rolls 3 and 4 supporting the pair of work rolls 1 and 2, the upper work roll 1 and the lower work roll 2 were separated from each other to set the roll gap between the work rolls 1 and 2 in an open state. Note that, the work side of the upper work roll 1 is supported by the upper work roll chock 5*a*, and the drive side of the upper work roll 1 is supported by the upper work roll chock 5*b*. The work side of the lower work roll 2 is supported by the lower work roll chock 6*a*, and the drive side of the lower work roll 2 is supported by the lower work roll chock 6*b*. The work side of the upper backup roll 3 is supported by the upper backup roll chock 7*a*, and the drive side of the upper backup roll 3 is supported by the upper backup roll chock 7*b*. Further, the work side of the lower backup roll 4 is supported by the lower backup roll chock 8*a*, and the drive side of the lower backup roll 4 is supported by the lower backup roll chock 8*b*. In the state in which the work rolls 1 and 2 were separated from each other, an increase bending force was applied by increase bending apparatuses (not illustrated) to the upper work roll chocks 5*a* and 5*b* and the lower work roll chocks 6*a* and 6*b*.

As illustrated in FIG. 5, when the rolls are rotated in a state in which an inter-roll cross angle arises between the lower work roll 2 and the lower backup roll 4, a thrust force is generated between the lower work roll 2 and the lower backup roll 4, and a moment is generated at the lower backup roll 4. In this state, in the present study, vertical roll loads were detected in the case where the rolls were subjected to normal rotation and the case where the rolls were rotated in reverse. For example, as illustrated in FIG. 6, during normal roll rotation and during reverse roll rotation, respectively, vertical roll loads were detected at a time when the lower work roll was rotated around an axis (Z-axis) parallel to the vertical direction to change an inter-roll cross angle only in a predetermined cross angle change zone. FIG. 6 shows measurement results obtained by detecting changes in a vertical roll load difference during normal roll rotation and during reverse roll rotation when an inter-roll cross angle of the lower work roll was changed by 0.1° to face the exit side on the drive side in a small rolling mill with a work roll diameter of 80 mm. The increase bending force applied to each work roll chock was set to 0.5 tonf/chock.

According to the detection results, a vertical roll load difference that is a difference between a vertical roll load on the drive side and a vertical roll load on the work side acquired during normal roll rotation is larger, in the negative direction, than the value thereof before changing the inter-roll cross angle. On the other hand, a vertical roll load difference that is a difference between a vertical roll load on the drive side and a vertical roll load on the work side acquired during reverse roll rotation is larger, in the positive direction, than the value thereof before changing the inter-roll cross angle. Thus, although the sizes of vertical roll load differences during normal roll rotation and during reverse roll rotation are approximately identical, the directions thereof are opposite to each other.

Therefore, based on the aforementioned relation, the state during normal roll rotation is taken as a reference, and one-half of a deviation from the reference in the state of reverse roll rotation is adopted as a control target value (first control target value) for the difference between vertical roll loads at which a thrust force between the work roll and the backup roll on the upper side and the lower side, respectively, becomes zero. The first control target values can be expressed by the following formula (2).

[Expression 2]

$$\left.\begin{aligned} P'^{T}_{dfT1} &= \frac{(P'^{T}_{W} - P'^{T}_{D}) - P^{T}_{df1}}{2} = \frac{P'^{T}_{df} - P^{T}_{df1}}{2} \\ P'^{B}_{dfT1} &= \frac{(P'^{B}_{W} - P'^{B}_{D}) - P^{B}_{df1}}{2} = \frac{P'^{B}_{df} - P^{B}_{df1}}{2} \end{aligned}\right\} \quad (2)$$

Here, $P'_{dfT1}{}^{T}$ represents the first control target value of the upper roll assembly, and $P'_{dfT1}{}^{B}$ represents the first control target value of the lower roll assembly. Further, $P'_{W}{}^{T}$ represents a vertical roll load measurement value on the work side of the upper roll assembly in a state of reverse roll rotation, and P'w' represents a vertical roll load measurement value on the work side of the lower roll assembly in a state of reverse roll rotation. Further, $P'_{D}{}^{T}$ represents a vertical roll load measurement value on the drive side of the upper roll assembly in a state of reverse roll rotation, $P'_{D}{}^{B}$ represents a vertical roll load measurement value on the drive side of the lower roll assembly in a state of reverse roll rotation, $P'_{df}{}^{T}$ represents a difference between the work side and the drive side in the vertical roll load measurement values of the upper roll assembly in a state of reverse roll rotation, and $P'_{df}{}^{B}$ represents a difference between the work side and the drive side in the vertical roll load measurement values of the lower roll assembly in a state of reverse roll rotation. In this way, a first control target value for each of the upper roll assembly and the lower roll assembly can be calculated.

Note that, whilst formula (2) has been defined here on the assumption that the sizes of vertical roll load differences during normal roll rotation and during reverse roll rotation are approximately identical, in some cases differences arise between the characteristics of vertical roll load differences in directions in which thrust forces act during normal rotation and during reverse rotation due to the influence of bearing looseness or sliding resistance between roll chocks and the housing or the like. In such a case, it suffices to set each first control target value in accordance with the degree of difference in the sizes of the vertical roll load differences during normal rotation and during reverse rotation based on results that were identified beforehand. That is, the first control target value may be a value other than a value that is one-half of the deviation from the reference value 1.

The roll chocks of rolls other than the reference roll are the object of the driving of roll chock positions during reverse roll rotation. That is, with regard to the upper roll assembly, as illustrated in the center in FIG. 4A, the positions of the upper work roll chocks may be controlled (P13), and as illustrated on the lower side in FIG. 4A, the positions of the upper backup roll chocks may be controlled (P15). On the other hand, with regard to the lower roll assembly, the lower backup roll 4 is not moved since it is the reference roll, and as illustrated in the center and on the lower side in FIG. 4A, the positions of the lower work roll chocks are controlled (P14, P16).

(B) Second Adjustment: Position Adjustment in Kiss Roll State (S118 to S134)

Returning to the description of the flowchart, when the position adjustment in the state in which the roll gap is open that is shown in the flowchart in FIG. 3A ends, next, as shown in FIG. 3B, the inter-roll cross control unit 23 causes the pressing-down device 27 to adjust roll positions in the vertical direction so that the roll gap between the upper work roll 1 and the lower work roll 2 becomes a predetermined kiss roll state (S118). The pressing-down device 27 applies a predetermined load to the rolls based on the relevant instruction to thereby cause the work rolls 1 and 2 to contact and enter a kiss roll state.

Next, the inter-roll cross control unit 23 causes the driving electric motor 21 to drive by means of the driving electric motor control unit 22 to thereby cause the work rolls to rotate at a predetermined rotational speed and in a predetermined rotational direction (S120). As described above, the rotational speed and the rotational direction that are roll rotation conditions are set in advance, and the driving electric motor control unit 22 causes the upper work roll 1 and the lower work roll 2 to rotate in accordance with the roll rotation conditions that were set. It is assumed here that the rotational direction of each of the work rolls 1 and 2 in step S120 is the direction of normal rotation. When the work rolls 1 and 2 are rotated, vertical roll loads on the work side and the drive side are respectively detected by the upper vertical roll load detection apparatuses 28*a* and 28*b* and the lower vertical roll load detection apparatuses 29*a* and 29*b*, and the detected vertical roll loads are output to the upper vertical roll load difference calculation portion 32 and the lower vertical roll load difference calculation portion 33.

Upon receiving the input of the vertical roll loads, the upper vertical roll load difference calculation portion 32 and the lower vertical roll load difference calculation portion 33 each calculate a vertical roll load difference that is the difference between the vertical roll load on the work side and the vertical roll load on the drive side. Each of the calculated vertical roll load differences during normal roll rotation is input to the inter-roll cross control unit 23, and is adopted as a reference value 2 (corresponds to "second reference value" of the present invention) (S122).

After each reference value 2 is calculated, next, the work rolls are caused to rotate so that the rotational direction is the direction of reverse rotation, and processing for a time of reverse roll rotation is started. The inter-roll cross control unit 23 causes the driving electric motor control unit 22 to drive the driving electric motor 21 and thereby cause the work rolls to rotate at a predetermined rotational speed and in a predetermined rotational direction (S124). When the work rolls are rotated, similarly to the time of normal roll rotation, vertical roll loads on the work side and the drive side are respectively detected by the upper vertical roll load detection apparatuses 28*a* and 28*b* and the lower vertical roll load detection apparatuses 29*a* and 29*b*, and the detected vertical roll loads are output to the upper vertical roll load difference calculation portion 32 and the lower vertical roll load difference calculation portion 33. The rotational direction of each of the work rolls 1 and 2 in step S124 is taken to be the direction of reverse rotation.

Upon receiving the input of the vertical roll loads, the upper vertical roll load difference calculation portion 32 and the lower vertical roll load difference calculation portion 33 each calculate a vertical roll load difference that is the difference between the vertical roll load on the work side and the vertical roll load on the drive side, and output the calculated vertical roll load differences during reverse roll rotation to the inter-roll cross control unit 23. The inter-roll cross control unit 23 then calculates a second control target value for each of the upper roll assembly and the lower roll assembly based on a deviation between the relevant vertical roll load difference during reverse roll rotation and the corresponding reference value 2 calculated in step S122 (S126). The second control target value is, for example, set to a value that is one-half of the deviation from the reference value 2. Note that, in some cases differences arise between the characteristics of vertical roll load differences in directions in which thrust forces act during normal rotation and during reverse rotation due to the influence of bearing looseness or sliding resistance between roll chocks and the housing or the like. In such a case, it suffices to set each second control target value in accordance with the degree of difference in the sizes of the vertical roll load differences during normal rotation and during reverse rotation based on results that were identified beforehand. That is, the second control target value may be a value other than a value that is one-half of the deviation from the reference value 2.

After each second control target value is calculated, with respect to each of the upper roll assembly and the lower roll assembly, a vertical roll load on the work side and a vertical roll load on the drive side are measured during reverse roll rotation, and a vertical roll load difference that is the difference between the measured values is calculated (S128). Next, the inter-roll cross control unit 23 compares the relevant vertical roll load difference during reverse roll rotation calculated in step S128 with the corresponding second control target value that was calculated in step S126, and determines whether or not these values match (S130). Note that, in the determination in step S130, it is assumed that cases where the values match include not only a case where the vertical roll load difference during reverse roll rotation and the second control target value match exactly, but also a case where a deviation of the vertical roll load difference during reverse roll rotation from the second control target value is within a predetermined range. If it is determined in step S130 that the vertical roll load difference during reverse roll rotation is not the second control target value or is not within the allowable range of deviation, the inter-roll cross control unit 23 instructs the roll chock position control unit 16 so as to adjust the positions of the work roll chocks of the roll assembly which did not satisfy the requirement of step S130 (S132). When the positions of the work roll chocks have been adjusted, the inter-roll cross control unit 23 executes the processing from step S128 again.

When it is determined in step S130 that each vertical roll load difference during reverse roll rotation matches the corresponding second control target value or is within the allowable range of deviation, the inter-roll cross control unit 23 determines that an inter-roll cross between the upper backup roll 3, the upper work roll 1, the lower work roll 2 and the lower backup roll 4 was adjusted to within the allowable range, and causes the pressing-down device 27 to adjust the rolls so that the roll gap between the upper work roll 1 and the lower work roll 2 becomes a predetermined size (S134). Thereafter, reduction position zero point adjustment or rolling of a workpiece by the rolling mill is started.

(Calculation of Reference Value 2 and Second Control Target Value)

Calculation of the reference value 2 and the second control target value will now be described in detail based on FIG. 4B. In the second adjustment, a tightening load is applied in a kiss roll state in which the upper and lower work rolls are caused to contact each other, and the positions of the chocks of the work roll and the backup roll on the opposite side to the reference roll are controlled so that a vertical roll load difference that arises due to a thrust force between the upper and lower work rolls in that state becomes a predetermined target value.

First, as illustrated on the upper side in FIG. 4B, in the kiss roll state, in the upper roll assembly that includes the upper work roll 1 and the upper backup roll 3 and in the lower roll assembly that includes the lower work roll 2 and the lower backup roll 4, the respective rolls are caused to rotate in the normal direction. Further, a vertical roll load on the work side and a vertical roll load on the drive side of the upper roll assembly are measured, and a vertical roll load on the work side and a vertical roll load on the drive side of the lower roll assembly are measured. Based on these measurement values, a vertical roll load difference that is the difference between the vertical roll load on the work side and the vertical roll load on the drive side is calculated for each of the upper roll assembly and the lower roll assembly (P21, P22). The vertical roll load difference of each roll assembly is calculated by the following formula (3).

[Expression 3]

$$\left.\begin{aligned} P_{df2}^{T} &= P_{W}^{T} - P_{D}^{T} \\ P_{df2}^{B} &= P_{W}^{B} - P_{D}^{B} \end{aligned}\right\} \tag{3}$$

Here, $P_{df2}{}^{T}$ represents a difference between vertical roll load measurement values on the work side and the drive side of the upper roll assembly in a normal roll rotation state in a kiss roll state (upper-side reference value $2^{T}$), and $P_{df2}{}^{B}$ represents a difference between the vertical roll load measurement values on the work side and the drive side of the lower roll assembly in a normal roll rotation state in a kiss roll state (lower-side reference value $2^{B}$). The reference value 2 in step S122 refers to the upper-side reference value $2^{T}$ and the lower-side reference value $2^{B}$.

Next, the rotation direction of the rolls in the kiss roll state is changed to reverse rotation, and second control target values are calculated based on measurement values on the drive side and the work side for upper and lower vertical roll loads that are measured and the corresponding reference value 2 calculated by the above formula (3). With regard to the second control target value also, similarly to the first control target value, when the normal roll rotation state is taken as the reference, one-half of a deviation from the reference in the state of reverse roll rotation can be adopted as a control target value (second control target value) for the difference between vertical roll loads at which a thrust force between the work roll and the backup roll on the upper side and the lower side, respectively, becomes zero. That is, the second control target values can be expressed by the following formula (4).

[Expression 4]

$$\left.\begin{aligned} P'_{dfT2}{}^{T} &= \frac{(P_{W}^{T} - P_{D}^{T}) - P_{df2}^{T}}{2} = \frac{P_{df}^{T} - P_{df2}^{T}}{2} \\ P'_{dfT2}{}^{B} &= \frac{(P_{W}^{B} - P_{D}^{B}) - P_{df2}^{B}}{2} = \frac{P_{df}^{B} - P_{df2}^{B}}{2} \end{aligned}\right\} \tag{4}$$

Here, $P'_{dfT2}{}^{T}$ represents a second control target value of the upper roll assembly, and $P'_{dfT2}{}^{B}$ represents a second control target value of the lower roll assembly. The second control target values for the upper roll assembly and the lower roll assembly can be calculated in this way. Note that, whilst a method that calculates loads in the vertical direction for both the upper and lower roll assemblies is described with regard to the above calculation, in the case of the second adjustment, because the difference is a difference between vertical roll loads that arises due to a thrust force between the upper and lower work rolls in the kiss roll state in which the upper and lower work rolls are caused to contact each other, the influence produced by the inter-roll cross appears similarly in both the upper and lower roll assemblies. Therefore, in this case, it suffices to perform control of the work roll and backup roll chock positions on the opposite side to the reference roll using at least the value for either one of the upper and lower roll assemblies (P23 in FIG. 4B).

Note that, whilst formula (4) has been defined here on the assumption that the sizes of vertical roll load differences during normal roll rotation and during reverse roll rotation are approximately identical, in some cases differences arise between the characteristics of vertical roll load differences in directions in which thrust forces act during normal rotation and during reverse rotation due to the influence of bearing looseness or sliding resistance between roll chocks and the housing or the like. In such a case, it suffices to set each second control target value in accordance with the degree of difference in the sizes of the vertical roll load differences during normal rotation and during reverse rotation based on results that were identified beforehand. That is, the second control target value may be a value other than a value that is one-half of the deviation from the reference value 2.

[2-3. Summary]

A rolling mill and a method for setting the rolling mill according to the first embodiment of the present invention have been described above. According to the present embodiment, utilizing the fact that although the sizes of vertical roll load differences during normal roll rotation and during reverse roll rotation are approximately identical, the directions thereof are opposite to each other, control target values for making an inter-roll cross angle zero are set that are calculated based on vertical roll load differences, and the aforementioned first adjustment and second adjustment are performed before reduction position zero point adjustment or before the start of rolling. By this means, rolling of a workpiece is performed in a state in which an inter-roll cross angle has been eliminated, and hence the occurrence of zigzagging and camber of the workpiece can be suppressed.

3. Second Embodiment

Next, a method for setting a rolling mill according to a second embodiment of the present invention will be described based on FIG. 7A to FIG. 8B. In the present embodiment, similarly to the first embodiment, before reduction position zero point adjustment or before the start of rolling, the positions of roll chocks are adjusted so as to make an inter-roll cross angle between a backup roll serving as a reference and other rolls zero, to thereby realize rolling in which thrust forces do not arise. In the rolling mill according to the present embodiment also, similarly to the first embodiment, it is possible to adjust an inter-roll cross even in a case where thrust counterforces cannot be measured. Note that, the rolling mill according to the present embodiment and the apparatus for controlling the rolling mill can be configured similarly to the rolling mill and the apparatus for controlling the rolling mill according to the first embodiment that are illustrated in FIG. 2. Therefore a detailed description regarding the rolling mill and the apparatus for controlling the rolling mill is omitted here.

[3-1. Method for setting rolling mill]

Figure 7A:
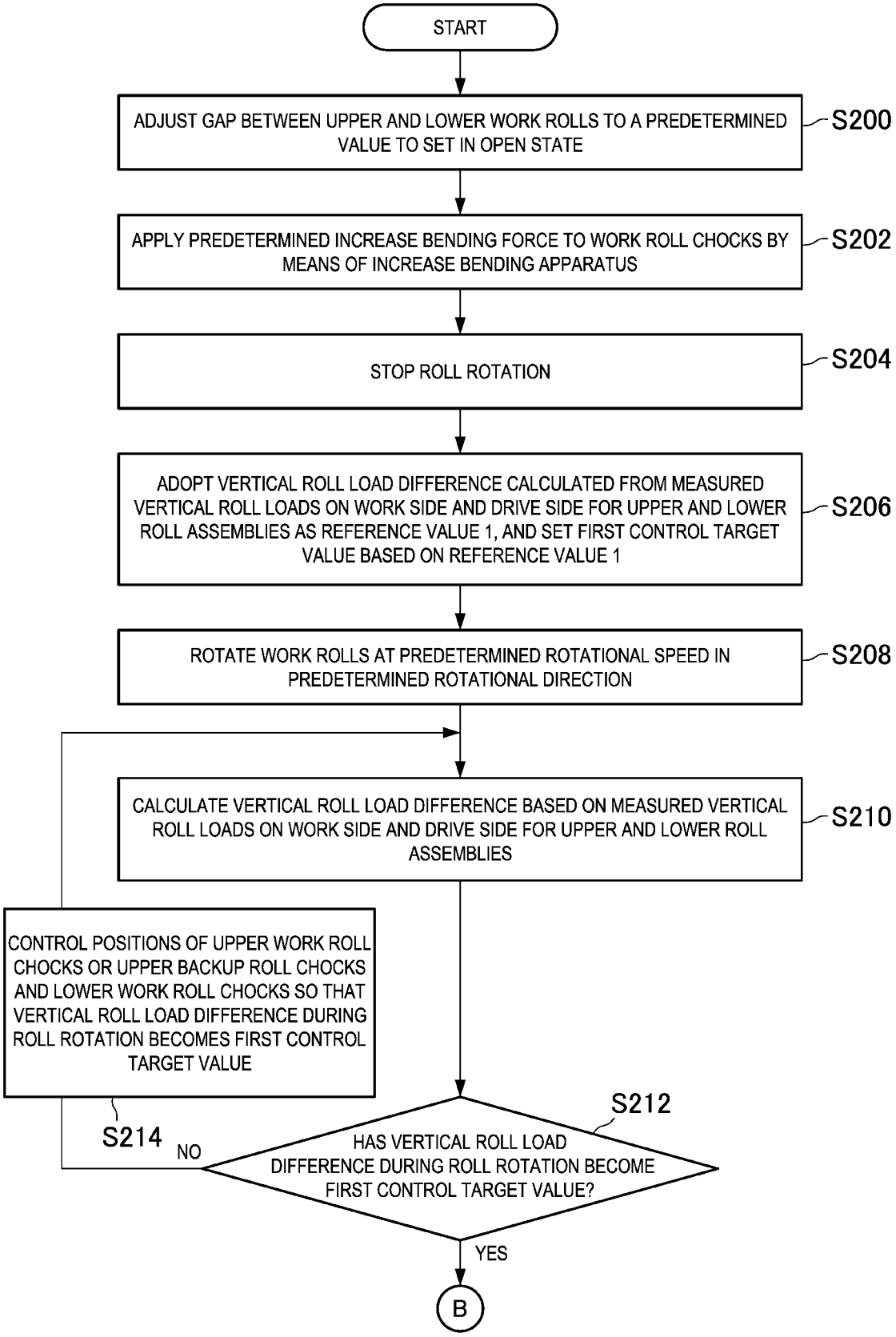
FIG. 7A is a flowchart describing a method for setting a rolling mill that performs roll chock position adjustment based on vertical roll loads at a time when rolls are stopped and vertical roll loads at a time of roll rotation according to a second embodiment of the present invention, which describes a first adjustment in a state in which a roll gap is open.
Figure 7B:
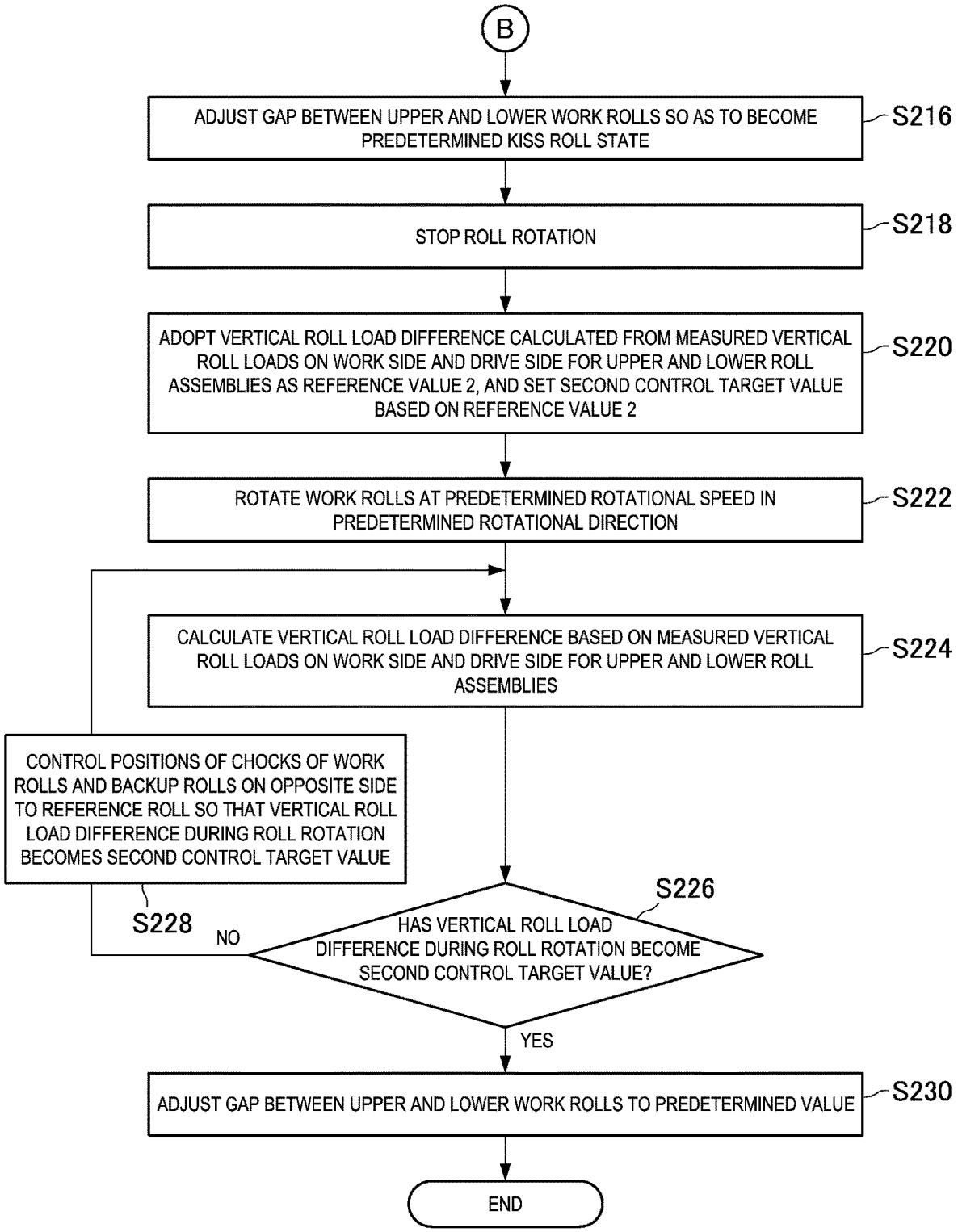
FIG. 7B is a flowchart describing a method for setting a rolling mill that performs roll chock position adjustment based on vertical roll loads at a time when rolls are stopped and vertical roll loads at a time of roll rotation according to the second embodiment, which describes a second adjustment in a kiss roll state.
Figure 8A:
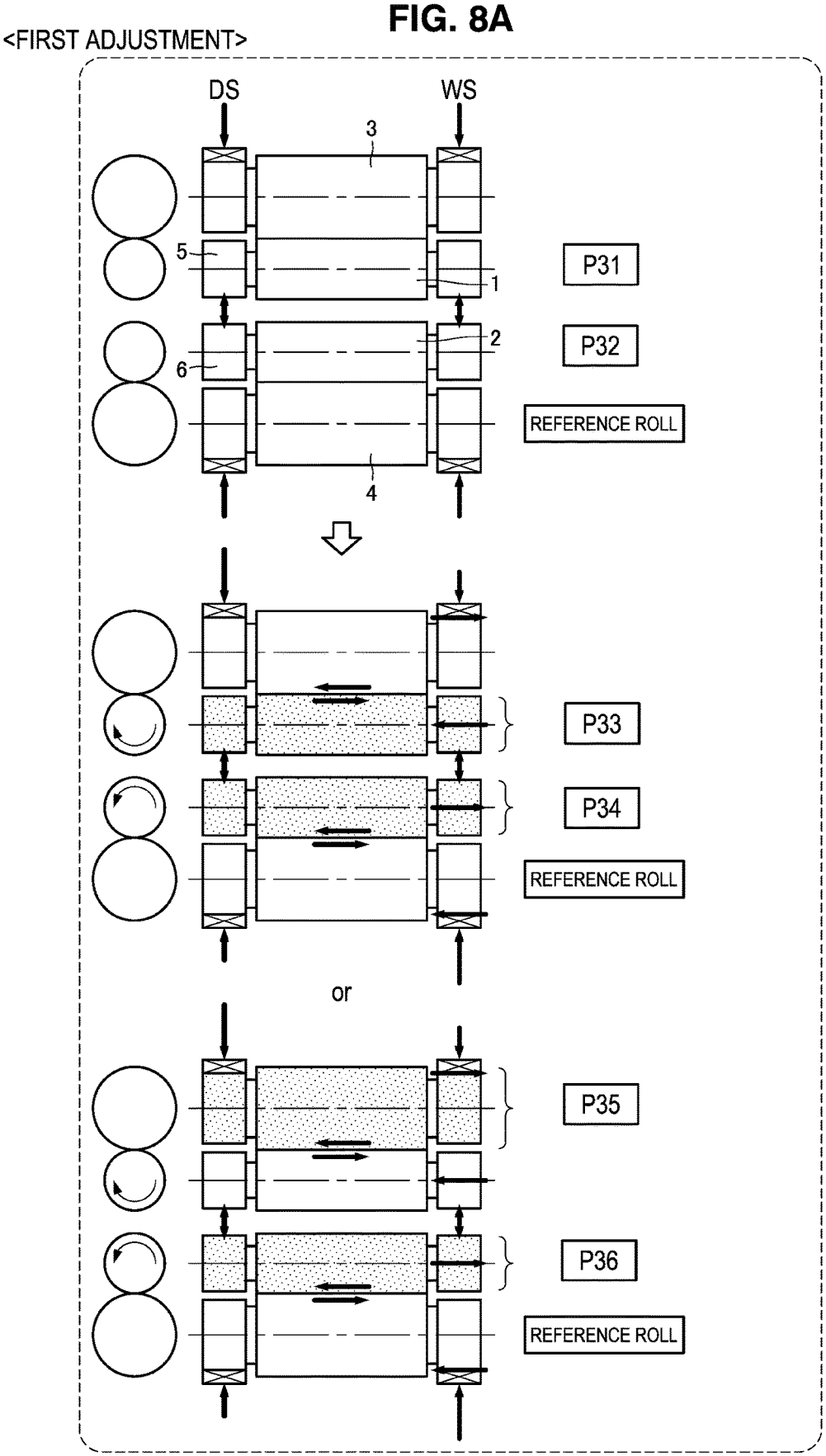
FIG. 8A is an explanatory drawing illustrating procedures for roll chock position adjustment in the method for setting a rolling mill according to the second embodiment, which illustrates position adjustment that is performed in a state in which a roll gap is open.
Figure 8B:
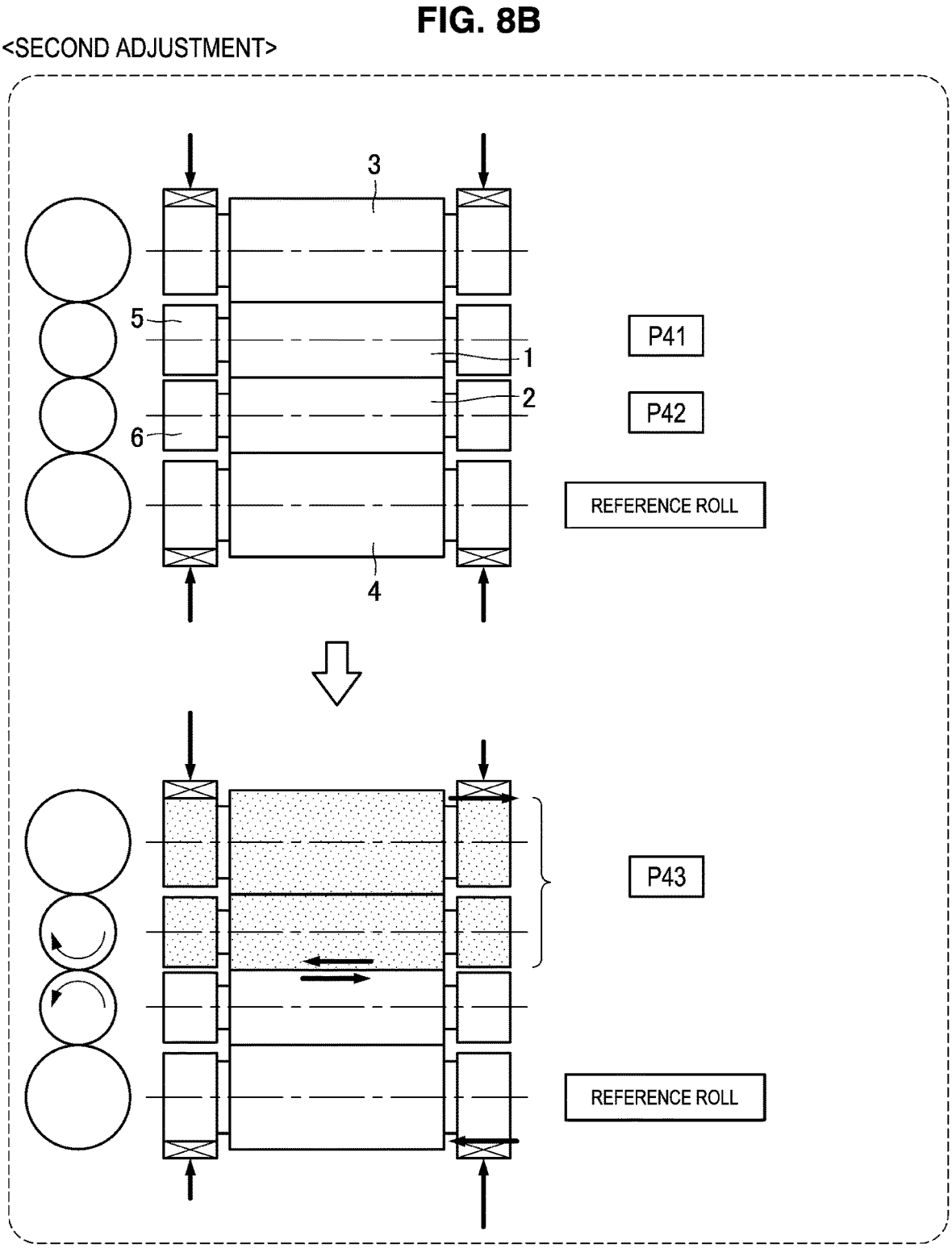
FIG. 8B is an explanatory drawing illustrating procedures for roll chock position adjustment in the method for setting a rolling mill according to the second embodiment, which illustrates position adjustment that is performed in a kiss roll state.

FIG. 7A and FIG. 7B are flowcharts for describing a method for setting a rolling mill according to the present embodiment, and illustrate an example in a case of performing position adjustment based on vertical roll loads at a time when rolls are in a stopped state and at a time of roll rotation. FIG. 8A is an explanatory drawing showing procedures for roll chock position adjustment in the method for setting a rolling mill according to the present embodiment, which illustrates position adjustment that is performed in a state in which a roll gap is open. FIG. 8B is an explanatory drawing showing procedures for roll chock position adjustment in the method for setting a rolling mill according to the present embodiment, which illustrates position adjustment that is performed in a kiss roll state. Note that, a description of the distribution of a load that acts between rolls is omitted from FIGS. 8A and 8B. Further, whilst the lower backup roll 4 is described as the reference roll in the present example, it suffices to set either the roll at the uppermost part or the roll at the lowermost part in the vertical direction as the reference roll, and in some cases the upper backup roll 3 serves as the reference roll.

In the method for setting a rolling mill according to the present embodiment, with respect to a case where the roll gap between the upper work roll 1 and the lower work roll 2 is set in an open state and a case where the roll gap is set in a kiss roll state, a vertical roll load difference is calculated based on vertical roll loads on the drive side and the work side that were detected by the upper vertical roll load detection apparatuses 28*a* and 28*b*, and a vertical roll load difference is calculated based on vertical roll loads on the drive side and the work side that were detected by the lower vertical roll load detection apparatuses 29*a* and 29*b*. Further, position adjustment of roll chocks is then performed based on the calculated vertical roll load differences to make an inter-roll cross between each roll of the rolling mill fall within a predetermined range. At such time, control target values for performing position adjustment of the roll chocks are derived using vertical roll loads on the work side and the drive side of the upper roll assembly and the lower roll assembly that are measured when the rolls are at a stop and when the rolls are rotating. At such time, the rolling direction position of the roll chocks of the reference roll is fixed as a reference position, and the positions in the rolling direction of the roll chocks of rolls other than the reference roll are moved to thereby adjust the positions of the roll chocks. These operations are described in detail hereunder.

(A) First Adjustment: Position Adjustment in State in which Roll Gap is Open (S200 to S214)

In a first adjustment in which position adjustment is performed in a state in which the roll gap is open, the upper work roll and the lower work roll are set in an open state, increase bending forces are imparted to apply loads between the work rolls and the backup rolls, and the positions of the upper and lower work roll chocks are controlled so that a difference between vertical roll loads that arises due to thrust forces between the relevant rolls in that state becomes a predetermined target value. First, as illustrated in FIG. 7A, the inter-roll cross control unit 23 causes the pressing-down device 27 to adjust the roll positions in the vertical direction so that the roll gap between the upper work roll 1 and the lower work roll 2 is in an open state having a predetermined gap (S200). The pressing-down device 27 applies a predetermined load to the rolls based on the relevant instruction, to thereby set the roll gap between the work rolls 1 and 2 in an open state.

Further, the inter-roll cross control unit 23 instructs the increase bending control unit 26 so as to apply a predetermined increase bending force to the work roll chocks 5 and 6 by means of the increase bending apparatuses 24*a*, 24*b*, 25*a* and 25*b* (S202). The increase bending control unit 26 controls the respective increase bending apparatuses 24*a*, 24*b*, 25*a* and 25*b* based on the instruction, to thereby apply a predetermined increase bending force to the work roll chocks 5 and 6. By this means, a predetermined load can be applied only between the work roll and the backup roll on the upper side and the lower side, respectively, without causing a load to act between the upper and lower work rolls. Note that, in a case where the increase bending apparatuses have a balancer function that lifts up the self-weight of the work rolls, the order of executing step S200 and step S202 may be reversed, that is, adjustment of the gap between the upper and lower work rolls may be performed after an increase bending force is applied.

Next, the inter-roll cross control unit 23 sets the rolls in a state in which rotation is stopped (S204). Subsequently, in the state in which the rolls are stopped, vertical roll loads on the work side and the drive side, respectively, are detected by the upper vertical roll load detection apparatuses 28*a* and 28*b* and the lower vertical roll load detection apparatuses 29*a* and 29*b*, and the detected values for the vertical roll loads are output to the upper vertical roll load difference calculation portion 32 and the lower vertical roll load difference calculation portion 33. Upon receiving the input of the vertical roll loads, the upper vertical roll load difference calculation portion 32 and the lower vertical roll load difference calculation portion 33 each calculate a vertical roll load difference that is the difference between the vertical roll load on the work side and the vertical roll load on the drive side. Each of the calculated vertical roll load differences for a time when the rolls are at a stop is input to the inter-roll cross control unit 23, and is adopted as a reference value 1 (corresponds to "first reference value" of the present invention), and a first control target value is calculated based on the relevant reference value 1 (S206).

After each first control target value is calculated, next the upper work roll 1 and the lower work roll 2 are caused to rotate, and processing for a time of roll rotation is started. The inter-roll cross control unit 23 causes the driving electric motor 21 to drive by means of the driving electric motor control unit 22 and thereby cause the work rolls to rotate at a predetermined rotational speed and in a predetermined rotational direction (S208). When the work rolls are rotated, vertical roll loads on the work side and the drive side are respectively detected by the upper vertical roll load detection apparatuses 28*a* and 28*b* and the lower vertical roll load detection apparatuses 29*a* and 29*b*, and the detected vertical roll loads are output to the upper vertical roll load difference calculation portion 32 and the lower vertical roll load difference calculation portion 33. Upon receiving the input of the vertical roll loads, the upper vertical roll load difference calculation portion 32 and the lower vertical roll load difference calculation portion 33 each calculate a vertical roll load difference that is the difference between the vertical roll load on the work side and the vertical roll load on the drive side, and output the calculated vertical roll load differences during roll rotation to the inter-roll cross control unit 23 (S210).

The inter-roll cross control unit 23 compares each vertical roll load difference during roll rotation calculated in step S210 with the corresponding first control target value that was calculated in step S206, and determines whether or not these values match (S212). Note that, in the determination in step S212, it is assumed that cases where the values match include not only a case where the vertical roll load difference during roll rotation and the first control target value match exactly, but also a case where a deviation of the vertical roll load difference from the first control target value during roll rotation is within a predetermined range. If it is determined in step S212 that the vertical roll load difference during roll rotation is not the first control target value or is not within the allowable range of deviation, the inter-roll cross control unit 23 instructs the roll chock position control unit 16 so as to adjust the positions of the work roll chocks of the roll assembly which did not satisfy the requirement of step S212 (S214). When the positions of the upper and lower work roll chocks have been adjusted, the inter-roll cross control unit 23 executes the processing from step S210 again. At such time, instead of the upper work roll chocks, the positions of the upper backup roll chocks may be controlled so that a differential load that arises due to a thrust force between the upper work roll and the upper backup roll decreases.

When it is determined in step S212 that each vertical roll load difference during roll rotation matches the corresponding first control target value or is within the allowable range of deviation, the inter-roll cross control unit 23 transitions to the processing shown in FIG. 7B.

(Calculation of Reference Value 1 and First Control Target Value)

Calculation of the reference value 1 and the first control target value will now be described in detail based on FIG. 8A. First, as illustrated on the upper side of FIG. 8A, in a state in which the roll gap is open, in the upper roll assembly that includes the upper work roll 1 and the upper backup roll 3 and in the lower roll assembly that includes the lower work roll 2 and the lower backup roll 4, rotation of each roll is stopped. At such time, since the upper work roll 1 and the lower work roll 2 are separated from each other, each roll assembly is in an independent state. In this state in which the rolls are stopped, a vertical roll load on the work side and a vertical roll load on the drive side of the upper roll assembly are measured, and a vertical roll load on the work side and a vertical roll load on the drive side of the lower roll assembly are measured. Next, based on these measurement values, a vertical roll load difference that is the difference between the vertical roll load on the work side and the vertical roll load on the drive side is calculated for each of the upper roll assembly and the lower roll assembly (P31, P32). The vertical roll load difference of each roll assembly is calculated by the following formula (5).

[Expression 5]

$$\left.\begin{aligned} P_{df1}^{0T} &= P_W^{0T} - P_D^{0T} \\ P_{df1}^{0B} &= P_W^{0B} - P_D^{0B} \end{aligned}\right\} \tag{5}$$

Here, $P^0{}_{df1}{}^T$ represents a difference between vertical roll load measurement values on the work side and the drive side of the upper roll assembly in a state in which the rolls are stopped (upper-side reference value $1^T$), and $P^0{}_{df1}{}^B$ represents a difference between the vertical roll load measurement values on the work side and the drive side of the lower roll assembly in a state in which the rolls are stopped (lower-side reference value $1^B$). The reference value 1 in step S206 refers to the upper-side reference value $1^T$ and the lower-side reference value $1^B$. Further, $P^0{}_W{}^T$ represents a vertical roll load measurement value on the work side of the upper roll assembly in a state in which the rolls are stopped, and $P^0{}_W{}^B$ represents a vertical roll load measurement value on the work side of the lower roll assembly in a state in which the rolls are stopped. Further, $P^0{}_D{}^T$ represents a vertical roll load measurement value on the drive side of the upper roll assembly in a state in which the rolls are stopped, and $P^0{}_D{}^B$ represents a vertical roll load measurement value on the drive side of the lower roll assembly in a state in which the rolls are stopped.

Figure 9:
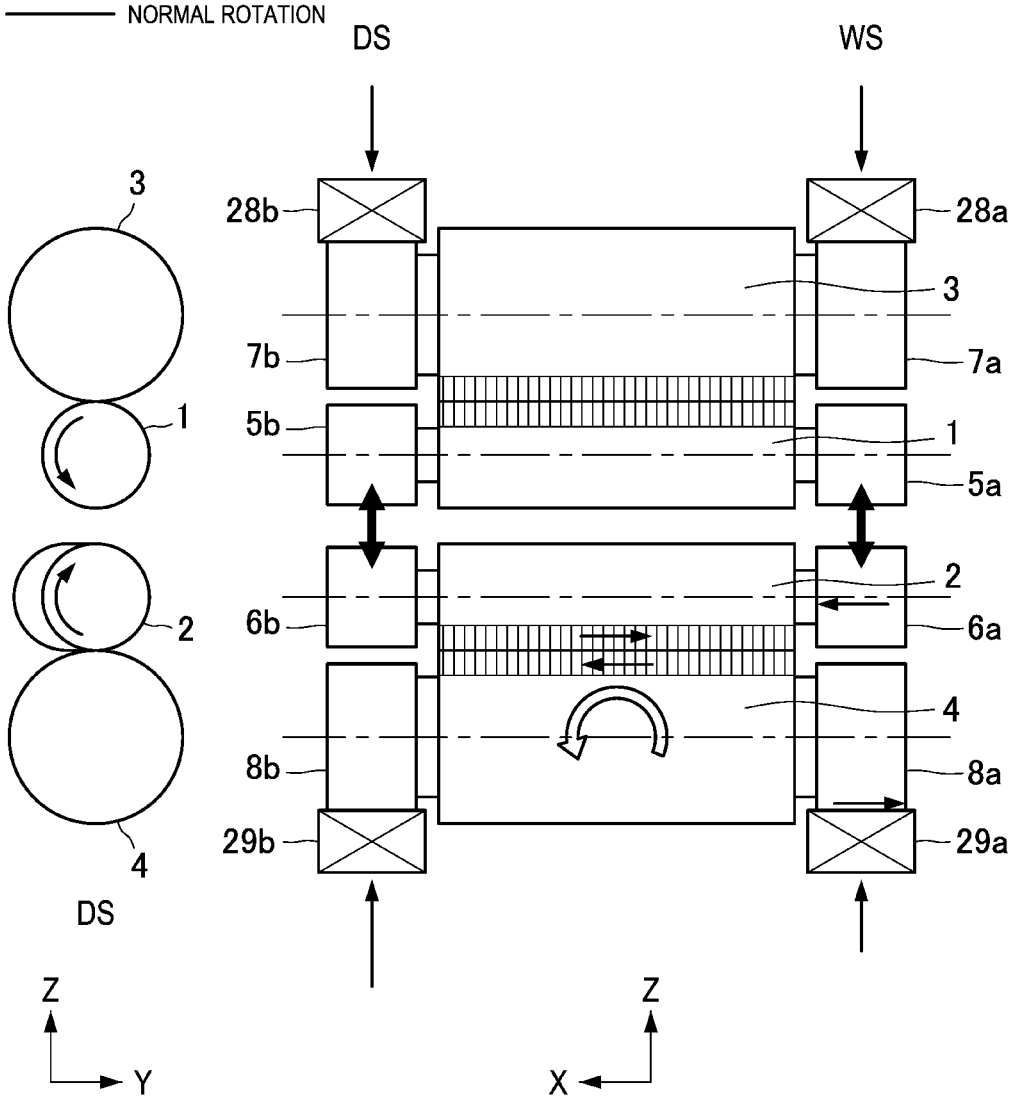
FIG. 9 is a multiple view drawing including a schematic side view and a schematic front view illustrating another example of a driving state at a state of the rolling mill at a time of inter-roll cross angle identification.

First control target values are then set based on the relevant reference values 1. In this case, to calculate the first control target values, the relation with respect to vertical roll load differences at a time when rolls are stopped and at a time of roll rotation was studied. In the study, for example, as illustrated in FIG. 9, in a rolling mill having the same configuration as the rolling mill illustrated in FIG. 5, the upper work roll 1 and the lower work roll 2 were separated from each other to set the roll gap between the work rolls 1 and 2 in an open state. In the state in which the work rolls 1 and 2 were separated from each other, an increase bending force was applied by increase bending apparatuses (not illustrated) to the upper work roll chocks 5*a* and 5*b* and the lower work roll chocks 6*a* and 6*b*.

As illustrated in FIG. 9, assuming that an inter-roll cross angle arises between the lower work roll 2 and the lower backup roll 4, when the lower work roll 2 and the lower backup roll 4 are rotated, a thrust force is generated between the lower work roll 2 and the lower backup roll 4 and a moment is generated at the lower backup roll 4. The moment causes a load applied to a lower vertical roll load detection apparatus 10*b* on the drive side to become larger than a load applied to a lower vertical roll load detection apparatus 10*a* on the work side, and hence a vertical roll load difference arises. On the other hand, in a state in which the rolls are stopped, relative slippage in the axial direction of the rolls does not occur between the lower work roll 2 and the lower backup roll 4, and thus an inter-roll thrust force is not generated. Consequently, in the lower vertical roll load detection apparatuses 10*a* and 10*b*, vertical roll loads that are not influenced by an inter-roll thrust force are detected.

Figure 10:
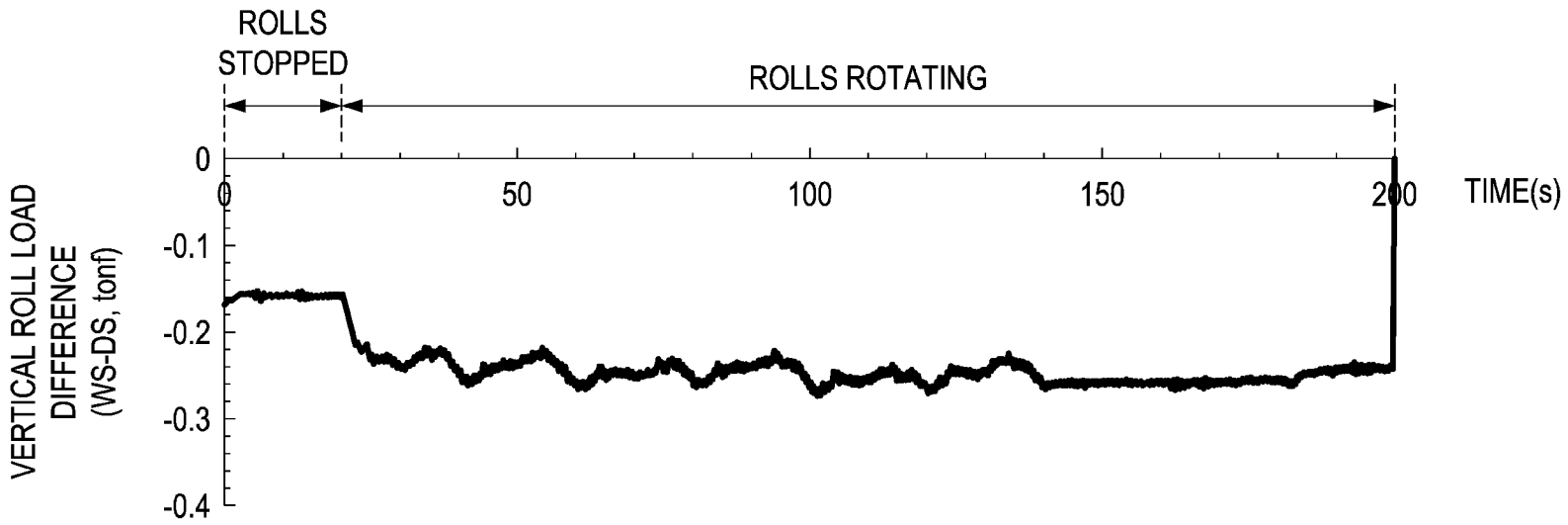
FIG. 10 is an explanatory drawing illustrating differences between vertical roll loads acquired in a case where rolls on the lower side are stopped and a case where the rolls are rotated in the rolling mill in the state shown in FIG. 9.

FIG. 10 illustrates changes in a vertical roll load difference that is a difference between vertical roll loads detected on the drive side and on the work side, with respect to a time when rolls are at a stop and a time when rolls are rotated. A predetermined inter-roll cross angle was provided between the lower work roll 2 and the lower backup roll 4, and vertical roll loads in a state in which the tolls were stopped were detected, and thereafter the rolls were rotated and vertical roll loads were detected. FIG. 10 shows a measurement result obtained by detecting a change in a vertical roll load difference during normal roll rotation and during reverse roll rotation when an inter-roll cross angle of the lower work roll was changed by 0.1° to face the exit side on the drive side in a small rolling mill with a work roll diameter of 80 mm. The increase bending force applied to each work roll chock was set to 0.5 tonf/chock. As illustrated in FIG. 10, the vertical roll load difference when the rolls are rotated is larger, in the negative direction, than the vertical roll load difference when the rolls are at a stop. Thus, the vertical roll load difference differs between a time when the rolls are at a stop and a time when the rolls are rotated.

Since it is considered that a vertical roll load difference that arises in a state in which rolls are stopped is caused by a factor other than a thrust force, thrust forces between the work roll and the backup roll on the upper side and the lower side, respectively can be made zero by setting first control target values that take a vertical roll load difference in a state in which the rolls are stopped as a reference and controlling the roll chock positions. The first control target values are expressed by the following formula (6).

[Expression 6]

$$\left.\begin{aligned} P^{rT}_{dfT1} &= P^{0T}_{df1} \\ P^{rB}_{dfT1} &= P^{0B}_{df1} \end{aligned}\right\} \tag{6}$$

Here, $P^{r}_{dfT1}{}^{T}$ represents a first control target value of the upper roll assembly, and $P^{r}_{dfT1}{}^{B}$ represents a first control target value of the lower roll assembly. Note that, in this case, the direction of rotation in a state of roll rotation is not particularly defined, and rotation of the rolls may be either normal rotation or reverse rotation. In this way, first control target values for the upper roll assembly and the lower roll assembly can be calculated.

The roll chocks of rolls other than the reference roll are the object of the driving of roll chock positions during roll rotation. That is, with regard to the upper roll assembly, as illustrated in the center in FIG. 8A, the positions of the upper work roll chocks may be controlled (P33), and as illustrated on the lower side in FIG. 8A, the positions of the upper backup roll chocks may be controlled (P35). On the other hand, with regard to the lower roll assembly, the lower backup roll 4 is not moved since it is the reference roll, and as illustrated in the center and on the lower side in FIG. 8A, the positions of the lower work roll chocks are controlled (P34, P36).

(B) Second Adjustment: Position Adjustment in Kiss Roll State (S216 to S230)

Returning to the description of the flowchart, when position adjustment in the state in which the roll gap is open that is shown in the flowchart in FIG. 7A ends, next, as shown in FIG. 7B, the inter-roll cross control unit 23 causes the pressing-down device 27 to adjust roll positions in the vertical direction so that the roll gap between the upper work roll 1 and the lower work roll 2 becomes a predetermined kiss roll state (S216). The pressing-down device 27 applies a predetermined load to the rolls based on the relevant instruction to thereby cause the work rolls 1 and 2 to contact and enter a kiss roll state.

Next, the inter-roll cross control unit 23 sets the rolls in a state in which rotation is stopped (S218). Subsequently, in the state in which the rolls are at a stop, vertical roll loads on the work side and the drive side, respectively, are detected by the upper vertical roll load detection apparatuses 28*a* and 28*b* and the lower vertical roll load detection apparatuses 29*a* and 29*b*, and the detected vertical roll loads are output to the upper vertical roll load difference calculation portion 32 and the lower vertical roll load difference calculation portion 33. Upon receiving the input of the vertical roll loads, the upper vertical roll load difference calculation portion 32 and the lower vertical roll load difference calculation portion 33 each calculate a vertical roll load difference that is the difference between the vertical roll load on the work side and the vertical roll load on the drive side. Each of the calculated vertical roll load differences for a time when the rolls are at a stop is input to the inter-roll cross control unit 23, and is adopted as a reference value 2 (corresponds to "second reference value" of the present invention), and a second control target value is calculated based on the relevant reference value 2 (S220).

After each second control target value is calculated, next the upper work roll 1 and the lower work roll 2 are caused to rotate, and processing for a time of roll rotation is started. The inter-roll cross control unit 23 causes the driving electric motor 21 to drive by means of the driving electric motor control unit 22 and thereby cause the work rolls to rotate at a predetermined rotational speed and in a predetermined rotational direction (S222). When the work rolls are rotated, vertical roll loads on the work side and the drive side are respectively detected by the upper vertical roll load detection apparatuses 28*a* and 28*b* and the lower vertical roll load detection apparatuses 29*a* and 29*b*, and the detected vertical roll loads are output to the upper vertical roll load difference calculation portion 32 and the lower vertical roll load difference calculation portion 33. Upon receiving the input of the vertical roll loads, the upper vertical roll load difference calculation portion 32 and the lower vertical roll load difference calculation portion 33 each calculate a vertical roll load difference that is the difference between the vertical roll load on the work side and the vertical roll load on the drive side, and output the calculated vertical roll load differences during roll rotation to the inter-roll cross control unit 23 (S224).

The inter-roll cross control unit 23 compares the relevant vertical roll load difference during roll rotation calculated in step S224 with the corresponding second control target value that was calculated in step S220, and determines whether or not these values match (S226). Note that, in the determination in step S226, it is assumed that cases where the values match include not only a case where the vertical roll load difference during roll rotation and the second control target value match exactly, but also a case where a deviation of the vertical roll load difference during roll rotation from the second control target value is within a predetermined range. If it is determined in step S226 that the vertical roll load difference during roll rotation is not the second control target value or is not within the allowable range of deviation, the inter-roll cross control unit 23 instructs the roll chock position control unit 16 so as to adjust the positions of the work roll chocks of the roll assembly which did not satisfy the requirement of step S226 (S228). When the positions of the work roll chocks have been adjusted, the inter-roll cross control unit 23 executes the processing from step S224 again.

Thereafter, when it is determined in step S226 that each vertical roll load difference during roll rotation matches the corresponding second control target value or is within the allowable range of deviation, the inter-roll cross control unit 23 determines that the inter-roll cross between the upper backup roll 3, the upper work roll 1, the lower work roll 2 and the lower backup roll 4 was adjusted to within the allowable range, and causes the pressing-down device 27 to adjust the rolls so that the roll gap between the upper work roll 1 and the lower work roll 2 becomes a predetermined size (S230). Thereafter, reduction position zero point adjustment or rolling of a workpiece by the rolling mill is started.

(Calculation of Reference Value 2 and Second Control Target Value)

Calculation of the reference value 2 and the second control target value will now be described in detail based on FIG. 8B. In the second adjustment, a tightening load is applied in a kiss roll state in which the upper and lower work rolls are caused to contact each other, and the positions of the chocks of the work roll and the backup roll on the opposite side to the reference roll are controlled so that a vertical roll load difference that arises due to a thrust force between the upper and lower work rolls in that state becomes a predetermined target value.

First, as illustrated on the upper side of FIG. 8B, in the kiss roll state, rotation of all of the rolls is stopped, and a vertical roll load on the work side and a vertical roll load on the drive side of the upper roll assembly, and a vertical roll load on the work side and a vertical roll load on the drive side of the lower roll assembly are measured. Next, based on these measurement values, a vertical roll load difference that is the difference between the vertical roll load on the work side and the vertical roll load on the drive side is calculated for each of the upper roll assembly and the lower roll assembly (P41, P42). The vertical roll load difference of each roll assembly is calculated by the following formula (7).

[Expression 7]

$$\left.\begin{aligned} P_{df2}^{0T} &= P_W^{0T} - P_D^{0T} \\ P_{df2}^{0B} &= P_W^{0B} - P_D^{0B} \end{aligned}\right\} \tag{7}$$

Here, $P^0{}_{df2}{}^T$ represents a difference between vertical roll load measurement values on the work side and the drive side of the upper roll assembly in a state in which the rolls are stopped in a kiss roll state (upper-side reference value $2^T$), and $P^0{}_{df2}{}^B$ represents a difference between the vertical roll load measurement values on the work side and the drive side of the lower roll assembly in a state in which the rolls are stopped in a kiss roll state (lower-side reference value $2^B$). The reference value 2 in step S220 refers to the upper-side reference value $2^T$ and the lower-side reference value $2^B$.

Next, the rolls are rotated in the kiss roll state, and second control target values are calculated based on measurement values on the drive side and the work side for upper and lower vertical roll loads that are measured and the corresponding reference value 2 calculated by the above formula (7). With regard to the second control target value also, similarly to the first control target value, the state in which the rolls are stopped is taken as the reference, and a control target value (second control target value) that makes a thrust force between the upper and lower work rolls zero can be adopted. The respective second control target values can be expressed by the following formula (8).

[Expression 8]

$$\left.\begin{aligned} P_{dfT2}^{rT} &= P_{df2}^{0T} \\ P_{dfT2}^{rB} &= P_{df2}^{0B} \end{aligned}\right\} \tag{8}$$

Here, $P^r{}_{dfT2}{}^T$ represents a second control target value of the upper roll assembly, and $P^r{}_{dfT2}{}^B$ represents a second control target value of the lower roll assembly. Note that, whilst a method that calculates loads in the vertical direction for both the upper and lower roll assemblies is described with regard to the above calculation, in the case of the second adjustment, because the difference is a difference between vertical roll loads that arises due to a thrust force between the upper and lower work rolls in the kiss roll state in which the upper and lower work rolls are caused to contact each other, the influence produced by the inter-roll cross appears similarly in both the upper and lower roll assemblies. Therefore, in this case, it suffices to perform control of the work roll and backup roll chock positions on the opposite side to the reference roll using at least the value for either one of the upper and lower roll assemblies (P43).

[3-2. Summary]

A method for setting a rolling mill according to the second embodiment of the present invention has been described above. According to the present embodiment, control target values for making an inter-roll cross angle zero are set that are calculated based on vertical roll load differences that are based on vertical roll load differences which do not arise when rolls are stopped but which appear during roll rotation, and the aforementioned first adjustment and second adjustment are performed before reduction position zero point adjustment or before the start of rolling. By this means, rolling of a workpiece is performed in a state in which an inter-roll cross angle has been eliminated, and hence the occurrence of zigzagging and camber of the workpiece can be suppressed.

4. Relation Between Inter-Roll Cross Angle and Vertical Roll Load Difference

In the methods for setting a rolling mill according to the first and second embodiments that are described above, in order to eliminate an inter-roll cross, control of the positions of roll chocks is performed so that a thrust counterforce that arises between rolls becomes zero or becomes a value within an allowable range. This is based on the finding that the correlations described hereunder exist between thrust counterforces and inter-roll cross angles. Hereunder, relations between an inter-roll cross angle and a vertical roll load difference are described based on FIG. 11 to FIG. 15.

[4-1. Relation when Roll Gap is in Open State]

Figure 11:
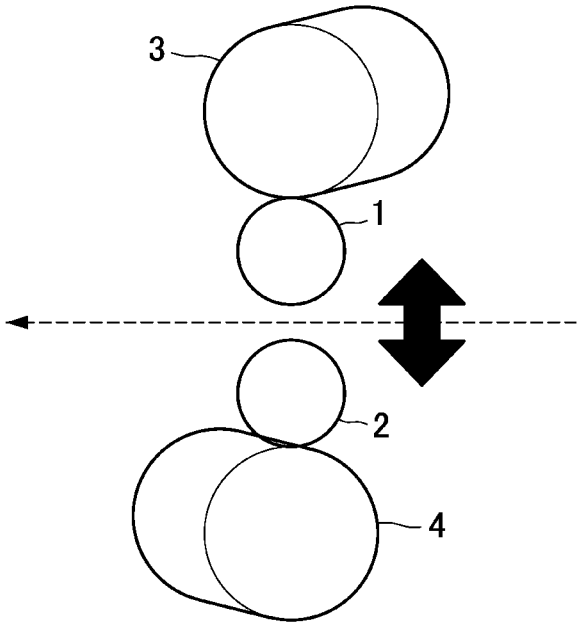
FIG. 11 is an explanatory drawing illustrating the arrangement of work rolls and backup rolls of a rolling mill in which a roll gap is in an open state.
Figure 12:
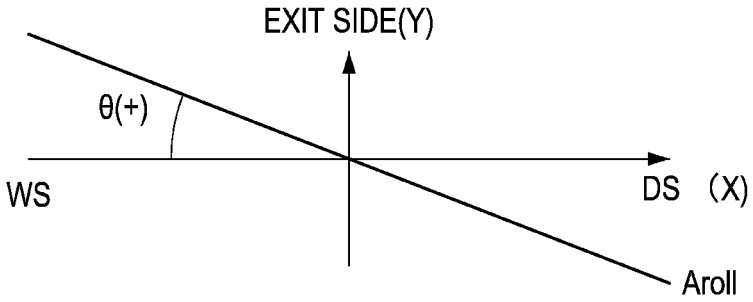
FIG. 12 is an explanatory drawing showing the definition of an inter-roll cross angle.
Figure 13:
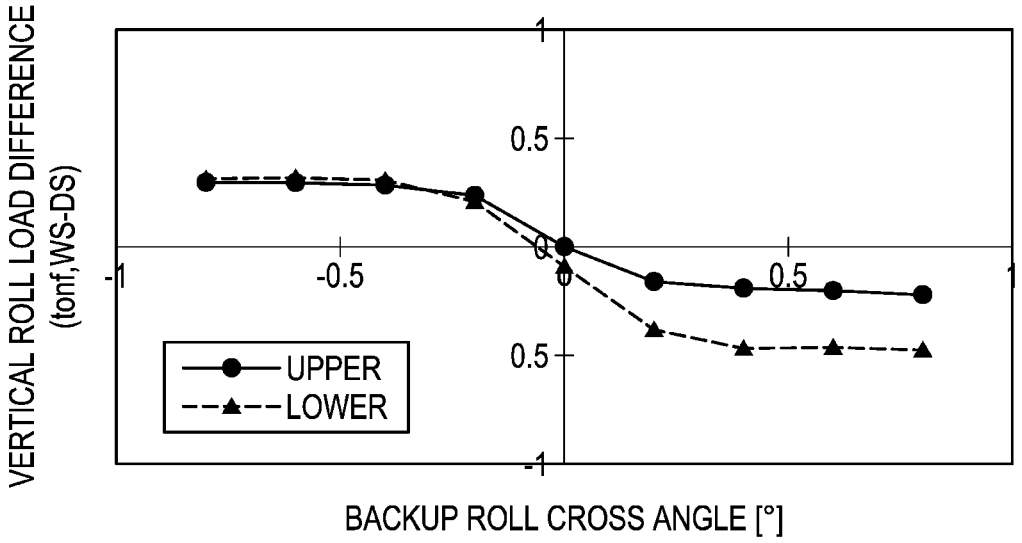
FIG. 13 is a graph illustrating a relation between a backup roll cross angle and a vertical roll load difference, in the state in which a roll gap is open illustrated in FIG. 11.

First, based on FIG. 11 to FIG. 13, the relation between an inter-roll cross and a vertical roll load difference in a case where a roll gap between the work rolls is in an open state will be described. FIG. 11 is an explanatory drawing illustrating the arrangement of the work rolls 1 and 2 and the backup rolls 3 and 4 of a rolling mill in which the roll gap is in an open state. FIG. 12 is an explanatory drawing showing the definition of an inter-roll cross angle. FIG. 13 is a graph illustrating a relation between a backup roll cross angle and a vertical roll load difference in a state in which the roll gap is open, which was obtained as a result of experiments performed using a small rolling mill with a work roll diameter of 80 mm. Note that, in FIG. 13, values are shown that were obtained by measuring vertical roll load differences of upper and lower backup rolls in both a case where a backup roll cross angle was set in an increasing direction and a case where a backup roll cross angle was set in a decreasing direction, respectively, and averaging the measurement values for the increasing direction and the measurement values for the decreasing direction.

As illustrated in FIG. 11, the roll gap between the upper work roll 1 and the lower work roll 2 was set in an open state, and a state was formed in which an increase bending force was applied by an increase bending apparatus to the work roll chocks. Then, changes in the vertical roll load difference when the cross angles of the upper backup roll 3 and the lower backup roll 4 were changed, respectively, were investigated. As illustrated in FIG. 12, with respect to the cross angle of a backup roll, a direction in which the work side of a roll axis Aron extending in the axial direction of the roll extends from the width direction (X-direction) toward the exit side is represented as positive. Further, as the increase bending force, 0.5 tonf was applied per roll chock.

As a result it was found that, as illustrated in FIG. 13, there is a relation such that, as the cross angle of the upper backup roll 3 and the lower backup roll 4 gradually increases from a negative angle to an angle of zero to a positive angle, the value for the vertical roll load difference gradually decreases. It was ascertained that, at such time, with respect to the vertical roll load difference, when the cross angle of the backup roll is zero, the value of the vertical roll load difference also becomes zero. Therefore, in a state in which the roll gap is in an open state and an increase bending force is applied, it is possible to ascertain the influence of thrust forces attributable to an inter-roll cross angle between a backup roll and a work roll of each roll assembly based on vertical roll load differences. Further, it is known that it is possible to reduce inter-roll thrust forces by controlling the positions of roll chocks so that these values become zero.

[4-2. Relation in Kiss Roll State]

Figure 14:
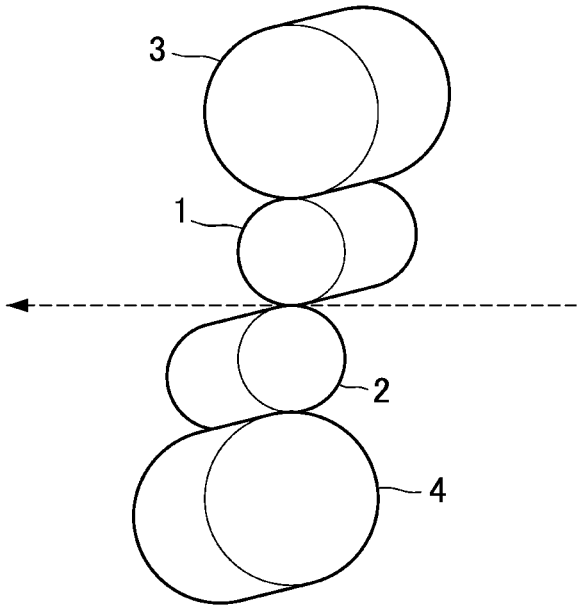
FIG. 14 is an explanatory drawing illustrating the arrangement of work rolls and backup rolls of a rolling mill set in a kiss roll state, that shows a state with a pair cross.
Figure 15:
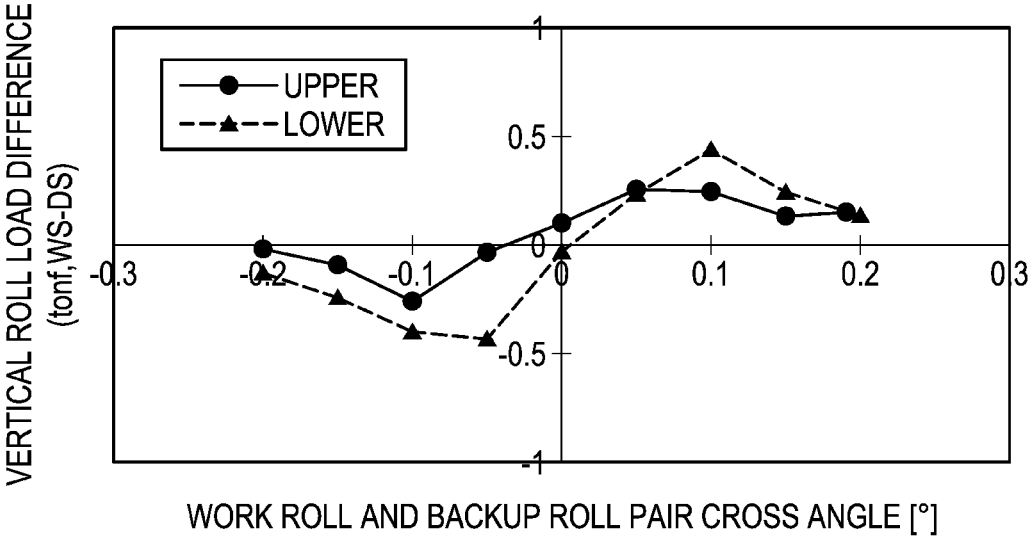
FIG. 15 is a graph showing a relation between a backup roll cross angle and a vertical roll load difference in the kiss roll state illustrated in FIG. 14.

Next, the relation between a roll pair cross angle and a vertical roll load difference in a case where the work rolls are in a kiss roll state will be described based on FIG. 14 and FIG. 15. FIG. 14 is an explanatory drawing illustrating the arrangement of the work rolls 1 and 2 and the backup rolls 3 and 4 of the rolling mill that has been set in a kiss roll state. FIG. 15 is a graph illustrating a relation between a pair cross angle between a work roll and a backup roll, and a vertical roll load difference in a kiss roll state. Note that, in FIG. 15, values are shown that were obtained by measuring vertical roll load differences of upper and lower backup rolls in both a case where a pair cross angle between a work roll and a backup roll was set in an increasing direction and a case where the pair cross angle was set in a decreasing direction, respectively, and averaging the measurement values for the increasing direction and the measurement values for the decreasing direction.

In this case, as illustrated in FIG. 14, changes in the vertical roll load difference when the upper work roll 1 and the lower work roll 2 were set in a kiss roll state and pair cross angles between the work rolls and the backup rolls were changed, respectively, were investigated. At such time, a kiss roll tightening load was made 6.0 tonf.

As a result it was found that, as illustrated in FIG. 15, as the pair cross angle gradually increases from a negative angle to an angle of zero to a positive angle, the vertical roll load difference changes in correspondence with the changes in the pair cross angle, and when the pair cross angle is zero, the vertical roll load difference also becomes zero. By this means, in a state in which a kiss roll tightening load is applied, it is possible to detect the influence of a thrust forces attributable to a cross between the upper and lower work rolls based on the vertical roll load differences. Further, it was confirmed that there is a possibility that inter-roll thrust forces between upper and lower work rolls can be reduced by controlling roll chock positions in a manner that takes the respective work rolls and backup rolls on the top and bottom as a single body so that the aforementioned values become zero.

Example 1

A conventional method and the method of the present invention were compared with respect to fifth to seventh stands of a hot finish rolling mill having the configuration illustrated in FIG. 2, in relation to reduction leveling setting that takes into consideration the influence of inter-roll thrust forces generated due to an inter-roll cross.

First, in the conventional method, without using the functions of the inter-roll cross control unit of the present invention, replacement of housing liners and chock liners was periodically performed, and equipment management was conducted so that an inter-roll cross would not occur. As a result, in a period immediately before replacement of the housing liner, when a thin and wide material having a finished exit-side plate thickness of 1.2 mm and a width of 1500 mm was rolled, zigzagging of 100 mm or more occurred at the sixth stand, and tail crash occurred as a result.

On the other hand, in the method of the present invention, using the functions of the inter-roll cross control unit according to the first embodiment that is described above, in a kiss roll tightened state, a thrust counterforce of each roll was measured, and in accordance with the processing flow illustrated in FIG. 3A and FIG. 3B, the roll chock positions of the respective rolls were controlled so that vertical roll load differences prior to rolling entered an allowable range that was set in advance. As a result, in a period immediately before replacement of the housing liner also, even in a case where a thin and wide material having a finished exit-side plate thickness of 1.2 mm and a width of 1500 mm with respect to which tail crash occurred in the conventional method was rolled, the occurrence of zigzagging stayed at 12 mm or less, and the workpiece could pass through the rolling line without causing tail crash to occur in the workpiece.

As described above, according to the method of the present invention, vertical roll load differences that are differences between vertical roll loads measured on the work side and drive side are calculated before rolling, and the roll chock positions of the respective rolls are controlled with respect to a reference roll so that the vertical roll load differences enter an allowable range based on appropriate logic, and by this means an inter-roll cross itself is eliminated, and left-right asymmetric deformation of a workpiece that occurs due to thrust forces caused by an inter-roll cross can be eliminated. Therefore, a metal plate material can be stably produced without zigzagging and camber or with extremely little zigzagging and camber.

Example 2

Next, a conventional method and the method of the present invention were compared in relation to reduction leveling setting that takes into consideration the influence of thrust forces generated due to an inter-roll cross.

First, in the conventional method, without using the functions of the inter-roll cross control unit of the present invention, replacement of housing liners and chock liners was periodically performed, and equipment management was conducted so that an inter-roll cross would not occur.

On the other hand, in the method of the present invention, using the functions of the inter-roll cross control unit according to the second embodiment that is described above, adjustment of the positions of roll chocks was performed in accordance with the processing flow illustrated in FIG. 7A and FIG. 7B before rolling. That is, first, in a state in which the roll gap was set in an open state and an increase bending force was applied, vertical roll loads were measured in a state in which rolls were rotated and in a state in which rolls were stopped, and the positions of the upper and lower work rolls chocks were controlled. Next, the rolls were set in a kiss roll state, vertical roll loads were measured in a state in which rolls were rotated and in a state in which rolls were stopped, and the positions of the roll chocks of the upper and lower work rolls and backup rolls were controlled so that the vertical roll load differences during rotation entered an allowable range that was set in advance.

Table 1 shows actual measurement values for the occurrence of camber with regard to a representative number of rolled workpieces, with respect to the present invention and the conventional method. Among the actual performance values for camber per 1 m of a front end portion of the workpieces, when the value for immediately before backup roll replacement and immediately before housing liner replacement is seen, it is found that in the case of the present invention the value is kept to a relatively small value of 0.12 mm/m. In contrast, in the case of the conventional method, in a period immediately before backup roll replacement and immediately before housing liner replacement, the actual measurement value for camber is large in comparison to the case of the present invention.

TABLE 1

| | Actual Measurement Values for Camber per 1 m at Front End Portion (mm/m) | | |
|---|---|---|---|
| | Immediately After Backup Roll Replacement | Immediately Before Backup Roll Replacement | Immediately Before Backup Roll Replacement and Immediately Before Housing Liner Replacement |
| Present Invention | 0.10 | 0.12 | 0.11 |
| Conventional Method | 0.20 | 0.59 | 0.83 |

As described above, according to the method of the present invention, vertical roll load differences are calculated before rolling, and the chock positions of the respective rolls are controlled with respect to a reference roll so that the vertical roll load differences enter an allowable range based on appropriate logic, and by this means an inter-roll cross itself is eliminated, and left-right asymmetric deformation of a workpiece that occurs due to thrust forces caused by an inter-roll cross can be eliminated. Therefore, a metal plate material can be stably produced without zigzagging and camber or with extremely little zigzagging and camber.

Whilst preferred embodiments of the present invention have been described in detail above with reference to the accompanying drawings, the present invention is not limited to the above examples. It is clear that a person having common knowledge in the field of the art to which the present invention pertains will be able to contrive various examples of changes and modifications within the category of the technical idea described in the appended claims, and it should be understood that they also naturally belong to the technical scope of the present invention.

Figure 16:
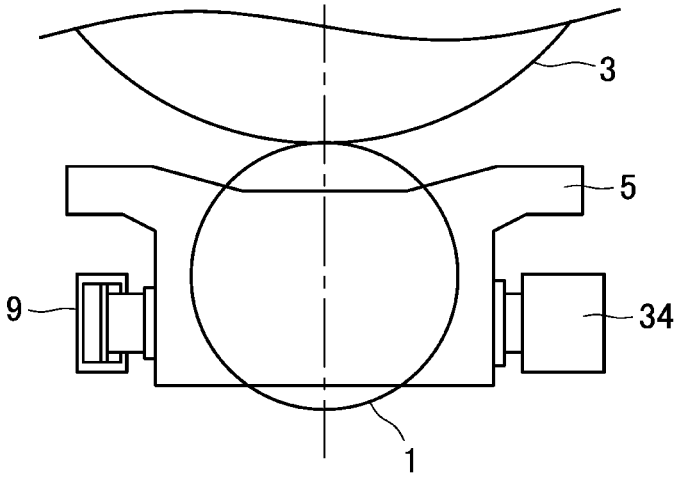
FIG. 16 is an explanatory drawing illustrating an example in which a servo-motor with a rotation angle detection function is applied instead of a hydraulic cylinder equipped with a roll chock position detection apparatus.

For example, although in the above embodiments a driving apparatus with a roll chock position detection function that detects the position in the rolling direction of work roll chocks is used, for example, as illustrated in FIG. 2, the present invention is not limited to this example. For example, even when using a servo-motor with a rotation angle detection function instead of a roll chock position detection apparatus, positions in the rolling direction of work roll chocks can be measured. That is, as shown in an example of the upper work roll 1 and the upper work roll chocks 5 that is illustrated in FIG. 16, a servo-motor with a rotation angle detection function 34 may be provided so as to face the driving apparatus with upper work roll chock position detection function 11 in the rolling direction of the upper work roll chocks 5. Further, with respect to the bending apparatuses also, it suffices that the bending apparatuses are apparatuses that cause a force to act in the vertical direction, and for example, a hydraulic jack may be employed for the bending apparatuses.

Further, although in the above description an example is described in which load detection apparatuses for detecting a load in the vertical direction are provided on the upper side and lower side, the present invention is not limited to this example. For example, in a case where a load detection apparatus for detecting a load in the vertical direction is provided on only one side among the upper side and lower side also, it is possible to perform similar control by, with respect to the side on which a load detection apparatus is not provided, performing adequate management and omitting the first adjustment on the assumption that there are few minute crosses of rolls.

Whilst a four-high rolling mill having a pair of work rolls and a pair of backup rolls has been described in the above embodiments, the present invention is applicable to a rolling mill of four-high or more. For example, in the case of a six-high rolling mill, a reference roll to serve as the reference for adjustment of the positions of roll chocks is set, and in such case, it suffices to set a roll located at the lowermost part or the uppermost part among the respective rolls arranged in the vertical direction, as the reference roll.

Figure 17A:
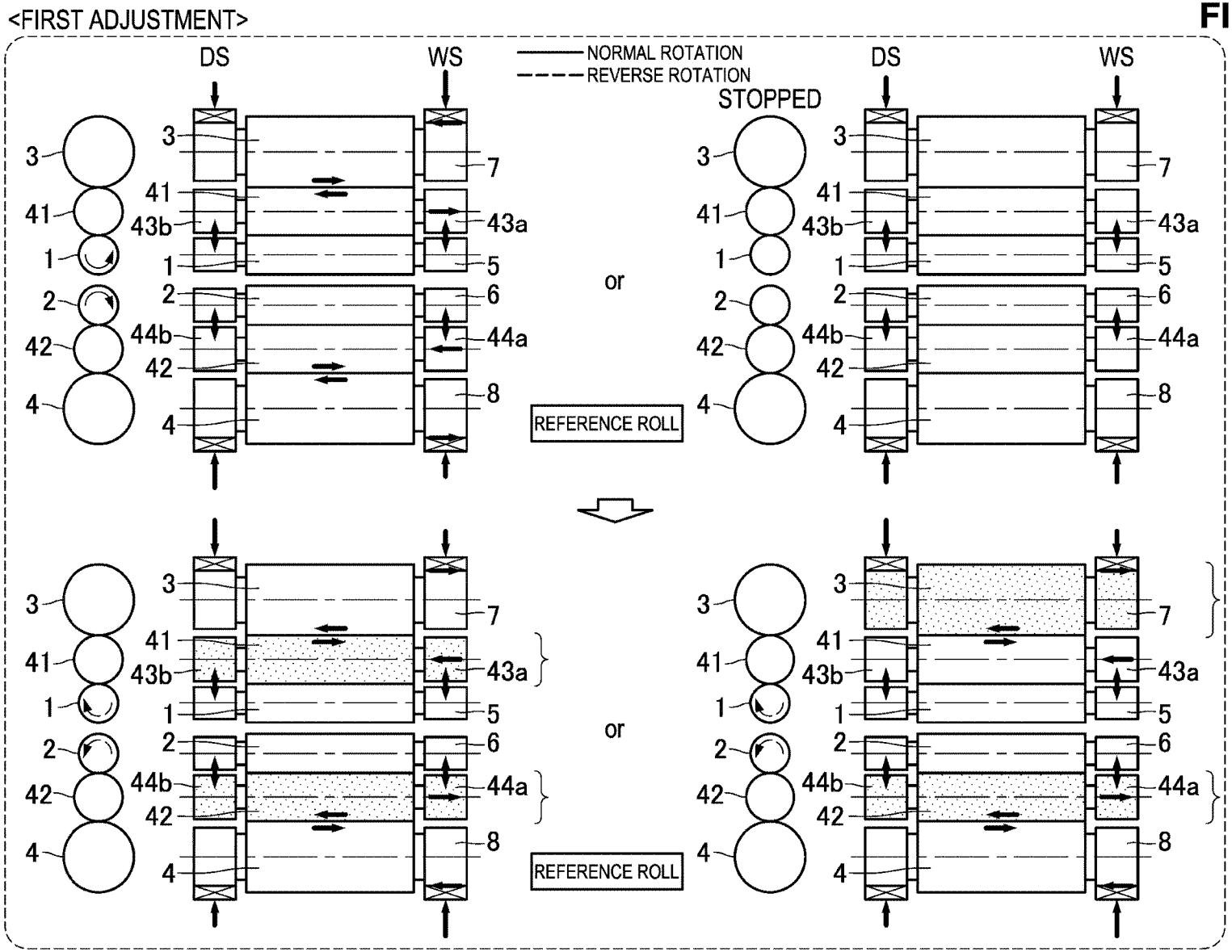
FIG. 17A is an explanatory drawing illustrating procedures for roll chock position adjustment (first adjustment) in a case where the method for setting a rolling mill illustrated in FIG. 4A
Figure 17B:
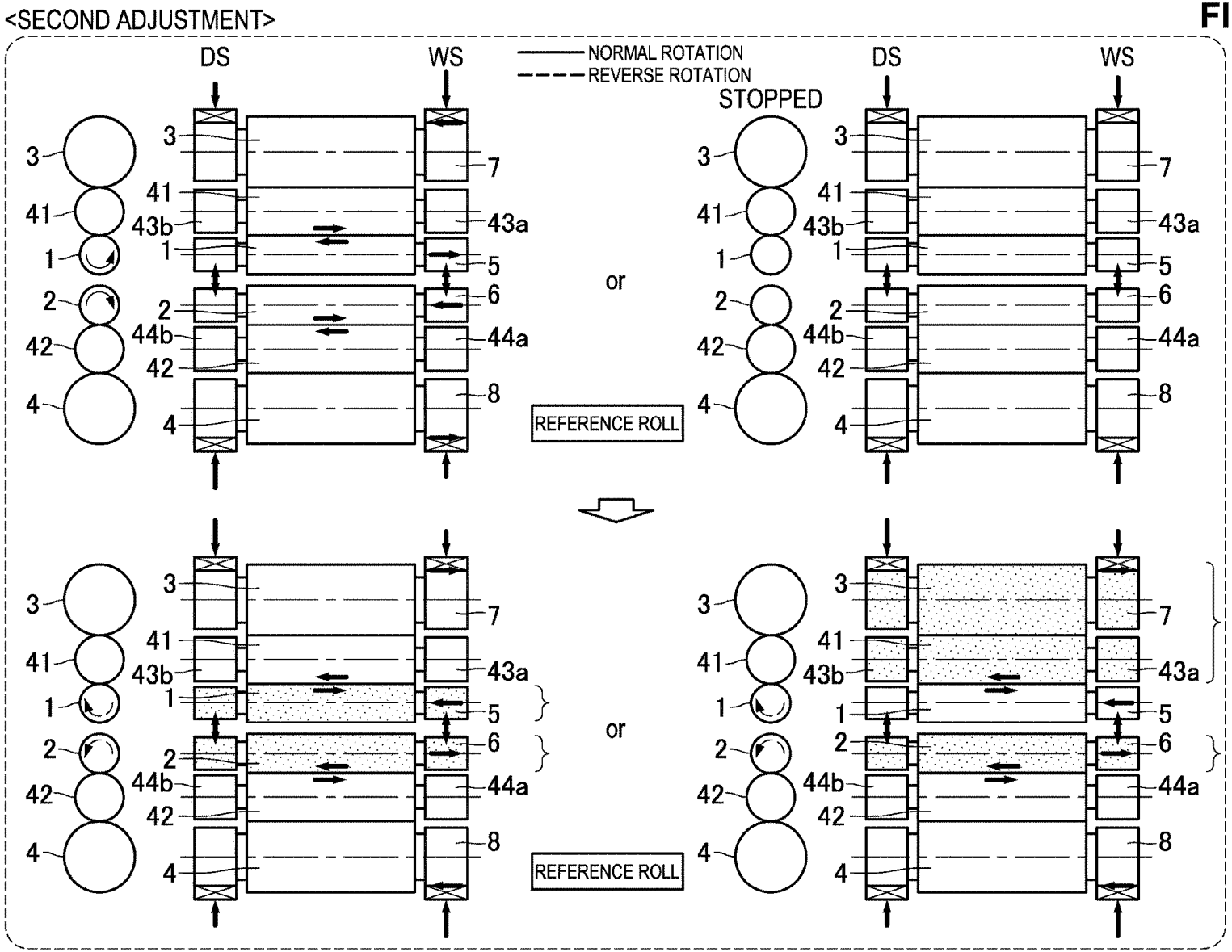
FIG. 17B is an explanatory drawing illustrating procedures for roll chock position adjustment (second adjustment) in a case where the setting method according to the present embodiment is applied to a six-high rolling mill.
Figure 17C:
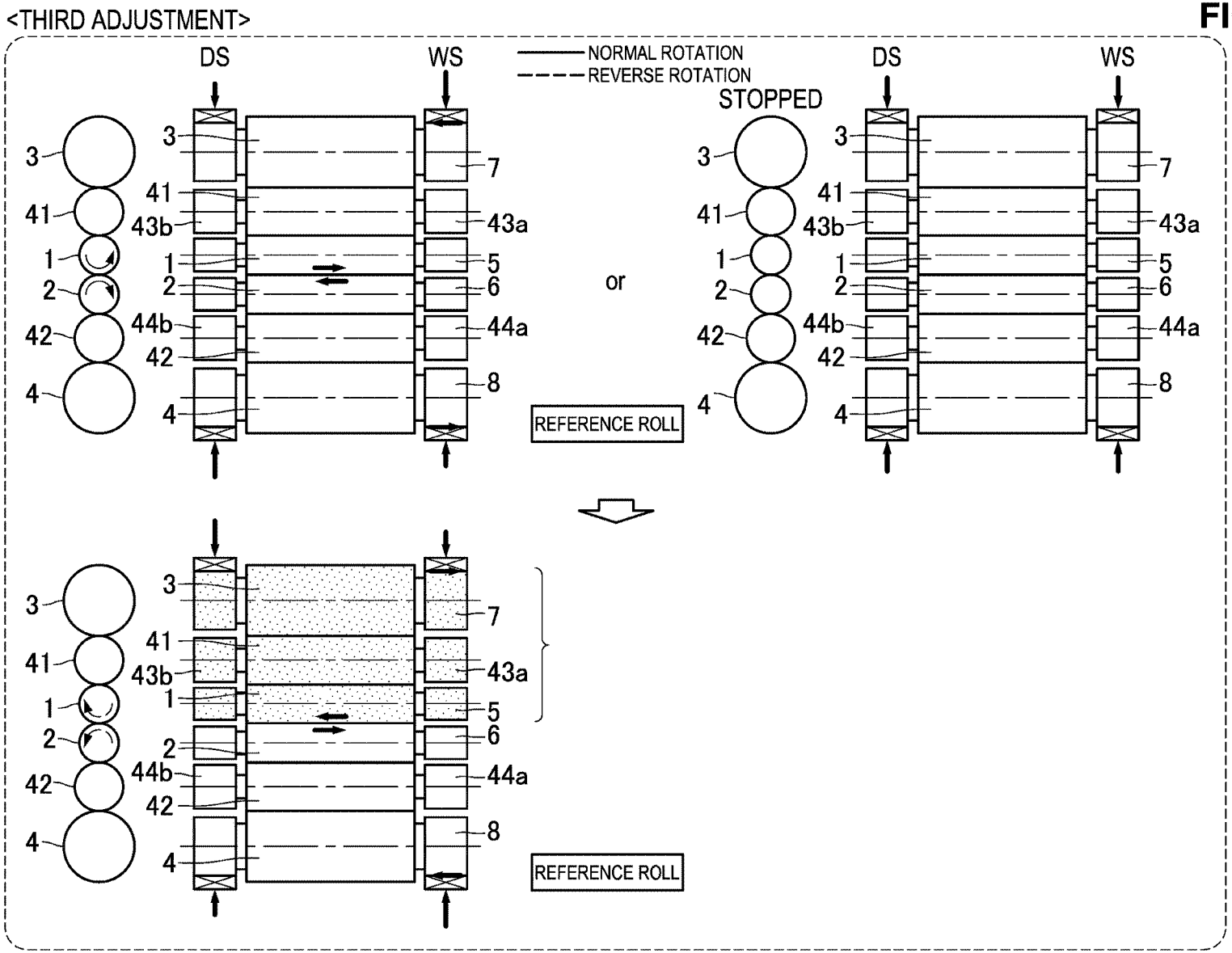
FIG. 17C is an explanatory drawing illustrating procedures for roll chock position adjustment (third adjustment) in a case where the method for setting a rolling mill illustrated in FIG. 4B

For example, as illustrated in FIG. 17A, in a six-high rolling mill, as the plurality of rolls, intermediate rolls 41 and 42 are provided between the work roll 1 and the backup roll 3, and the work roll 2 and the backup roll 4, respectively. The upper intermediate roll 41 is supported by an upper intermediate roll chock 43*a* on the work side and an upper intermediate roll chock 43*b* on the drive side (the upper intermediate roll chocks 43*a*, 43*b* are also referred to together as "upper intermediate roll chocks 43"). The lower intermediate roll 42 is supported by a lower intermediate roll chock 44*a* on the work side and a lower intermediate roll chock 44*b* on the drive side (the lower intermediate roll chocks 44*a*, 44*b* are also referred to together as "lower intermediate roll chocks 44"). Note that, the upper intermediate roll chocks 43 and the lower intermediate roll chocks 44 are also referred to as simply "roll chocks" in some cases. In the case of a six-high rolling mill, for example, by performing adjustment steps in three stages as illustrated in FIG. 17A to FIG. 17C, roll chock positions can be adjusted in a similar manner to the case of a four-high rolling mill.

Specifically, when adjusting the roll chock positions, as a first adjustment, in a state in which the roll gap between the work rolls 1 and 2 is set in an open state and a bending force is applied by bending apparatuses to the roll chocks 43 and 44 of the intermediate rolls 41 and 42, and for the upper roll assembly and the lower roll assembly, respectively, adjustment of positions is performed between the roll chocks 43 and 44 of the intermediate rolls 41 and 42 and the roll chocks 7 and 8 of the backup rolls 3 and 4 (FIG. 17A). Next, as a second adjustment, the roll gap between the work rolls 1 and 2 is maintained in the open state, and in a state in which a bending force is applied by bending apparatuses to the roll chocks 5 and 6 of the work rolls 1 and 2, for the upper roll assembly and the lower roll assembly, respectively, adjustment of positions is performed between the roll chocks 43 and 44 of the intermediate rolls 41 and 42 and the roll chocks 5 and 6 of the work rolls 1 and 2 (FIG. 17B). Thereafter, as a third adjustment, the work rolls 1 and 2 are set in a kiss roll state, and adjustment of the positions is performed between the roll chocks of the upper roll assembly and the lower roll assembly (FIG. 17C).

For example, in a case where the work rolls 1 and 2 are caused to rotate in the normal direction as illustrated on the left upper side in FIG. 17A, and in a case where the work rolls 1 and 2 are caused to rotate in the reverse direction as illustrated on the lower side in FIG. 17A, the first adjustment may be performed by calculating a load difference between a vertical roll load on the work side and a vertical roll load on the drive side, calculating a control target value, and then adjusting the positions of the roll chocks. This corresponds to the first adjustment in the case of a four-high rolling mill that is illustrated in FIG. 4A. In this case, first, the work rolls 1 and 2 are caused to rotate (normal rotation), and for each of the upper roll assembly and the lower roll assembly, vertical roll loads on the work side and the drive side are detected and a reference value 1 (corresponds to "first reference value" of the present invention) is calculated based on a load difference between the vertical roll load on the work side and the vertical roll load on the drive side. Next, the rotational direction of the work rolls 1 and 2 is reversed, and for each of the upper roll assembly and the lower roll assembly, vertical roll loads on the work side and the drive side are detected, a load difference between the vertical roll load on the work side and the vertical roll load on the drive side is calculated, and a first control target value is calculated based on a deviation between the relevant load difference and the corresponding reference value 1. Thereafter, the roll chocks 44 of the intermediate roll 42 on the side of the lower backup roll 4 that is the reference roll in FIG. 17A, and either the roll chocks 43 of the intermediate roll 41 or the roll chocks 7 of the backup roll 3 of the roll assembly on the opposite side to the reference roll are moved in the rolling direction to adjust the positions of the roll chocks so that the load difference becomes a value within an allowable range of the first control target value.

Alternatively, for example, in a case where the work rolls 1 and 2 are stopped as illustrated on the right upper side in FIG. 17A, and a case where the work rolls 1 and 2 are caused to rotate as illustrated on the lower side in FIG. 17A, the first adjustment may be performed by calculating a load difference between a vertical roll load on the work side and a vertical roll load on the drive side, calculating a control target value, and then adjusting the positions of the roll chocks. This corresponds to the first adjustment in the case of the four-high rolling mill illustrated in FIG. 8A. In this case, first, in a state in which rotation of the work rolls 1 and 2 is stopped, for each of the upper roll assembly and the lower roll assembly, vertical roll loads on the work side and the drive side are detected, a reference value 1 is calculated based on a load difference between the vertical roll load on the work side and the vertical roll load on the drive side, and a first control target value is set based on the reference value 1. Next, the work rolls 1 and 2 are caused to rotate, and for each of the upper roll assembly and the lower roll assembly, vertical roll loads on the work side and the drive side are detected, and a load difference between the vertical roll load on the work side and the vertical roll load on the drive side is calculated. Thereafter, the roll chocks 44 of the intermediate roll 42 on the side of the lower backup roll 4 that is the reference roll in FIG. 17A, and either the roll chocks 43 of the intermediate roll 41 or the roll chocks 7 of the backup roll 3 of the roll assembly on the opposite side to the reference roll are moved in the rolling direction to adjust the positions of the roll chocks so that the load difference becomes a value within an allowable range of the first control target value.

Regarding the second adjustment, similarly to the first adjustment, for example, in a case where the work rolls 1 and 2 are caused to rotate in the normal direction as illustrated on the left upper side in FIG. 17B, and in a case where the work rolls 1 and 2 are caused to rotate in the reverse direction as illustrated on the lower side in FIG. 17B, the second adjustment may be performed by calculating a load difference between a vertical roll load on the work side and a vertical roll load on the drive side, calculating a control target value, and then adjusting the positions of the roll chocks. In this case, first, the work rolls 1 and 2 are caused to rotate (normal rotation), and for each of the upper roll assembly and the lower roll assembly, vertical roll loads on the work side and the drive side are detected and a reference value 2 (corresponds to "second reference value" of the present invention) is calculated based on a load difference between the vertical roll load on the work side and the vertical roll load on the drive side. Next, the rotational direction of the work rolls 1 and 2 is reversed, and for each of the upper roll assembly and the lower roll assembly, vertical roll loads on the work side and the drive side are detected, a load difference between the vertical roll load on the work side and the vertical roll load on the drive side is calculated, and a second control target value is calculated based on a deviation between the relevant load difference and the corresponding reference value 2. Thereafter, the roll chocks 6 of the work roll 2 on the side of the lower backup roll 4 that is the reference roll, and either the roll chocks 5 of the work roll 1 or the roll chocks 7 and 43 of the intermediate roll 41 and the backup roll 3 of the roll assembly on the opposite side to the reference roll are moved in the rolling direction to adjust the positions of the roll chocks so that the load difference becomes a value within an allowable range of the second control target value.

Alternatively, for example, in a case where the work rolls 1 and 2 are stopped as illustrated on the right upper side in FIG. 17B, and a case where the work rolls 1 and 2 are caused to rotate as illustrated on the lower side in FIG. 17B, the second adjustment may be performed by calculating a load difference between a vertical roll load on the work side and a vertical roll load on the drive side, calculating a control target value, and then adjusting the positions of the roll chocks. In this case, first, in a state in which rotation of the work rolls 1 and 2 is stopped, for each of the upper roll assembly and the lower roll assembly, vertical roll loads on the work side and the drive side are detected, a reference value 2 is calculated based on a load difference between the vertical roll load on the work side and the vertical roll load on the drive side, and a second control target value is set based on the reference value 2. Next, the work rolls 1 and 2 are caused to rotate, and for each of the upper roll assembly and the lower roll assembly, vertical roll loads on the work side and the drive side are detected, and a load difference between the vertical roll load on the work side and the vertical roll load on the drive side is calculated. Thereafter, the roll chocks 6 of the work roll 2 on the side of the lower backup roll 4 that is the reference roll, and either the roll chocks 5 of the work roll 1 or the roll chocks 43 and 7 of the intermediate roll 41 and the backup roll 3 of the roll assembly on the opposite side to the reference roll are moved in the rolling direction to adjust the positions of the roll chocks so that the load difference becomes a value within an allowable range of the second control target value.

Note that, in the first adjustment, bending apparatuses of the intermediate rolls 41 and 42 are used to apply loads between the intermediate rolls 41 and 42 and the backup rolls 3 and 4, and the bending apparatuses of the work rolls 1 and 2 are set to apply zero force or a force of a degree that balances the weights of the rolls. Thus, in the case of a six-high rolling mill, first, in a first adjustment, the positions of chocks of an intermediate roll having a bending apparatus or of a backup roll on an opposite side to the reference roll are moved and adjusted in accordance with a cross angle between the intermediate roll and the backup roll. Subsequently, in a second adjustment, the bending apparatuses of the intermediate rolls 41 and 42 impart zero force or a force of a degree that balances the weights of the rolls, and similarly to the case of a four-high rolling mill, it suffices to use the bending apparatuses of the work rolls to apply a load between each work roll and the corresponding intermediate roll, and perform adjustment in accordance with a cross angle between the work rolls and intermediate rolls by moving the roll chock positions of the relevant work roll or the roll adjacent to the work roll, that is, the intermediate roll, together with the roll chocks of the backup roll.

In the third adjustment, the work rolls 1 and 2 are set in a kiss roll state, and the positions of the roll chocks of the entire rolling mill are adjusted. At this time, in a case where the work rolls 1 and 2 are caused to rotate in the normal direction as illustrated on the left upper side in FIG. 17C, and in a case where the work rolls 1 and 2 are caused to rotate in the reverse direction as illustrated on the lower side in FIG. 17C, the positions of the roll chocks may be adjusted. This corresponds to the second adjustment in the case of the four-high rolling mill illustrated in FIG. 4B. In this case, first, the rolls 1 and 2 are caused to rotate (normal rotation), and for each of the upper roll assembly and the lower roll assembly, vertical roll loads on the work side and the drive side are detected and a reference value 3 (corresponds to "third reference value" of the present invention) is calculated based on a load difference between the vertical roll load on the work side and the vertical roll load on the drive side. Next, the rotational direction of the work rolls 1 and 2 is reversed, and for each of the upper roll assembly and the lower roll assembly, vertical roll loads on the work side and the drive side are detected, a load difference between the vertical roll load on the work side and the vertical roll load on the drive side is calculated, and a third control target value is calculated based on a deviation between the relevant load difference and the corresponding reference value 3. Thereafter, either one of the upper roll assembly and the lower roll assembly is adopted as the reference roll assembly, which in the example illustrated in FIG. 17C is the lower roll assembly, and the roll chocks of each roll of the upper roll assembly are controlled simultaneously and in the same direction while maintaining the relative position between the roll chocks so as to adjust the positions of the roll chocks so that the load difference becomes a value within an allowable range of the third control target value.

Alternatively, for example, in a case where the work rolls 1 and 2 are stopped as illustrated on the right upper side in FIG. 17C, and a case where the work rolls 1 and 2 are caused to rotate as illustrated on the lower side in FIG. 17C, the third adjustment may be performed by adjusting the positions of the roll chocks. This corresponds to the second adjustment in the case of the four-high rolling mill illustrated in FIG. 8B. In this case, first, in a state in which rotation of the work rolls 1 and 2 is stopped, for each of the upper roll assembly and the lower roll assembly, vertical roll loads on the work side and the drive side are detected, a reference value 3 is calculated based on a load difference between the vertical roll load on the work side and the vertical roll load on the drive side, and a third target value is set based on the reference value 3. Next, the work rolls 1 and 2 are caused to rotate, and for each of the upper roll assembly and the lower roll assembly, vertical roll loads on the work side and the drive side are detected, and a load difference between the vertical roll load on the work side and the vertical roll load on the drive side is calculated. Thereafter, either one of the upper roll assembly and the lower roll assembly is adopted as the reference roll assembly, which in the example illustrated in FIG. 17C is the lower roll assembly, and the roll chocks of each roll of the upper roll assembly are controlled simultaneously and in the same direction while maintaining the relative position between the roll chocks so as to adjust the positions of the roll chocks so that the load difference becomes a value within an allowable range of the third control target value.

Note that, a setting method can be independently decided on for each of the first adjustment, the second adjustment and the third adjustment. For example, the first adjustment may be performed by subjecting the work rolls 1 and 2 to normal rotation and to reverse rotation, and the second adjustment may be performed by stopping the work rolls 1 and 2 and rotating the work rolls 1 and 2. Thus, the present invention is also applicable to a six-high rolling mill, and not just a four-high rolling mill. Furthermore, the present invention is similarly applicable to rolling mills other than a four-high rolling mill and a six-high rolling mill, and for example the present invention can also be applied to an eight-high rolling mill or a five-high rolling mill. Further, in the case of a five-high rolling mill and a six-high rolling mill, it suffices to determine the reference value 1, the first control target value, the reference value 2, the second control target value, the reference value 3 and the third control target value by similar methods to formulas (1) to (8). With regard to a reference value for a reference value 4 or more and a control target value for a fourth control target value or more in a rolling mill of eight-high or more also, it suffices to determine the values by similar methods to formulas (1) to (8).

REFERENCE SIGNS LIST

1 Upper work roll
2 Lower work roll
3 Upper backup roll
4 Lower backup roll
5*a* Upper work roll chock (work side)
5*b* Upper work roll chock (drive side)
6*a* Lower work roll chock (work side)
6*b* Lower work roll chock (drive side)
7*a* Upper backup roll chock (work side)
7*b* Upper backup roll chock (drive side)
8*a* Lower backup roll chock (work side)
8*b* Lower backup roll chock (drive side)
9 Upper work roll chock pressing apparatus
10 Lower work roll chock pressing apparatus
11 Driving apparatus with upper work roll chock position detection function
12 Driving apparatus with lower work roll chock position detection function
13 Upper backup roll chock pressing apparatus
14 Driving apparatus with upper backup roll chock position detection function
15 Roll chock rolling direction force control unit
16 Roll chock position control unit
21 Driving electric motor
22 Driving electric motor control unit
23 Inter-roll cross control unit
24*a* Entrance-side upper increase bending apparatus
24*b* Exit-side upper increase bending apparatus
25*a* Entrance-side lower increase bending apparatus
25*b* Exit-side lower increase bending apparatus
26 Increase bending control unit
27 Pressing-down device
28*a* Upper vertical roll load detection apparatus (work side)
28*b* Upper vertical roll load detection apparatus (drive side)
29*a* Lower vertical roll load detection apparatus (work side)
29*b* Lower vertical roll load detection apparatus (drive side)
30 Housing
30*a*, 30*b* Rolling support point position
32 Upper vertical roll load difference calculation portion [subtractor]
33 Lower vertical roll load difference calculation portion [subtractor]
34 Servo-motor with rotation angle detection function
40 Lower backup roll chock pressing apparatus
41 Upper intermediate roll
42 Lower intermediate roll
43 Upper intermediate roll chock
43*a* Upper intermediate roll chock (work side)
43*b* Upper intermediate roll chock (drive side)
44 Lower intermediate roll chock
44*a* Lower intermediate roll chock (work side)
44*b* Lower intermediate roll chock (drive side)

The invention claimed is:

1. A rolling mill of four-high or more that includes a plurality of rolls including at least a pair of work rolls and a pair of backup rolls supporting the work rolls, in which any one roll among respective rolls arranged in a vertical direction is adopted as a reference roll, comprising:

a load detector which, at a rolling support point position on a work side and a drive side of the backup rolls, detects a vertical roll load that acts in the vertical direction of the backup rolls;

a pressing apparatus which, with respect to at least roll chocks of the rolls other than the reference roll, is provided on either one of an entrance side and an exit side in a rolling direction of a workpiece, the pressing apparatus pressing the roll chocks in the rolling direction;

a driving apparatus, including a hydraulic cylinder, which, with respect to the roll chocks of the rolls other than the reference roll, is provided so as to face the pressing apparatus in the rolling direction, the driving apparatus moving the roll chocks in the rolling direction;

a vertical roll load difference calculation portion which calculates a vertical roll load difference between the vertical roll load detected by the load detector on the work side and the vertical roll load detected by the load detector on the drive side; and a position controller which fixes a rolling direction position of the roll chocks of the reference roll as a reference position, and drives the driving apparatus to control positions in the rolling direction of the roll chocks of the rolls other than the reference roll so that the calculated vertical roll load difference becomes a value within an allowable range.

2. The rolling mill according to claim 1, wherein a roll located at a lowermost part or an uppermost part in the vertical direction among the plurality of rolls is adopted as the reference roll.

3. The rolling mill according to claim 2, wherein the driving apparatus is the hydraulic cylinder comprising a roll chock position detection apparatus.

4. The rolling mill according to claim 2, comprising:

a bending apparatus that imparts a bending force to the rolls;

wherein the position controller sets a roll gap between the work rolls in an open state, and imparts a bending force by means of the bending apparatus to the roll chocks on a side of the roll that is a position adjustment object.

5. The rolling mill according to claim 4, wherein the driving apparatus is the hydraulic cylinder comprising a roll chock position detection apparatus.

6. The rolling mill according to claim 1, comprising:

a bending apparatus that imparts a bending force to the work rolls;

wherein the position controller sets a roll gap between the work rolls in an open state, and imparts a bending force by means of the bending apparatus to the roll chocks on a side of the roll that is a position adjustment object.

7. The rolling mill according to claim 6, wherein the driving apparatus is the hydraulic cylinder comprising a roll chock position detection apparatus.

8. The rolling mill according to claim 1, wherein the driving apparatus is the hydraulic cylinder comprising a roll chock position detection apparatus.

9. A method for setting a rolling mill, the rolling mill being a rolling mill of four-high or more that includes a plurality of rolls including at least a pair of work rolls and a pair of backup rolls supporting the work rolls, and a load detector which, at a rolling support point position on a work side and a drive side of the backup rolls, detects a vertical roll load that acts in a vertical direction of the rolls;

the method for setting a rolling mill being executed before reduction position zero point adjustment or before starting rolling, in which any one roll among respective rolls arranged in the vertical direction is adopted as a reference roll, the method comprising:

calculating a vertical roll load difference that is a difference between a vertical roll load detected by the load detector on the work side and a vertical roll load detected by the load detector on the drive side; and fixing a rolling direction position of roll chocks of the reference roll as a reference position and moving roll chocks of the rolls other than the reference roll in a rolling direction of a workpiece to adjust positions of the roll chocks so that the vertical roll load difference becomes a value within an allowable range.

10. The method for setting a rolling mill according to claim 9, wherein a roll located at a lowermost part or an uppermost part in the vertical direction among the plurality of rolls is adopted as the reference roll.

11. The method for setting a rolling mill according to claim 10, the rolling mill being a four-high rolling mill, wherein:

a plurality of rolls provided on an upper side in the vertical direction with respect to the workpiece are taken as an upper roll assembly, and a plurality of rolls provided on a lower side in the vertical direction with respect to the workpiece are taken as a lower roll assembly;

the method including performing:

a first step of setting a roll gap between the work rolls in an open state, and in a state in which a bending force is imparted by a bending apparatus to the roll chocks of the work rolls, with respect to each of the upper roll assembly and the lower roll assembly, adjusting positions of the roll chocks of the work roll and the roll chocks of the backup roll, and after finishing the first step, a second step of setting the work rolls in a kiss roll state, and adjusting positions of the roll chocks of the upper roll assembly and the lower roll assembly;

wherein:

the first step includes performing:

a first reference value calculation step of causing the rolls to rotate in a predetermined rotational direction, and with respect to each of the upper roll assembly and the lower roll assembly, detecting a vertical roll load on the work side and on the drive side and calculating a first reference value based on a vertical roll load difference that is a difference between the vertical roll load on the work side and the vertical roll load on the drive side, a first control target value calculation step of reversing the rotational direction of the rolls, and with respect to each of the upper roll assembly and the lower roll assembly, detecting a vertical roll load on each of the work side and the drive side and calculating a first control target value based on a deviation between a vertical roll load difference that is a difference between the vertical roll load on the work side and the vertical roll load on the drive side and the first reference value, and a first adjustment step of moving the roll chocks of the work roll of a roll assembly on the reference roll side in the rolling direction or moving the roll chocks of the work roll or the backup roll of a roll assembly on an opposite side to the reference roll in the rolling direction to adjust positions of the roll chocks so that the vertical roll load difference becomes a value within an allowable range of the first control target value; and the second step includes setting the work rolls in a kiss roll state, and performing:

a second reference value calculation step of causing the rolls to rotate in a predetermined rotational direction, and with respect to each of the upper roll assembly and the lower roll assembly, detecting a vertical roll load on the work side and on the drive side and calculating a second reference value based on a vertical roll load difference that is a difference between the vertical roll load on the work side and the vertical roll load on the drive side, a second control target value calculation step of reversing the rotational direction of the rolls, and with respect to each of the upper roll assembly and the lower roll assembly, detecting a vertical roll load on the work side and on the drive side and calculating a second control target value based on a deviation between a vertical roll load difference that is a difference between the vertical roll load on the work side and the vertical roll load on the drive side and the second reference value, and a second adjustment step of adopting one of the upper roll assembly and the lower roll assembly as a reference roll assembly, and controlling the roll chocks of each roll of the other roll assembly simultaneously and in a same direction while maintaining relative positions between the roll chocks to adjust positions of the roll chocks so that the vertical roll load difference becomes a value within an allowable range of the second control target value.

12. The method for setting a rolling mill according to claim 10, the rolling mill being the rolling mill that is six-high and comprises intermediate rolls between the work rolls and the backup rolls, respectively, wherein:

a plurality of rolls provided on an upper side in the vertical direction with respect to the workpiece are taken as an upper roll assembly, and a plurality of rolls provided on a lower side in the vertical direction with respect to the workpiece are taken as a lower roll assembly;

the method including performing:

a first step of setting a roll gap between the work rolls in an open state, and in a state in which a bending force is imparted by a bending apparatus to the roll chocks of the intermediate rolls, with respect to each of the upper roll assembly and the lower roll assembly, adjusting positions of the roll chocks of the intermediate roll and the roll chocks of the backup roll, after finishing the first step, a second step of maintaining the roll gap between the work rolls in an open state, and in a state in which a bending force is imparted by a bending apparatus to the roll chocks of the work rolls, with respect to each of the upper roll assembly and the lower roll assembly, adjusting positions of the roll chocks of the intermediate roll and the roll chocks of the work roll, and after finishing the second step, a third step of setting the work rolls in a kiss roll state, and adjusting positions of the roll chocks of the upper roll assembly and the lower roll assembly;

wherein:

the first step includes performing:

a first reference value calculation step of causing the rolls to rotate in a predetermined rotational direction, and with respect to each of the upper roll assembly and the lower roll assembly, detecting a vertical roll load on the work side and on the drive side and calculating a first reference value based on a vertical roll load difference that is a difference between the vertical roll load on the work side and the vertical roll load on the drive side, a first control target value calculation step of reversing the rotational direction of the rolls, and with respect to each of the upper roll assembly and the lower roll assembly, detecting a vertical roll load on the work side and the drive side and calculating a first control target value based on a deviation between a vertical roll load difference that is a difference between the vertical roll load on the work side and the vertical roll load on the drive side and the first reference value, and a first adjustment step of moving the roll chocks of the intermediate roll of a roll assembly on the reference roll side and either of the roll chocks of the intermediate roll and the roll chocks of the backup roll of a roll assembly on an opposite side to the reference roll in the rolling direction to adjust positions of the roll chocks so that the vertical roll load difference becomes a value within an allowable range of the first control target value;

the second step includes performing:

a second reference value calculation step of causing the rolls to rotate in a predetermined rotational direction, and with respect to each of the upper roll assembly and the lower roll assembly, detecting a vertical roll load on the work side and on the drive side and calculating a second reference value based on a vertical roll load difference that is a difference between the vertical roll load on the work side and the vertical roll load on the drive side, a second control target value calculation step of reversing the rotational direction of the rolls, and with respect to each of the upper roll assembly and the lower roll assembly, detecting a vertical roll load on the work side and on the drive side and calculating a second control target value based on a deviation between a vertical roll load difference that is a difference between the vertical roll load on the work side and the vertical roll load on the drive side and the second reference value, and a second adjustment step of moving the roll chocks of the work roll of a roll assembly on the reference roll side and either the roll chocks of the work roll or the roll chocks of the intermediate roll and the backup roll of a roll assembly on an opposite side to the reference roll in the rolling direction to adjust positions of the roll chocks so that the vertical roll load difference becomes a value within an allowable range of the second control target value; and the third step includes setting the work rolls in a kiss roll state, and performing:

a third reference value calculation step of causing the rolls to rotate in a predetermined rotational direction, and with respect to each of the upper roll assembly and the lower roll assembly, detecting a vertical roll load on the work side and on the drive side and calculating a third reference value based on a vertical roll load difference that is a difference between the vertical roll load on the work side and the vertical roll load on the drive side, a third control target value calculation step of reversing the rotational direction of the rolls, and with respect to each of the upper roll assembly and the lower roll assembly, detecting a vertical roll load on the work side and on the drive side and calculating a third control target value based on a deviation between a vertical roll load difference that is a difference between the vertical roll load on the work side and the vertical roll load on the drive side and the third reference value, and a third adjustment step of adopting one of the upper roll assembly and the lower roll assembly as a reference roll assembly, and controlling the roll chocks of each roll of the other roll assembly simultaneously and in a same direction while maintaining relative positions between the roll chocks to adjust positions of the roll chocks so that the vertical roll load difference becomes a value within an allowable range of the third control target value.

13. The method for setting a rolling mill according to claim 10, the rolling mill being a four-high rolling mill, wherein:

a plurality of rolls provided on an upper side in the vertical direction with respect to the workpiece are taken as an upper roll assembly, and a plurality of rolls provided on a lower side in the vertical direction with respect to the workpiece are taken as a lower roll assembly;

the method including performing:

a first step of setting a roll gap between the work rolls in an open state, and in a state in which a bending force is imparted by a bending apparatus to the roll chocks of the work rolls, with respect to each of the upper roll assembly and the lower roll assembly, adjusting positions of the roll chocks of the work roll and the roll chocks of the backup roll, and after finishing the first step, a second step of setting the work rolls in a kiss roll state, and adjusting positions of the roll chocks of the upper roll assembly and the lower roll assembly;

wherein:

the first step includes performing:

a first control target value calculation step of, in a state in which rotation of the rolls is stopped, with respect to each of the upper roll assembly and the lower roll assembly, detecting a vertical roll load on the work side and on the drive side, calculating a first reference value based on a vertical roll load difference that is a difference between the vertical roll load on the work side and the vertical roll load on the drive side, and setting a first control target value based on the first reference value, a first load difference calculation step of causing the rolls to rotate and, with respect to each of the upper roll assembly and the lower roll assembly, detecting a vertical roll load on the work side and on the drive side and calculating a vertical roll load difference that is a difference between the vertical roll load on the work side and the vertical roll load on the drive side, and a first adjustment step of moving the roll chocks of the work roll of a roll assembly on the reference roll side in the rolling direction or moving the roll chocks of the work roll or the backup roll of a roll assembly on an opposite side to the reference roll in the rolling direction to adjust positions of the roll chocks so that the vertical roll load difference becomes a value within an allowable range of the first control target value; and the second step includes setting the work rolls in a kiss roll state, and performing:

a second control target value calculation step of, in a state in which rotation of the rolls is stopped, with respect to each of the upper roll assembly and the lower roll assembly, detecting a vertical roll load on the work side and on the drive side, calculating a second reference value based on a vertical roll load difference that is a difference between the vertical roll load on the work side and the vertical roll load on the drive side, and setting a second control target value based on the second reference value, a second load difference calculation step of causing the rolls to rotate and, with respect to each of the upper roll assembly and the lower roll assembly, detecting a vertical roll load on the work side and on the drive side and calculating a vertical roll load difference that is a difference between the vertical roll load on the work side and the vertical roll load on the drive side, and a second adjustment step of adopting one of the upper roll assembly and the lower roll assembly as a reference roll assembly, and controlling the roll chocks of each roll of the other roll assembly simultaneously and in a same direction while maintaining relative positions between the roll chocks to adjust positions of the roll chocks so that the vertical roll load difference becomes a value within an allowable range of the second control target value.

14. The method for setting a rolling mill according to claim 10, the rolling mill being the rolling mill that is six-high and comprises intermediate rolls between the work rolls and the backup rolls, respectively, wherein:

a plurality of rolls provided on an upper side in the vertical direction with respect to the workpiece are taken as an upper roll assembly, and a plurality of rolls provided on a lower side in the vertical direction with respect to the workpiece are taken as a lower roll assembly;

the method including performing:

a first step of setting a roll gap between the work rolls in an open state, and in a state in which a bending force is imparted by a bending apparatus to the roll chocks of the intermediate rolls, with respect to each of the upper roll assembly and the lower roll assembly, adjusting positions of the roll chocks of the intermediate roll and the roll chocks of the backup roll, after finishing the first step, a second step of maintaining the roll gap between the work rolls in an open state, and in a state in which a bending force is imparted by a bending apparatus to the roll chocks of the work rolls, with respect to each of the upper roll assembly and the lower roll assembly, adjusting positions of the roll chocks of the intermediate roll and the roll chocks of the work roll, and after finishing the second step, a third step of setting the work rolls in a kiss roll state, and adjusting positions of the roll chocks of the upper roll assembly and the lower roll assembly;

wherein:

the first step includes performing:

a first control target value calculation step of, in a state in which rotation of the rolls is stopped, with respect to each of the upper roll assembly and the lower roll assembly, detecting a vertical roll load on the work side and on the drive side, calculating a first reference value based on a vertical roll load difference that is a difference between the vertical roll load on the work side and the vertical roll load on the drive side, and setting a first control target value based on the first reference value, a first load difference calculation step of causing the rolls to rotate and, with respect to each of the upper roll assembly and the lower roll assembly, detecting a vertical roll load on the work side and on the drive side and calculating a vertical roll load difference that is a difference between the vertical roll load on the work side and the vertical roll load on the drive side, and a first adjustment step of moving the roll chocks of the intermediate roll of a roll assembly on the reference roll side and either of the roll chocks of the intermediate roll and the roll chocks of the backup roll of a roll assembly on an opposite side to the reference roll in the rolling direction to adjust positions of the roll chocks so that the vertical roll load difference becomes a value within an allowable range of the first control target value;

the second step includes performing:

a second control target value calculation step of, in a state in which rotation of the rolls is stopped, with respect to each of the upper roll assembly and the lower roll assembly, detecting a vertical roll load on the work side and on the drive side, calculating a second reference value based on a vertical roll load difference that is a difference between the vertical roll load on the work side and the vertical roll load on the drive side, and setting a second control target value based on the second reference value, a second load difference calculation step of causing the rolls to rotate and, with respect to each of the upper roll assembly and the lower roll assembly, detecting a vertical roll load on the work side and on the drive side and calculating a vertical roll load difference that is a difference between the vertical roll load on the work side and the vertical roll load on the drive side, and a second adjustment step of moving the roll chocks of the work roll of a roll assembly on the reference roll side and either the roll chocks of the work roll or the roll chocks of the intermediate roll and the backup roll of a roll assembly on an opposite side to the reference roll to move in the rolling direction to adjust positions of the roll chocks so that the vertical roll load difference becomes a value within an allowable range of the second control target value; and the third step includes setting the work rolls in a kiss roll state, and performing:

a third control target value calculation step of, in a state in which rotation of the rolls is stopped, with respect to each of the upper roll assembly and the lower roll assembly, detecting a vertical roll load on the work side and on the drive side, calculating a third reference value based on a vertical roll load difference that is a difference between the vertical roll load on the work side and the vertical roll load on the drive side, and setting a third control target value based on the third reference value, a third load difference calculation step of causing the rolls to rotate and, with respect to each of the upper roll assembly and the lower roll assembly, detecting a vertical roll load on the work side and on the drive side and calculating a vertical roll load difference that is a difference between the vertical roll load on the work side and the vertical roll load on the drive side, and a third adjustment step of adopting one of the upper roll assembly and the lower roll assembly as a reference roll assembly, and controlling the roll chocks of each roll of the other roll assembly simultaneously and in a same direction while maintaining relative positions between the roll chocks to adjust positions of the roll chocks so that the vertical roll load difference becomes a value within an allowable range of the third control target value.

* * * * *